US006086185A

United States Patent [19]

Inui et al.

[11] Patent Number: 6,086,185

[45] **Date of Patent: *Jul. 11, 2000**

[54] INK JET RECORDING METHOD AND INK JET RECORDING APPARATUS

[75] Inventors: Toshiharu Inui, Yokohama; Jiro Moriyama, Kawasaki; Hiroaki Kitazawa, Machida; Yasuhiro Numata, Kawasaki; Takayoshi Ishino; Isao Ebisawa, both of Yokohama; Hisao Yaegashi, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/143,156

[22] Filed: Oct. 29, 1993

[30] Foreign Application Priority Data

| | | | |
|---|---|---|---|
| Oct. 30, 1992 | [JP] | Japan | 4-292540 |
| Oct. 30, 1992 | [JP] | Japan | 4-292641 |
| Oct. 30, 1992 | [JP] | Japan | 4-292642 |
| Oct. 30, 1992 | [JP] | Japan | 4-293007 |
| Dec. 28, 1992 | [JP] | Japan | 4-361306 |
| Oct. 7, 1993 | [JP] | Japan | 5-251822 |

[51] Int. Cl.[7] ..... B41J 2/21

[52] U.S. Cl. ..... 347/43

[58] Field of Search ..... 347/43, 35, 12, 347/23, 9, 14

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,540,996 | 9/1985 | Saito | 347/43 |

(List continued on next page.)

FOREIGN PATENT DOCUMENTS

| | | | |
|---|---|---|---|
| 0433556 | 6/1991 | European Pat. Off. . | |
| 8906890 | 8/1990 | Germany . | |
| 08906890 | 12/1990 | Germany . | |
| 54-56847 | 5/1979 | Japan . | |
| 58-138656 | 8/1983 | Japan . | |
| 58-173669 | 10/1983 | Japan . | |
| 59-089160 | 5/1984 | Japan . | |
| 59-123670 | 7/1984 | Japan . | |
| 59-138461 | 8/1984 | Japan . | |
| 60-71260 | 4/1985 | Japan . | |
| 61-104856 | 5/1986 | Japan . | |
| 1-216852 | 8/1989 | Japan | 347/43 |
| 3146355 | 6/1991 | Japan . | |
| 4158049 | 6/1992 | Japan . | |

OTHER PUBLICATIONS

Patent Abstracts of Japan, vol. 10, No. 286 (M–521) (2342), with respect to Japanese Patent Document No. 61–104856 (May 23, 1986).

Patent Abstracts of Japan, vol. 8, No. 201 (M–325) (1638), with respect to Japanese patent Document No. 59–89160 (May 23, 1986).

*Primary Examiner*—N. Le
*Assistant Examiner*—Michael Nghiem
*Attorney, Agent, or Firm*—Fitzpatrick, Cella, Harper & Scinto

[57] ABSTRACT

When the color printing is performed using a recording head arranged such that number of nozzles for discharging black ink is greater than the number of nozzles for discharging inks of other colors, the use frequency of some nozzles among all the nozzles for discharging the black ink is higher, so that image unevenness may arise when transferred to the black printing. The present invention relates to an ink jet recording method and an ink jet recording apparatus in which the image unevenness often seen in the black printing involving the use of more nozzles than other colors, and the blur of recorded image seen in the image having black images adjacent color images located are reduced.

40 Claims, 67 Drawing Sheets

U.S. PATENT DOCUMENTS

| | | | |
|---|---|---|---|
| 4,558,332 | 12/1985 | Takahashi | 347/35 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,748,453 | 5/1988 | Lin et al. | 347/43 X |
| 4,750,009 | 6/1988 | Yoshimura . | |
| 4,864,328 | 9/1989 | Fischbeck | 347/43 |
| 4,963,882 | 10/1990 | Hickman | 347/43 X |
| 4,967,203 | 10/1990 | Doan et al. | 347/41 |
| 4,967,204 | 10/1990 | Tesasawa et al. | 347/30 X |
| 4,989,016 | 1/1991 | Gatten et al. | 347/40 X |

1
10a
10b
10c
10d

CYAN

MAGENTA

YELLOW

24
BLACK
BLACK
BLACK
YELLOW
MAGENTA
CYAN

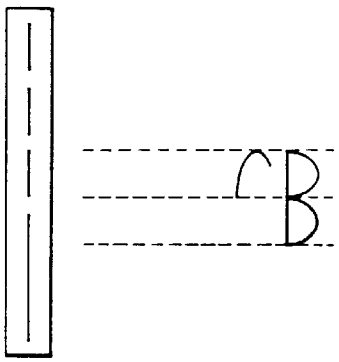
FIG. 36D
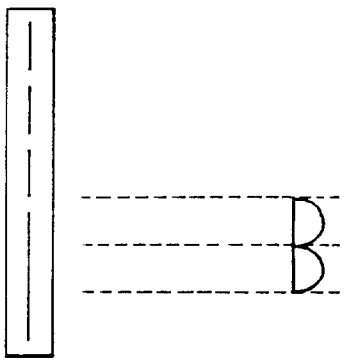
FIG. 36C
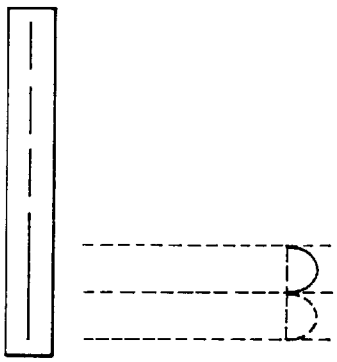
FIG. 36B
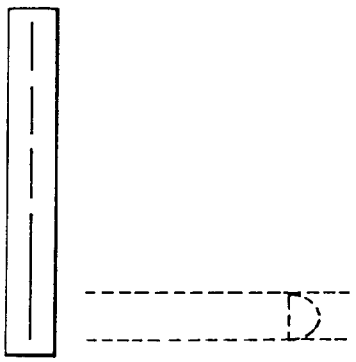
FIG. 36A
FIG. 36H
FIG. 36G
FIG. 36F
FIG. 36E

INK JET RECORDING METHOD AND INK JET RECORDING APPARATUS

BACKGROUND OF THE INVENTION

1. Field of the Invention

The present invention relates to an ink jet recording method for recording a multi-color image by using the inks of a plurality of colors and a recording head having a plurality of nozzles corresponding to such colors, and particularly to an ink jet recording method of using a recording head in which the number of nozzles for a specific color is greater than the number of nozzles for other colors.

2. Related Background Art

Conventionally, methods of recording color image using four colors of yellow (Y), magenta (M), cyan (C) and black (Bk) have been well known and applied to printers or copying machines.

As one technique for such methods, an ink jet recording method of using four ink jet recording heads corresponding to four colors to permit independent discharging of four colors has been put to practical use. This method has the merits that the recording heads can be used in common when the amount of discharging the ink for each color is equal, and the driving method of each recording head can be simple, because the recording heads are independent for each color.

On the other hand, this method has the drawback that it is unsuitable for the smaller apparatus in the recent trend, since four recording heads are mounted, resulting in higher costs and complicated assembling.

Also, since the four recording heads are used, this method is suitable for the higher speed, but if the printing is made on the recording sheet on which the ink is less liable to fix, such as a plain paper, the blur of color inks, may easily occur, resulting in the image quality remarkably degraded.

Therefore, a recording head has been proposed in which nozzle (discharge unit) groups for discharging the inks of four colors of yellow, magenta, cyan and black are arranged not to be overlapped in a scan direction, as shown in FIG. 1. This recording head allows the use of single recording head to provide a multi-color image, and is very suitable for inexpensive and small-sized apparatuses. Also, this recording head hardly produces the blur of inks, resulting in higher quality of image, although it takes longer time to perform the printing, as compared with the use of the four recording heads.

However, the use of this recording head in which the nozzle groups for four colors are not overlapped, as shown in FIG. 1, can not completely prevent the blur of color inks from occurring. Also, it is naturally required that the color printers or color copying machines produce the black image of high quality, comparable to that of conventional white and black apparatuses. To meet that requirement, an attempt has been made to make the discharge amount of black ink greater than that of color inks. However, in this case, there was a problem that the blur of inks was remarkable at the boundaries between black image and color image, resulting in the quite bad print quality.

Also, various proposals for recording the color image using plural color inks have been made to achieve the higher quality recording and higher speed recording.

In Japanese Laid-Open Patent Application No. 58-138656 (hereinafter referred to as conventional example 1), the present applicant has proposed a method of arranging an increased number of ink jet nozzles corresponding to only a main color K among CMYK to attain a recording speed in the recording mode of only color K faster than in the color recording mode.

Also, the present applicant has proposed a method for improving the image quality in Japanese Laid-Open Patent Application No. 58-173669 (hereinafter referred to as conventional example 2) and Japanese Laid-Open Patent Application No. 3-146355 (hereinafter referred to as conventional example 3). According to conventional example 3, a proposal has been made to achieve the overall improvement by discharging a greater amount of K ink than that of other inks. Also, according to this conventional example 3, another proposal has been made to prevent the blur of K in such a manner that other colors than K are not recorded around the K.

Also, according to U.S. Pat. No. 4,967,203 (hereinafter referred to as conventional example 4), a proposal has been made to suppress the blur as a whole in such a manner as to record all colors in either a cross pattern or a counter-cross pattern at the forward recording.

However, in the above method of conventional example 1, the number of nozzles used for K is equal to the number of nozzles for CMY at the color recording, which means that no improvement in the recording speed or recording quality is expected at the color recording.

Also, in the above proposal of conventional example 2, the overall image quality may be enhanced, but in some cases, the blur of K may spread over CMY at the color recording, resulting in degraded image quality.

Also, in the above proposal of conventional example 3, unrecorded pixels around K may expose the underlying color, for example, white on the white paper, resulting in degraded image quality.

Also, in the above proposal of conventional example 4, the substantial recording may slow down to one-half thereof. The same recording speed can be attained by doubling the number of nozzles for the recording head, but there is the disadvantage of increasing the costs of an expensive recording head or a control or drive circuit section.

Suppose now an instance wherein an ink jet head (recording head) has discharge nozzle groups for yellow (Y), magenta (M), cyan (C) and black (Bk), and the number of black nozzles is greater than the number of nozzles for each color, or wherein the longitudinal length of black nozzle group is equal to or greater than the longitudinal length of font data, or the longitudinal length of color nozzle groups is equal to or greater than the longitudinal length of font data. The color recording with such recording head is accomplished by using all the nozzles of the heads for yellow, magenta and cyan, and only predetermined nozzles of black head, while reciprocating the recording head in a main scan direction by multiple times. Also, the recording of monochrome image is performed by discharging the ink onto the recording sheet, using all the nozzles of black head.

Therefore, conventionally, in performing the recording with such recording head, when control is transferred from the color recording to the monochrome recording, the recording operation of using all the nozzles including other nozzles than the predetermined nozzles of black head as described above which are not used during the color recording is started. However, the other nozzles which are not used before may not be fully activated, and therefore it is apprehended that the discharged ink causes an unevenness at the initiation of the recording. Such black unevenness may arise not only when switching is made from the color recording to the monochrome recording, but also when font data with its width exceeding the longitudinal length of nozzle group for the recording head is recorded in monochrome, because different section of the nozzles of the black head is used by each scan of the recording head, causing a problem that the recorded image has degraded quality.

SUMMARY OF THE INVENTION

An object of the present invention is to provide an ink jet recording method capable of recording a high quality image wherein the blur of ink at the boundaries between black image and color image is reduced.

Hence, the present invention provides an ink jet recording method for recording a multi-color image by relatively scanning a recording head across the recording sheet, the recording head having m discharge units for discharging the black ink and n discharge units (n<m) for discharging the color ink, corresponding to each of a plurality of colors, in which the discharge units of each color for discharging black and color ink are not overlapped in a scan direction, characterized in that when a black image printed with the black ink and a color image printed with the color ink are adjacent, predetermined discharge units among a group of discharge units for discharging the black ink are used so that the scan for forming the black image and the scan for forming the color image may not be continuous.

Also, the present invention is characterized in that the color ink is yellow, magenta, and cyan.

Further, the present invention is characterized in that the discharging unit number m for the group of discharge units for discharging the black ink and the discharge unit number n for the groups of discharge units for discharging the color inks satisfies an inequality $m \geqq 2n$.

The present invention has been achieved in view of the foregoing problems, and its object is to provide an ink jet recording method of using multi-color inks whereby the improvement in the recorded image quality can be attained without increasing the costs of the recording head or the control or drive circuit section and without decreasing the recording speed.

To accomplish the above object, the present invention provides an ink jet recording head having the inks of two or more colors and two or more groups of nozzles for jetting the inks corresponding to such colors, in which at least one of the nozzle numbers for the nozzle groups corresponding to such colors is different from other nozzle numbers, characterized in that in performing the recording operation for a certain area, the recording pixel charging frequency per nozzle with a nozzle group having the greatest number of nozzles in the certain area is smaller than that with other nozzle groups in the certain area.

To accomplish such an object, the present invention is characterized by comprising a recording head having the inks for plural colors, and the nozzle columns for discharging the inks corresponding to such colors, wherein the nozzle number of a specific color among the nozzles numbers corresponding to such colors is at least N times or greater that of other colors, and the recording for the specific color is performed in such a manner as to discharge the ink onto the same recording pixel through a different nozzle by at least M times the number of discharging other colors, where M, N are integers equal to or greater than 2, and $N \geqq M$.

Accordingly, the present invention has been achieved in view of the above-stated problem, and its object is to provide an ink jet recording apparatus provided with a plurality of print heads having different nozzle numbers, wherein the use frequencies of a plurality of nozzles for a print head having a greater nozzle number than other heads are averaged to prevent the image unevenness from occurring due to use frequency variations.

To accomplish the above object, the present invention provides an ink jet recording apparatus provided with a plurality of recording heads comprising different numbers of nozzles to effect the recording by discharging the ink through such nozzles, characterized by comprising means for creating the image data corresponding to each of the plurality of recording heads, memory means for memorizing the image data, detecting means for detecting the use numbers of all nozzles of the recording heads, means for producing a discharge pattern to equalize the use frequencies for all the nozzles of a recording head having a greater number of nozzles than others among the plurality of recording heads, and means for masking the discharge pattern onto the image pattern of the memory means.

Also, means for solving the aforementioned problems associated with the conventional arts involves an ink jet recording method of recording a desired image by relatively scanning a recording head across the recording medium, the recording head comprising a group of m nozzles for discharging the black ink and a plurality of groups of n nozzles (n<m) for discharging the color inks corresponding to a plurality of colors, characterized in that when only the black image is printed, the group of m nozzles for discharging the black ink is totally used, the feed amount of the recording medium is equal to the amount of m nozzles, while when the color image including black image is printed, the feed amount of the recording medium is equal to the amount of n nozzles, so that the nozzles for use in printing the black image are not dedicated to specific nozzles among the group of m nozzles for discharging the black ink.

Further, the present invention is characterized in that when printing the color image, the nozzles for discharging the black ink are changed for every predetermined pages of the recording medium.

Further, the present invention is characterized in that when printing the color image, only the black image is formed by multiple scans entirely using the group of m nozzles used for discharging the black ink.

Further, the present invention is characterized in that when printing the color image, only the black image is formed by multiple scans using 1 ($m \geqq 1 > n$) nozzles for discharging the black ink, and the nozzles for discharging the black ink are changed for every predetermined pages of the recording medium.

Thus, the present invention provides an ink jet recording apparatus having a plurality of print heads each comprising a plurality of nozzles, in which a print head having a greater number of nozzles than other heads is prevented from printing with only a part of the plurality of nozzles.

The present invention has been achieved in view of the aforementioned conventional examples, and its object is to provide an ink jet recording method and apparatus capable of recording a high quality image with reduced density unevenness of recorded image.

To accomplish the above objects, the ink jet recording apparatus of the present invention has a constitution as stated below. That is, the ink jet recording apparatus which performs the recording by discharging the ink onto the recording medium comprises a plurality of recording heads each having arranged a plurality of nozzles, and recording means for recording in such a manner that predetermined nozzles of any other recording head than a recording head having the smallest number of nozzles are used corresponding to the smallest number of nozzles for the recording head, when the plurality of recording heads have different numbers of nozzles.

To accomplish the above object, the present invention provide an ink jet recording method for recording a color image by discharging the inks from a plurality of recording heads onto the recording medium, including the processes of recording the color image by having as the use object predetermined nozzles of any other recording head than a recording head having the smallest number of nozzles, corresponding to the number of nozzles for the recording head, when the plurality of recording heads have different numbers of nozzles, recording a monochrome image with all the nozzles of a recording head of black as the use object, and performing a predischarge for the nozzles out of the use object when recording the color image or monochrome image.

With the above constitution, when a plurality of recording heads each have arranged a plurality of nozzles, and the plurality of recording heads have different numbers of nozzles, the recording is performed by using predetermined nozzles of any other recording head than a recording head having the smallest number of nozzles, corresponding to the smallest number of nozzles thereof.

BRIEF DESCRIPTION OF THE DRAWINGS

FIGS. 36A to 36H are views for explaining a process of printing color image in the embodiment 2.

DETAILED DESCRIPTION OF THE PREFERRED EMBODIMENTS

The preferred embodiments of the present invention will be described below in detail with reference to the drawings.

(Embodiment 1)

Figure 1:
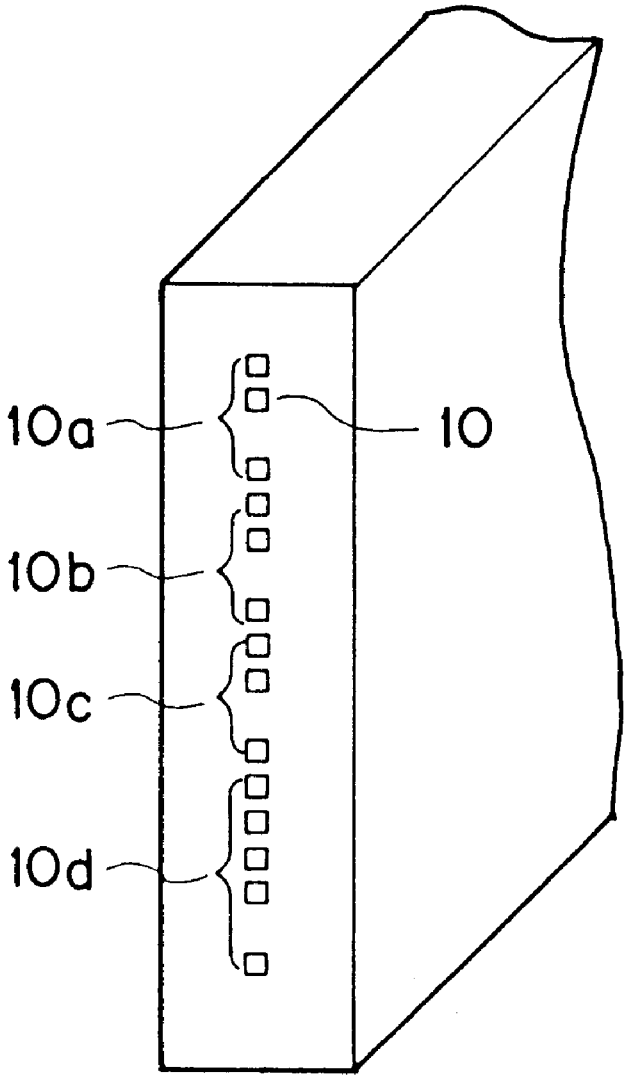
FIG. 1 is a schematic view for explaining a recording head used in example 1.

FIG. 1 shows schematically a recording head for use with an ink jet recording method of the present invention. 1 is a recording head, and 10 is a nozzle (discharge unit), wherein 10*a* is a nozzle group for discharging the yellow ink, 10*b* is a nozzle group for discharging the magenta ink, 10*c* is a nozzle group for discharging the cyan ink and 10*d* is a nozzle group for discharging the black ink. A nozzle group of each color is configured not to be overlapped in a main scan direction, with a space 10*e*, 10*f*, 10*g* provided between such nozzle group of each color. Not being overlapped in the main-scan direction means that no nozzle is disposed adjacent in the main scan direction. For example, in FIG. 1, no nozzle is disposed next to another in the horizontal direction. Each of a nozzle group 10*a*, a nozzle group 10*b*, and a nozzle group 10*c* has twenty four nozzles, and a nozzle group 10*d* has forty eight nozzles arranged at a density of 360 per inch (360 dpi). The discharge amount of nozzle 10*d* is about 80 ng, and the discharge amount of each of nozzles 10*a*, 10*b* and 10*c* is about 40 ng.

A print method for printing various images with the recording head as shown in FIG. 1 will be described below.

Figure 2:
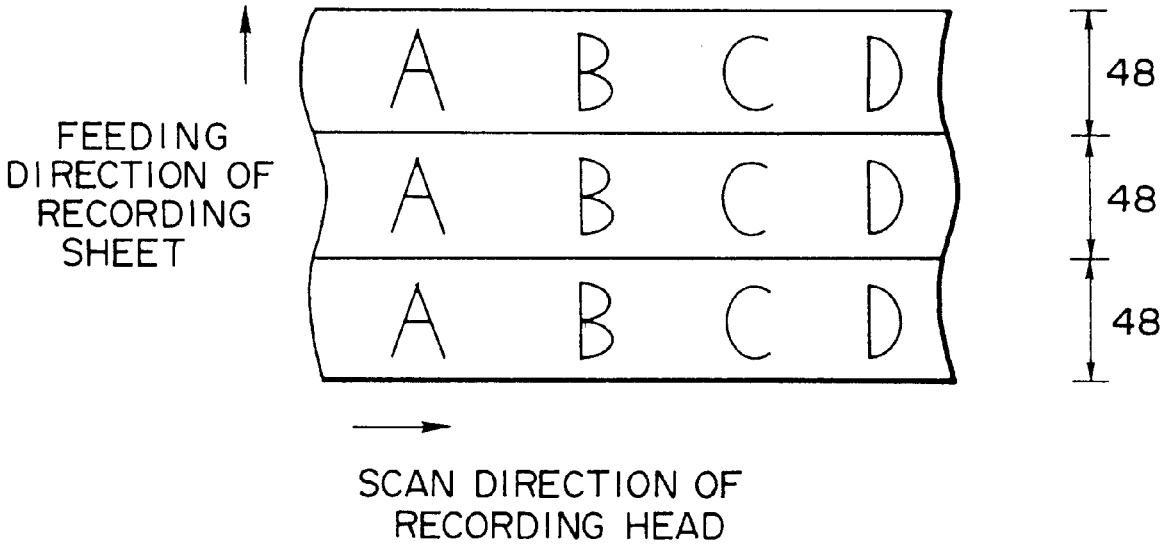
FIG. 2 is a view for explaining a process of printing only black image.
Figure 8A:
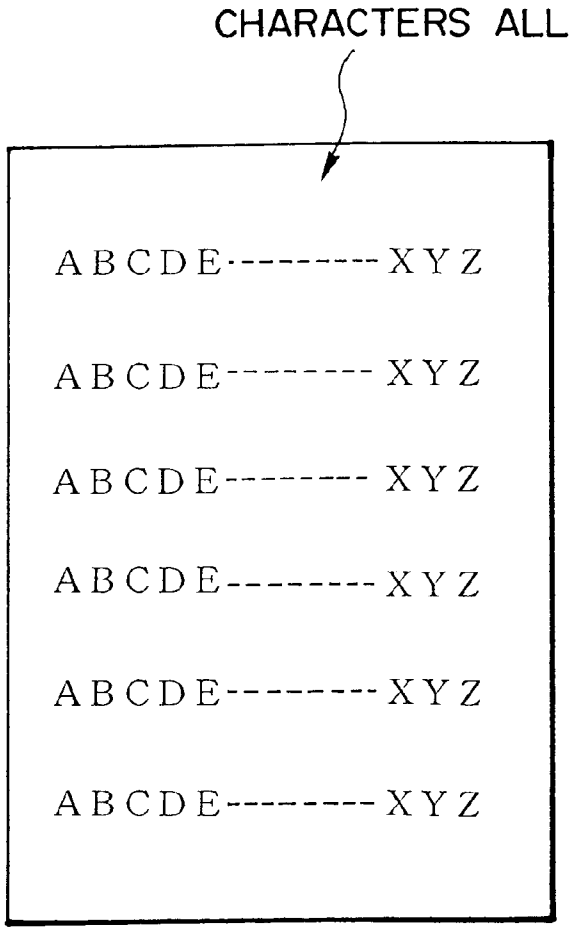
FIG. 8A and 8B are views for explaining the kind of image and the feeding of recording paper.
Figure 8B:
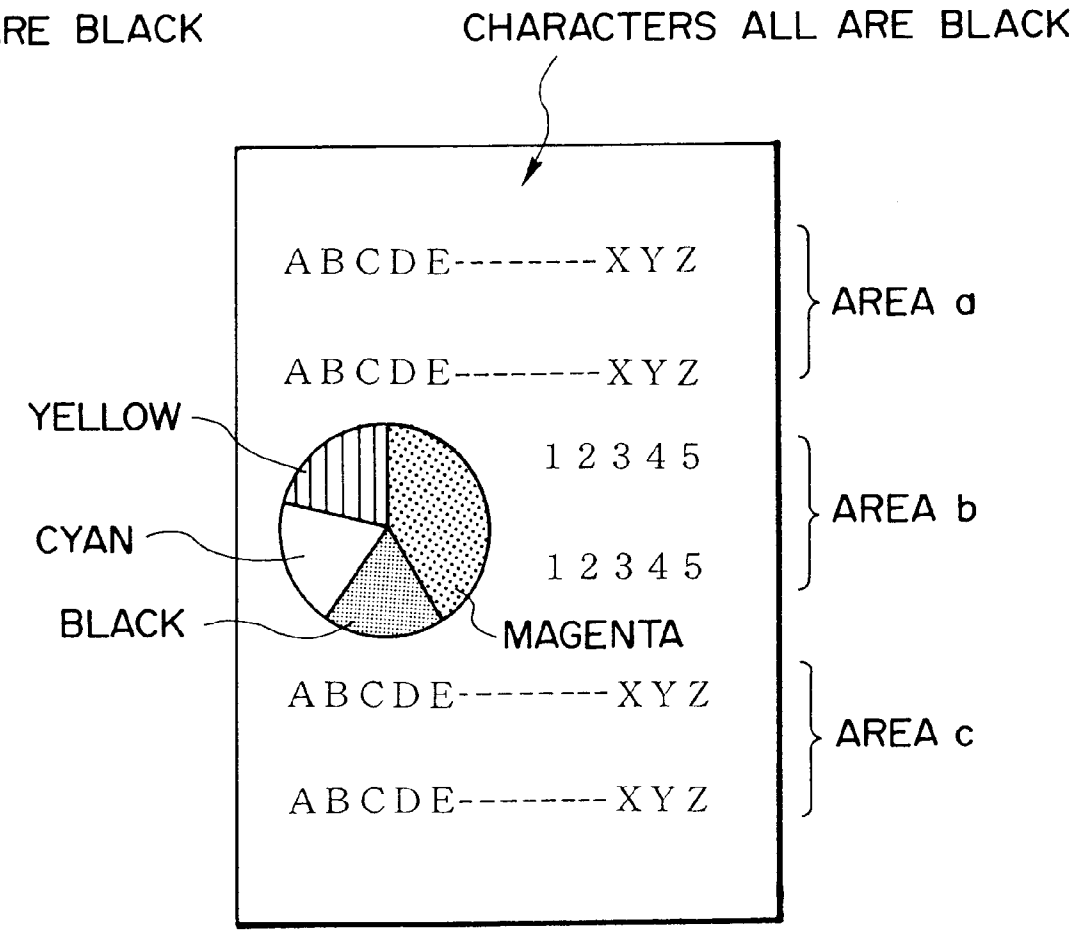

FIG. 2 shows an instance of printing only black image using the nozzle group 10*d* for the discharge of black ink, wherein forty eight nozzles for the nozzle group 10*d* are all used, and recording sheet is fed by the amount of forty eight nozzles to print the next line when the scan of the recording head is ended. This method is effective particularly when one page has only black image, as shown in FIG. 8A, or in printing the black image portion (area a and area c in FIG. 8B) when one page has a black image and a color image mixed, as shown in FIG. 8B but the black image and the color image are separated in a feed direction of recording sheet, and has the advantage that the recording speed is high. Note that when this type of recording head is used, the feed pitch of recording sheet in the color image portion (area b in FIG. 8B) is basically twenty four nozzles.

FIGS. 3A to 3F show an instance of printing a color image using the color ink discharging nozzles 10*a*, 10*b*, 10*c* and the black ink discharging nozzle 10*d* of the recording head as shown in FIG. 1, wherein twenty four nozzles are used for each color (same figure F). In the same figure, the nozzles for discharging the black ink are those arranged on the side of the cyan ink discharging nozzle 10*c*. In the figure, Y is printed with yellow ink, M is printed with magenta ink, C is printed with cyan ink, and B is printed with black ink.

Figure 3A:
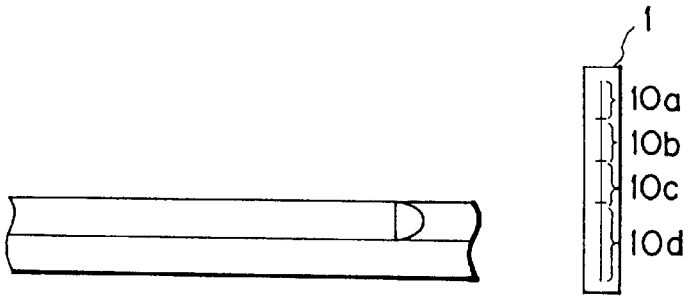
FIGS. 3A to 3F are views for explaining a process of printing an image consisting of a black image and a color image which are mixed.
Figure 3B:
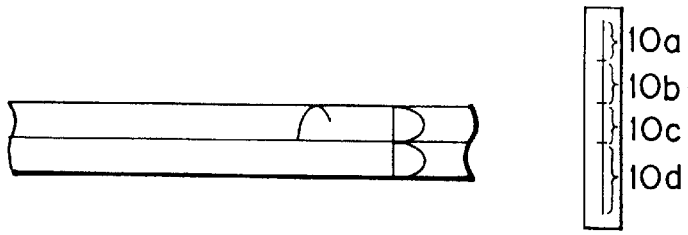
Figure 3C:
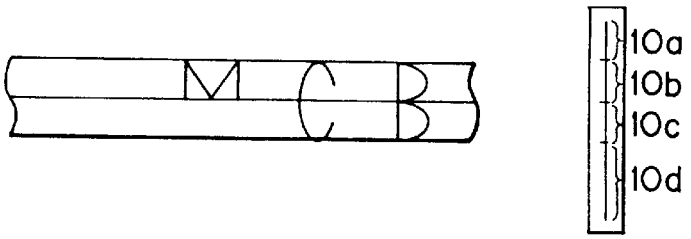
Figure 3D:
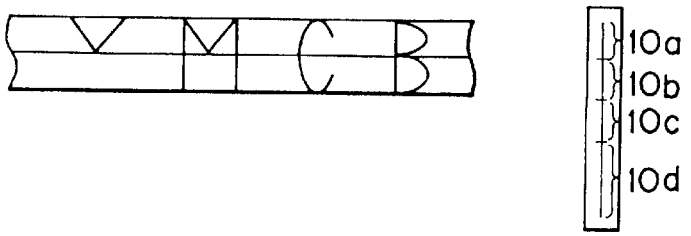
Figure 3E:
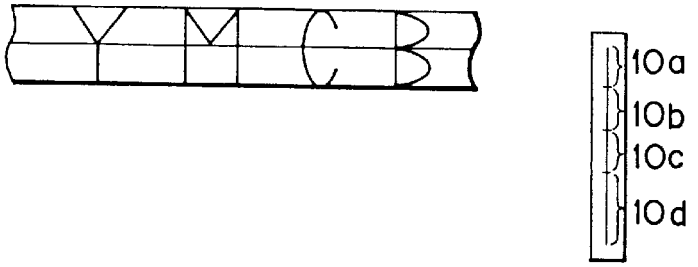

A process of forming a color image will be described using FIGS. 3A to 3E, FIG. 3A shows an instance of scanning the recording head 1 at a position as shown, where the upper part of a black character "B" corresponding to twenty four nozzles is printed. Subsequently, the recording sheet is fed by the amount of twenty four nozzles, and the remaining lower part of black character "B" and the upper part of a cyan character "C" corresponding to twenty four nozzles are printed from a state of FIG. 3B. Further, the recording sheet is fed by the amount of twenty four nozzles, the lower part of cyan character "C" corresponding to twenty four nozzles, as well as the upper part of a magenta character "M" corresponding to twenty four nozzles, are printed as shown in FIG. 3C. The above operation is further performed as shown in FIGS. 3D and 3E until the printing of four colors is ended.

By the way, the image as shown in FIGS. 3A to 3F consists of color images which are not adjoining, so that there is particularly no decrease of the print quality due to the blur of colors. However, in the case of an image as shown in FIGS. 4A to 4G, a black character "B" exists in the background of yellow, magenta and cyan, so that the blur of color is likely to occur at the boundaries between black and color. In particular, it is preferable that the discharge amount of black ink per dot is designed to be greater than that of color inks from the aspect of print quality, though the blur is likely to occur at the boundaries between black image and color image.

Figures 4A, 4B, 4C, 4D, 4E, 4F, 4G:
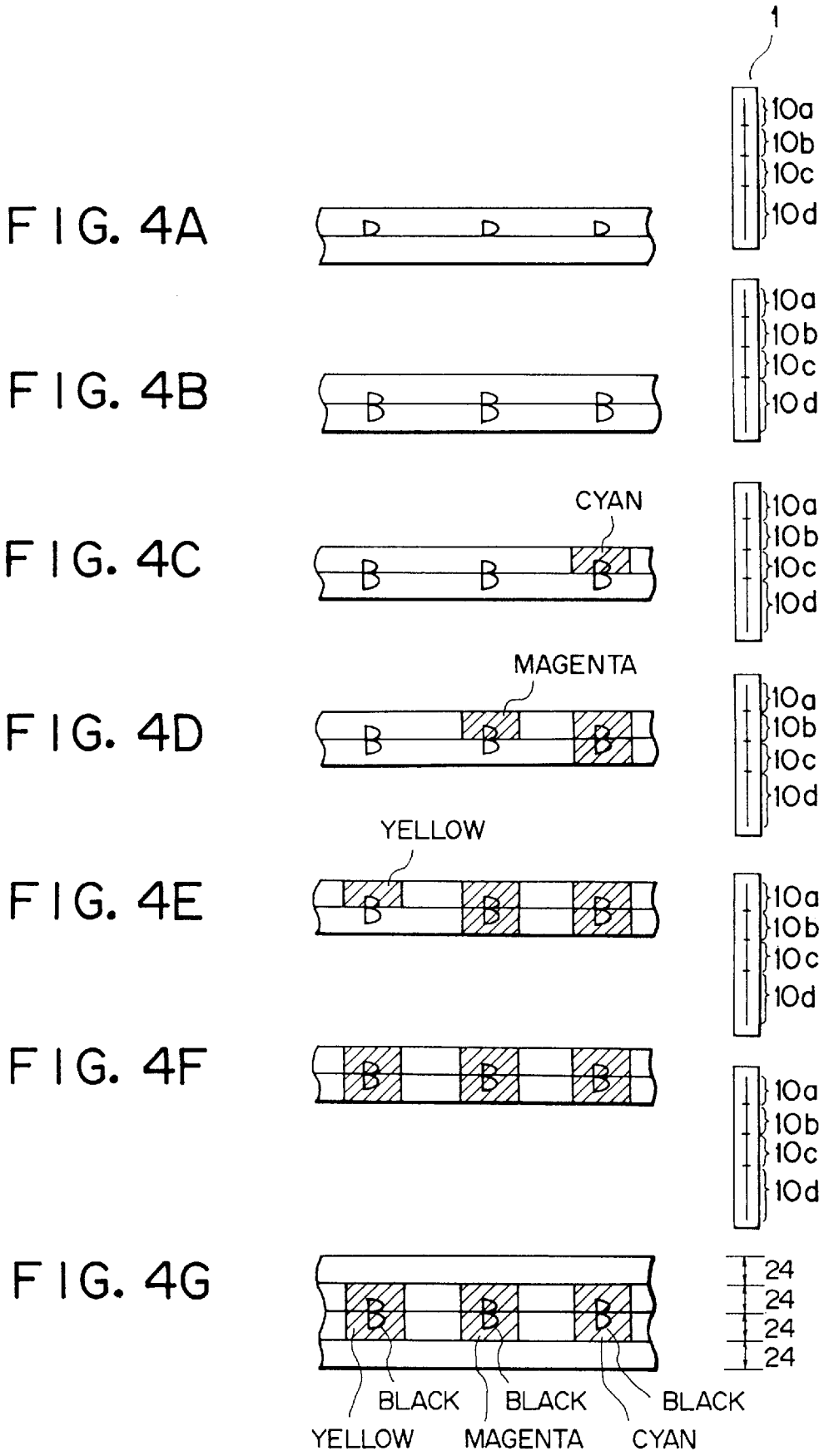
FIGS. 4A to 4G are views for explaining a process of printing an image in which the adjacent boundary exists between black image portion and color image portion.

Therefore, a recording method according to the embodiment 1 of the present invention is to record an image consisting of adjoining black image and color image as shown in FIG. 4G, using a recording head as shown in FIG. 1, wherein the nozzles used for printing the black image are twenty four nozzles on the lower part thereof, as will be described in FIGS. 4A to 4F.

First, as shown in FIG. 4A, the portion corresponding to the upper part of a black character "B" is printed using nozzles on the lower part of the black ink discharging nozzles 10*d*. Subsequently, a recording sheet is fed by the amount of twenty four nozzles, and then the remaining lower part of black character "B" is printed, using the lower part of the black ink discharging nozzles 10*d* (B in the same figure). After the recording sheet is further fed, the upper part of a cyan background portion is printed using the cyan ink discharging nozzles 10*c* (C in the same figure). After the recording sheet is fed, the lower part of cyan background portion is printed by the nozzles 10*c*, and the upper part of a magenta background is printed by the nozzles 10*d* (D in the same figure). The same operation is repeated until the printing is ended in FIG. 4F.

Figure 3F:
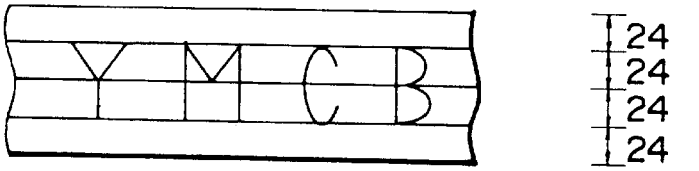

Herein, comparing the process of printing the image of FIG. 3F in accordance with the procedure of FIGS. 3A to 3E with the process of printing the image of FIG. 4G in accordance with the procedure of FIGS. 4A to 4F, the latter process has one greater number of scanning the recording head required to record a color image corresponding to the amount of forty eight nozzles in a paper feed direction. That is, the latter process uses the lower part of nozzles for discharging the black ink, which are separated (i.e., not continuous) by one scan or the amount of twenty four nozzles from the cyan ink discharging nozzles 10*c*, so that the number of scans in the latter process is one greater than in the former process. Therefore, the latter method takes a longer time from printing black image to printing color image than the former method, even though black image and color image are adjoining, so that it produces less blur at the adjoining portion than the former.

As described above, with the recording method of the present invention, the print timing of black image and color image can be delayed from normal timing by appropriately setting the nozzles for printing the black image when there are adjoining black image and color image, so that a high quality color image without blur between colors can be obtained.

Also, the number of scans for the recording head in reciprocatory motion is one greater for each printing of one page of recording sheet, so that the substantial recording time is hardly affected.

In the embodiment as described above, the image of FIGS. 4A to 4G was printed at a discharge frequency of 6 kHz, with the time from the start of one scan to the start of next scan for the recording head being about one second, so that a high quality image without blur at the boundaries between black image and color image could be obtained.

(Embodiment 2)

Figure 5:
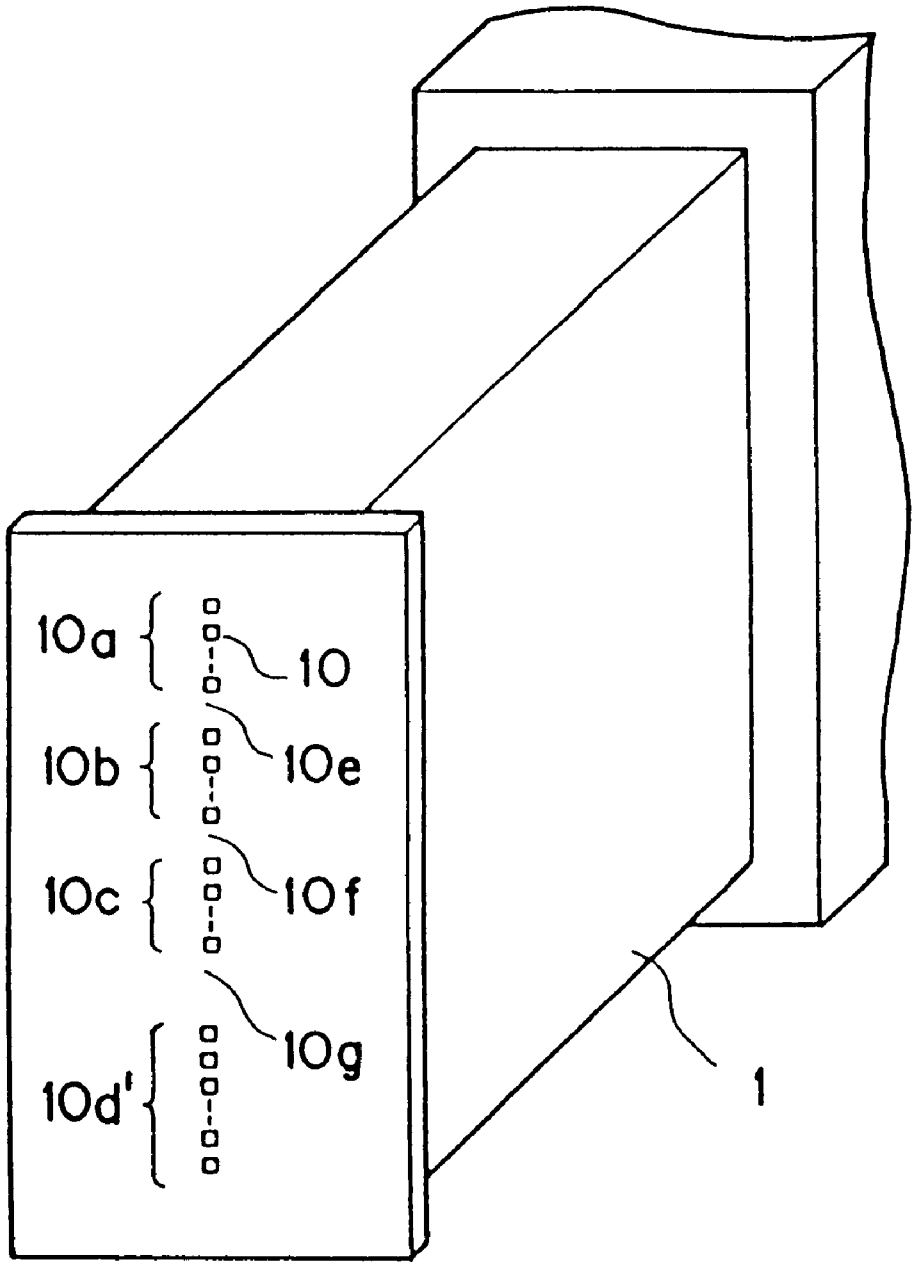
FIG. 5 is a schematic view for explaining a recording head us ed in example 2.

A recording head as shown in FIG. 5 is comprised of a yellow ink discharging nozzle group 10*a*, a magenta ink discharging nozzle group 10*b*, a cyan ink discharging nozzle group 10*c* and a black ink discharging nozzle group 10*d*, like the embodiment 1, the black ink discharging nozzle group has sixty four nozzles arranged, and each of other color ink discharging nozzles has twenty four nozzles arranged. Also, a space of eight nozzles 10*e*, 10*f* is provided between the yellow ink discharging nozzle 10*a* and the magenta ink discharging nozzle 10*b* and between the magenta ink discharging nozzle 10*b* and the cyan ink discharging nozzle 10*c*, and a space of sixteen nozzles 10*g* is provided between the cyan ink discharging nozzle 10*c* and the black ink discharging nozzle 10*d*. The discharge amount of each nozzle is equal to that of the embodiment 1.

Also, this recording head, owing to the spaces provided, is easily formed with a liquid chamber for supplying the ink to the nozzles of each color, and has the advantage that a temperature detecting sensor for the recording head can be provided in such spaces, with its effects easily drawn by applying the present invention.

Figure 6:
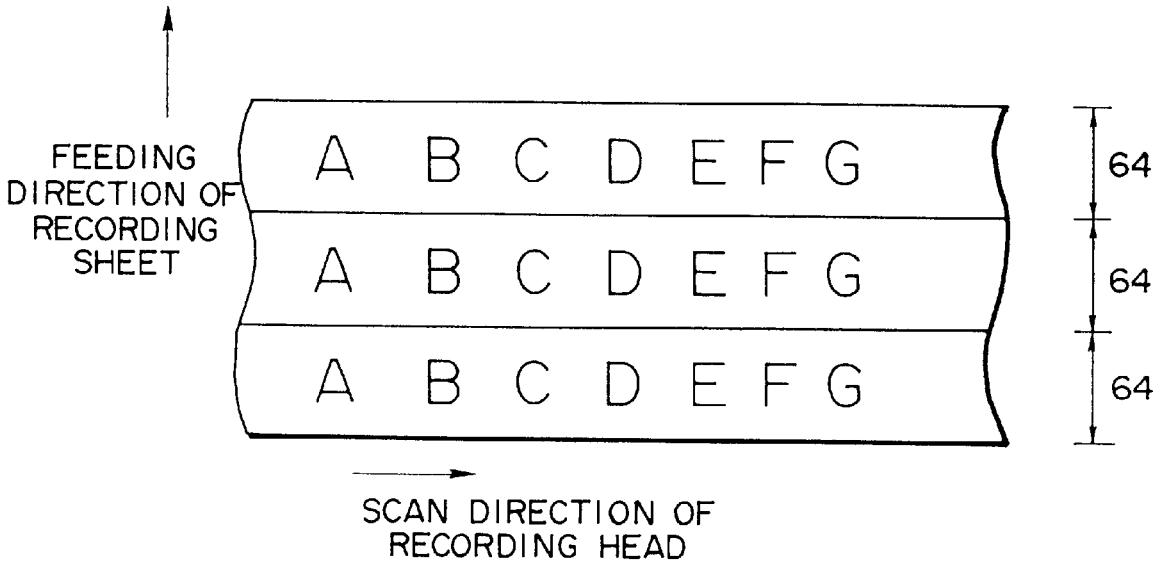
FIG. 6 is a view for explaining a process of printing only black image .

FIG. 6 shows a printing method for printing the black image portion among black image and color image separated in a feed direction of recording sheet, when the image within one page is all black, or when the black and color images are mixed in one page, using this recording head. That is, the black image is printed using all sixty four nozzles, while the feed pitch of recording sheet is equal to the amount of 64 nozzles.

Next, a printing method for printing an image as shown in FIG. 4G using this recording head will be now described with reference to FIGS. 7A to 7H. As will be clear from the figure, the nozzles located at predetermined positions from the uppermost in the figure among the black ink discharging nozzles 10*d* are used in printing the black image. Specifically, twenty four nozzles from the twenty-fifth nozzle to forth-eighth nozzle from the uppermost in the figure are used.

Figure 7A:
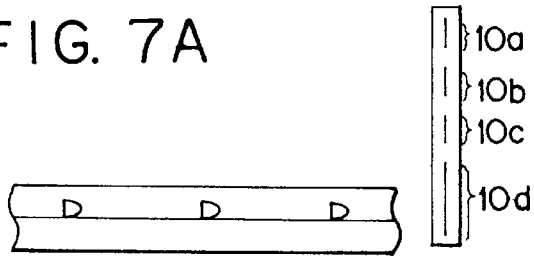
FIGS. 7A to 7H are views for explaining a process of printing the image of FIG. 4 by a method of example 2.
Figure 7B:
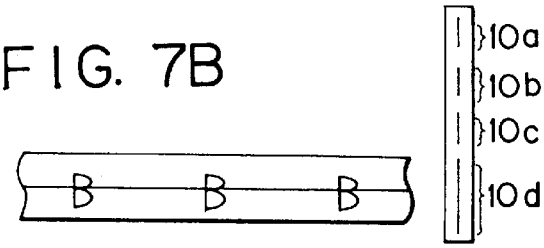
Figure 7C:
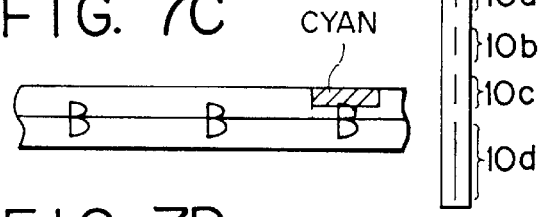
Figure 7D:
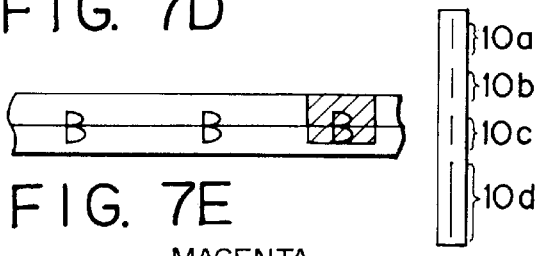
Figure 7E:
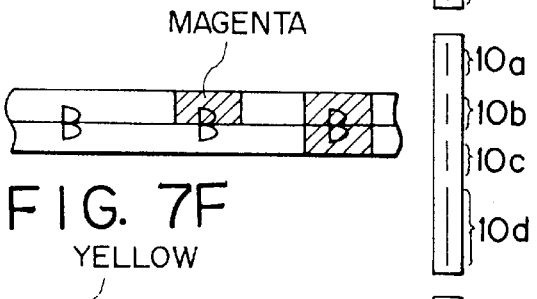
Figure 7F:
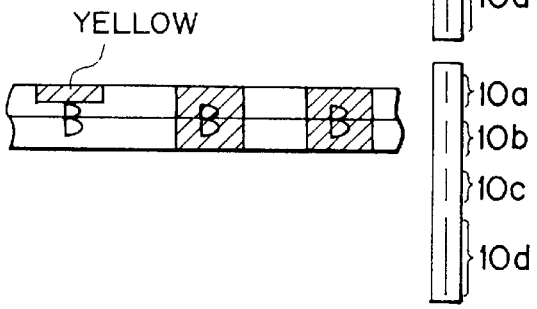
Figure 7G:
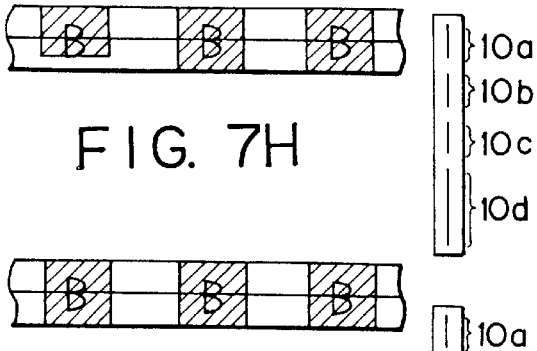
Figure 7H:
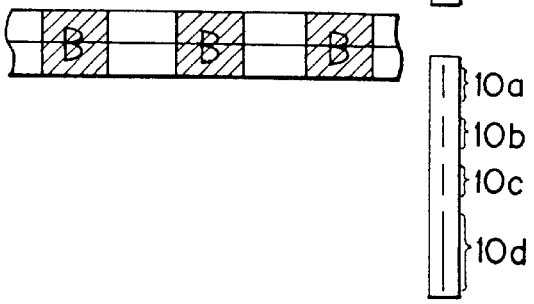

First, the upper part of a black character "B" is printed using the twenty fifth to forth-eighth nozzles, as shown in FIG. 7A. Subsequently, the recording sheet is fed by the amount of twenty four nozzles, and the lower part of black character "B" is printed using the same nozzles as shown in FIG. 7B. In this case, the color printing is not performed. Then, after the recording sheet is fed by the amount of twenty four nozzles, part of a cyan background portion is printed using the cyan ink discharging nozzles 10*c*. Thereinafter, the printing of a background portion of each color is performed each time by the amount of twenty four nozzles, the details being the same as those of the embodiment 1 and omitted. Owing to the use of the recording head provided with a predetermined space between adjacent nozzle groups, the total of eight scans is required to print the image as shown in FIG. 4G in this embodiment.

As described above, owing to the use of the twenty-fifth to forty-eighth nozzles among the black ink discharging nozzles, there occurs an idle time amounting to one scan in reciprocatory motion until the color ink getting contiguous to black character most early after the black character is printed, specifically, the cyan ink, is printed, there occurs no blur at the adjoining portion. The image of FIG. 4G was printed under the same conditions as those of the embodiment 1, so that a high quality equivalent to that of the embodiment 1 was obtained.

(Embodiment 3)

When printing an image having the contiguous boundaries between black image and color image, using the same recording head as in the embodiment 2, the forty-first to sixty-fourth nozzles among the black ink discharging nozzles were used. The feed pitch of recording sheet is equal to the amount of twenty four nozzles, like the embodiment 2. There is a time difference amounting to two scans in reciprocatory motion from the printing of black image at the continuous boundaries to the printing of color image (cyan) to be performed at the earliest time. Thus, the same image was printed as that of FIG. 4G, so that a higher quality image without any blur could be obtained than the image of the embodiment 2.

Figure 9:
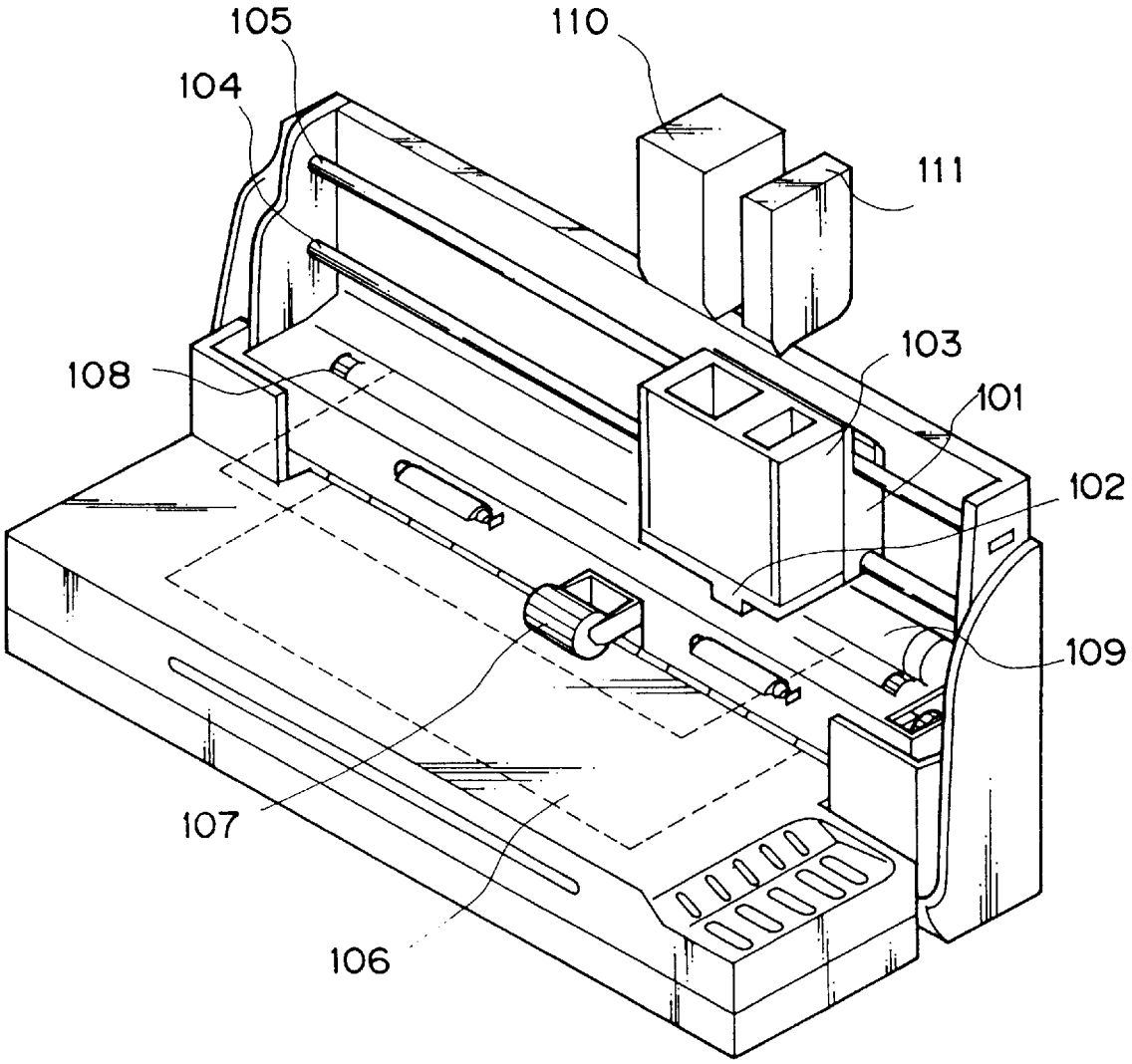
FIG. 9 is a perspective view of an ink jet recording apparatus to which the present invention is applicable.

FIG. 9 is a perspective view of an ink jet printer with an ink cartridge and a carriage mounted thereon, to which the present invention is applicable.

Carriage 101 has a print head 102 and a cartridge guide 103 mounted, and can scan over a guide shaft 104 and a guide shaft 105. A recording sheet 106 is fed into a main device by a sheet supply roller 107 to be carried between a sheet feed roller 108 and a pinch roller (not shown) and passed under a sheet presser plate 109 on to the front face of the sheet feed roller 108 for the printing. An ink cartridge has two kinds of a color ink cartridge 110 for three colors of yellow, magenta and cyan, and a black ink cartridge 111, each inserted into a cartridge guide 103, separately, to communicate with the print head 102.

The inks of yellow, magenta and cyan accommodated within the color ink cartridge 110 have a higher permeating rate into the recording sheet not to produce the blur of ink at the color boundaries in forming the color image. On the other hand, the black ink accommodated in the black ink cartridge 111 has a relatively slower permeating rate into the recording sheet than the three kinds of color inks so that the black image may be of high quality having a high density and less blur of ink.

The constituents of the inks for use in this embodiment are as follows.

| | |
|---|---|
| (Yellow) | |
| C.I. direct yellow 86 | 3 parts |
| Diethylene glycol | 10 parts |
| Isopropyl alcohol | 2 parts |
| Urea | 5 parts |
| Acetynol EH (Kawaken Chemical) | 1 part |
| Water | remaining parts |
| (Magenta) | |
| C.I. acid red 289 | 3 parts |
| Diethylene glycol | 10 parts |
| Isopropyl alcohol | 2 parts |
| Urea | 5 parts |
| Acetynol EH (Kawaken Chemical) | 1 part |
| Water | remaining parts |
| (Cyan) | |
| C.I. direct blue 199 | 3 parts |
| Diethylene glycol | 10 parts |
| Isopropyl alcohol | 2 parts |
| Urea | 5 parts |

-continued

| | |
|---|---|
| Acetynol EH (Kawaken Chemical) | 1 part |
| Water | remaining parts |
| (Black) | |
| C.I. direct black 154 | 3 parts |
| Diethylene glycol | 10 parts |
| Isopropyl alcohol | 2 parts |
| Urea | 5 parts |
| Acetynol EH (Kawaken Chemical) | 1 part |
| Water | remaining parts |

Figure 10:
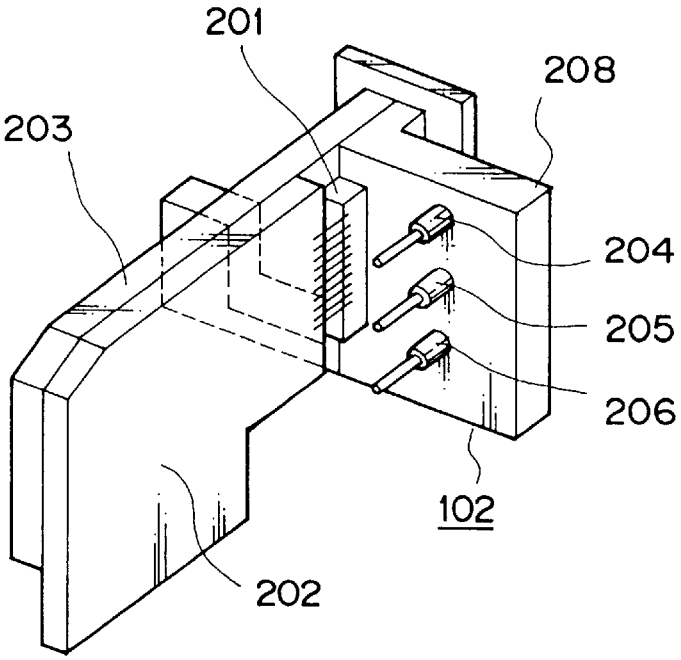
FIG. 10 is a view of a head mechanism for the ink jet recording apparatus to which the present invention is applicable.
Figure 10:
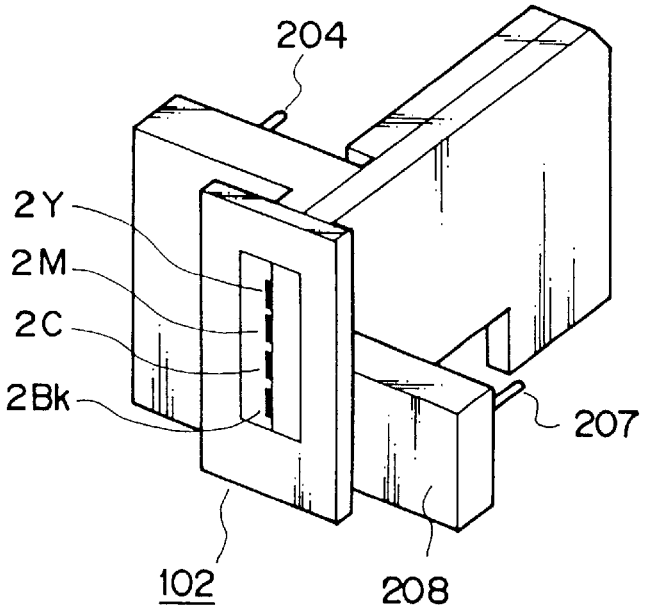

Referring now to FIG. 10 in detail, the print head 102 has the groups of discharge orifices for yellow, magenta, cyan and black, arranged in a line on the front surface of the print head 102. One group comprises twenty four discharge orifices for each of yellow, magenta and cyan, or sixty four discharge orifices for black, and a space amounting to eight nozzles between adjacent nozzle groups, or sixteen nozzles between black and color nozzle groups is provided. Further, these nozzles are arranged to a density of 360 per inch (360 dpi). Normally, or printing only black image, all sixty four nozzles within a black discharge orifice group, while for printing color image including black image, twenty four nozzles for each of yellow, magenta, cyan and black are used.

Each of these discharge orifices is provided with an ink liquid channel communicating thereto, a common liquid chamber or supplying the ink to ink liquid channels is provided rearward of the ink liquid channels disposed. An ink liquid channel corresponding to each of the discharge orifices has an electricity-heat converter for generating a heat energy for use in discharging an ink droplet through the discharge orifice, and an electrode wiring for supplying the electric power to such electricity-heat converter. These electricity-heat converters and electrical wirings are formed by film formation technique on a substrate 201 made of silicone. Further, by laminating partition walls and a ceiling plate made of resin and glass material on this substrate, the discharge orifices, the ink liquid channels and the common liquid chamber are made. Further rearwardly thereof, a drive circuit for driving the electricity-heat converters based on a recording signal is provided in the form of a printed board.

In parallel to silicone substrate 201 and printed board 202 is disposed an aluminum plate 203, and projection pipes 204 to 208, extending in parallel to the aluminum plate 203, project outward from a plastic member 208 called a distributor extending in a direction perpendicular to the silicone substrate 201, and communicate to liquid channels provided further inward thereof, which in turn communicate to the common liquid chamber.

Within the distributor, four liquid channels for yellow, magenta, cyan and black are provided to connect the pipes to respective common liquid chambers.

Each discharge orifice for yellow, magenta and cyan provided on the print head 102 discharges an ink of about 40 ng, and a discharge orifice for black discharges an ink of about 80 ng.

Figure 11:
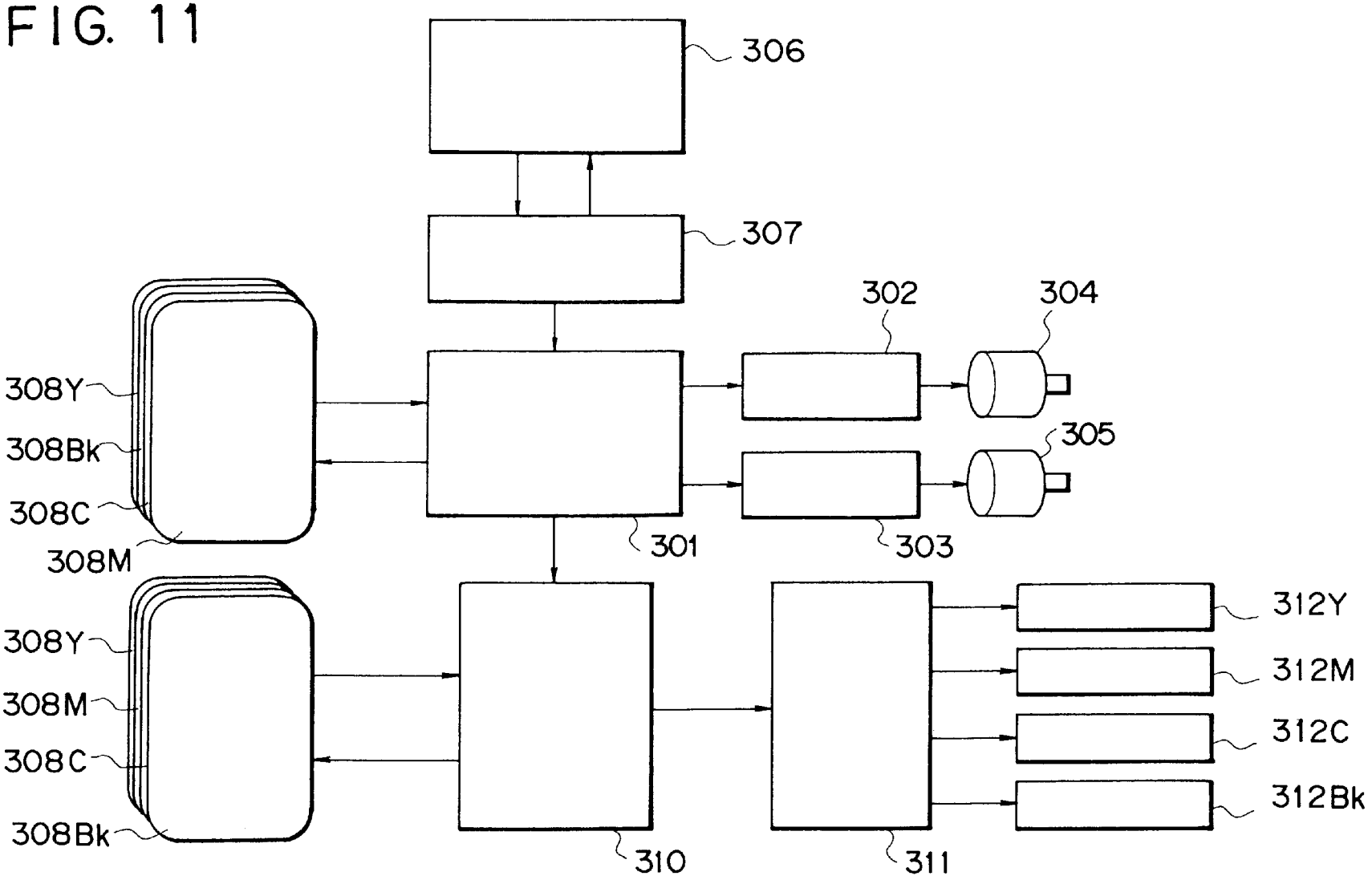
FIG. 11 is a block diagram of a control circuit for the ink jet recording apparatus to which the present invention is applicable.

FIG. 11 is an electrical control block diagram of a color ink jet printer as described above.

Reference numeral 301 represents a system controller for controlling the overall apparatus, which is internally provided with a microprocessor, a storage element (ROM) for storing control programs, a storage element (RAM) for use when the microprocessor operates. Reference numeral 302 represents a driver for driving the print head in a main scan direction, and reference numeral 303 represents a driver for moving the print head in a sub-scan direction. Reference numerals 304, 305 represent respective motors for the above-described drivers, which operate by receiving the information of speed and movement distance.

Reference numeral 306 represents a host computer which is an equipment for transferring the printing information to the printer of the present invention. Reference numeral 307 represents a reception buffer for temporarily storing data from the host computer, or storing data until the data is read through the system controller. Reference numeral 308 represents a frame memory for expanding print data to image data, the frame memory having a memory size necessary for the printing. In this embodiment, a frame memory capable of memorizing one print sheet will be described, but the present invention is not limited in the size of frame memory.

Reference numeral 309 represents a storage element for temporarily storing the data to be printed, wherein the storage capacity varies depending on the number of nozzles provided for the recording head. Reference numeral 310 represents a print control section for appropriately controlling the print head in accordance with an instruction from the system controller in terms of the discharge rate and the print data number. Reference numeral 311 represents a driver for driving the heads 312Y, 312M, 312C, 312Bk, which is controlled by a signal issued from the print control section 310.

Note that using the first to twenty-fourth nozzles among the black ink discharging nozzles, the same image as in the embodiment 2 was printed, the blur occurred particularly at the boundaries between cyan and black of the image in which black character exists in the cyan background.

Thus, experimentally, the printing was performed by gradually prolonging the time from the start of one scan of the recording head to the start of next scan, beginning from 1 second. As a result, barely near 2 seconds as doubled, a print quality equivalent to that of the embodiment 2 could be obtained.

As described above with respect to the embodiments 1 to 3, when the black image for printing with the black ink and color image for printing with the color ink are contiguous, there occurs no blur at the contiguous boundaries between the black image and the color image by selectively using the black ink discharging nozzles so that the scan of forming the black image is not continuously followed by the scan of forming the color image, resulting in a high quality recorded image. Also, since the blur does not occur at the contiguous bondaries between black image and color image, the discharge amount of black ink can be greater than the discharge amount of color inks, so that a high quality image can be obtained with high density of black image. Moreover, these effects can be attained without substantially increasing the printing time for one page.

Note that in the above embodiments, in printing the portion in which the black image and the color image are contiguous, the black ink discharging nozzles are set so that the time from the printing of black image to the printing of color image contiguous there to may be at least one scan or more, but these can be also set when the contiguous portion between the black image and the color image does not exist as shown in FIG. 3F.

Next, an ink jet recording method which can improve the recorded quality without decreasing the recording speed will be described below in detail with reference to the drawings.

(Embodiment 4)

Referring now to FIG. 9, an ink jet recording apparatus to which the present invention is applicable will be described in detail.

Figure 19:
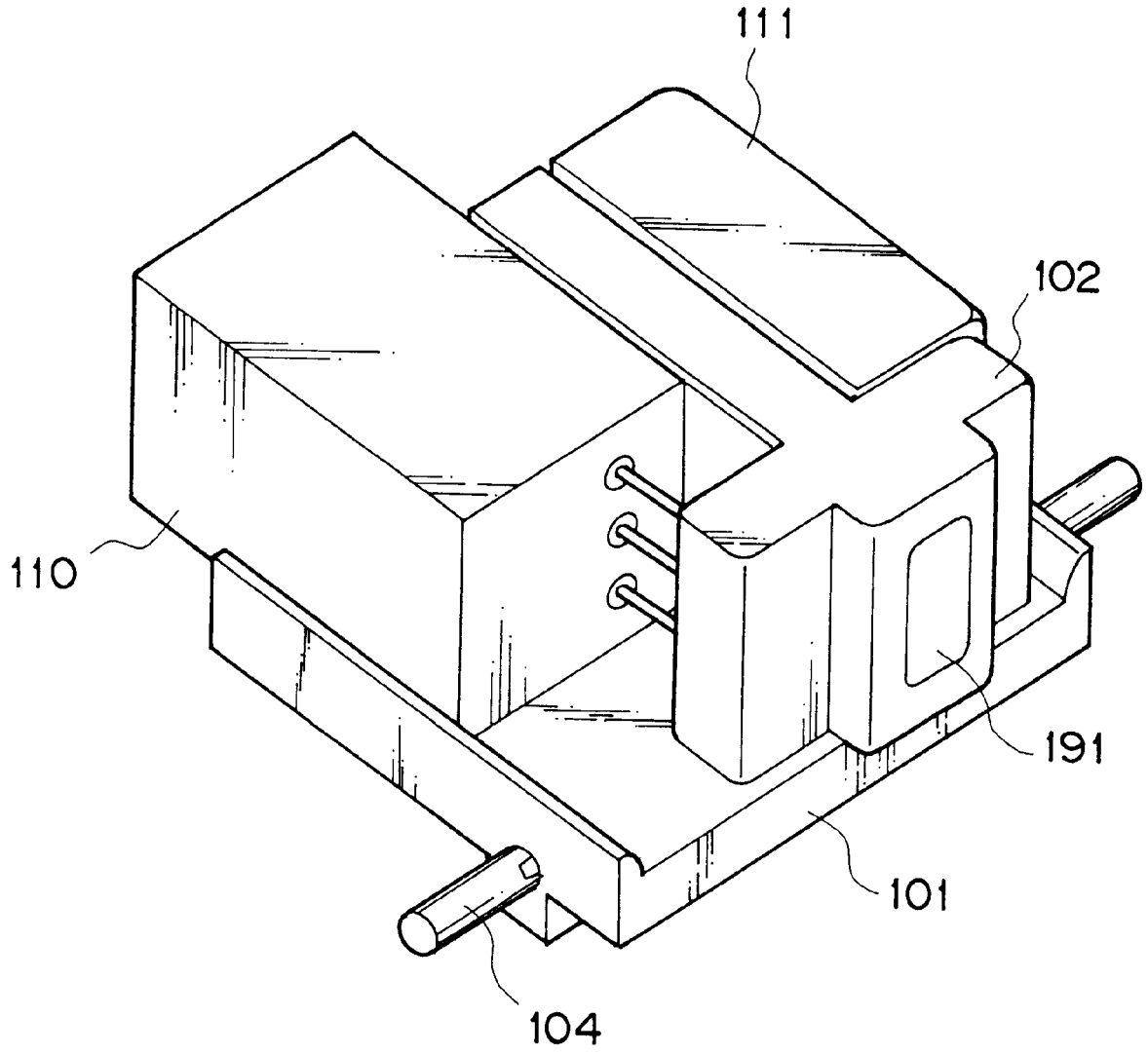
FIG. 19 is a detailed view of a carriage.

FIG. 19 shows the details of carriage 101. A color ink cartridge 110 and a black ink cartridge 111 are attached from rearward of print head 102 to supply the ink through pipes, not shown. The color ink cartridge 110 contains the inks of cyan, magenta and yellow within one housing, which are separated by a partition wall. 191 is a discharge orifice face provided on the print head for discharging the ink, on which the discharge orifices corresponding to the ink of each color are formed.

Figure 12A:
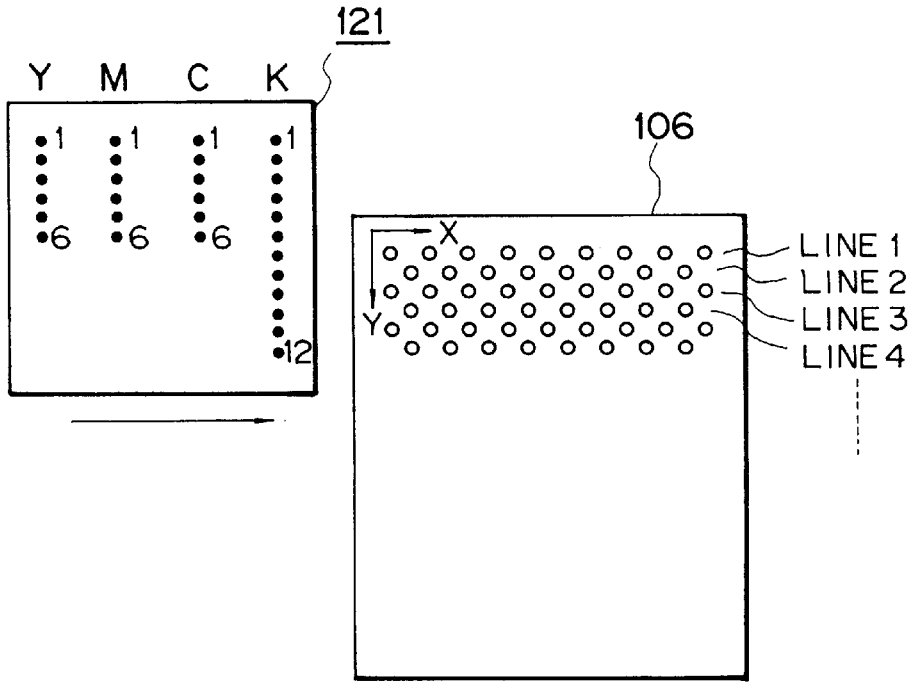
FIG. 12A and 12B are views showing the recorded state with a head to which the present invention is applicable.
Figure 12B:
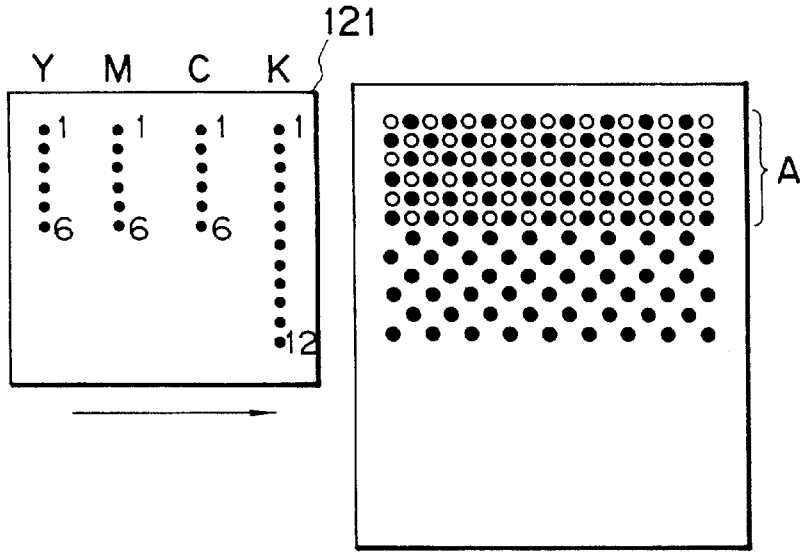

FIGS. 12A and 12B are views representing the recorded states by a recording method as described in this embodiment. 121 is a recording head, as viewed from the side of the discharge orifice face 191 of the print head 102 as shown in FIG. 19. The black point as shown in the figure indicates the nozzle position.

The jetting of ink droplets from the recording head can be accomplished by bubbles in the ink due to the heat generated by applying electrical energy to the heat generators provided near the nozzles.

The recording head 121 moves relative to the paper 106 which is a recording medium. In the figure, the X direction as indicated by the arrow is a main scan direction, the Y direction orthogonal to the main scan direction is a sub-scan direction.

The recording head 1 has six nozzles corresponding to each of the inks of three colors of yellow (Y), magenta (M) and cyan (C), and twelve nozzles, which is twice those of CMY, corresponding to the ink of black (K). The nozzles of each color are arranged substantially linearly and in parallel to those of the other colors. The arrangement pitch of the nozzles of each color is about 70.6 micron, which is equal to the pitch of recording pixels. That is, the recording is performed at a recording density of 360 dpi. This is controlled to be similar in the X direction.

In this embodiment, the average amount of ink jetted from each nozzle is about 40 pl for C, M and Y, and about 60 pl for K, which is equal to one and half times that of CMY.

The recording method of applying the ink onto the paper for each pixel is performed in such a manner that CMY is excluded in K portion and C+M+Y is replaced with K for an image signal preinput for the recording. That is, the recording is performed in eight cases of K, C, M, Y, C+M, M+Y, Y+C and no recording.

First, in FIG. 12A, the recording head 1 secured to the carriage of the recording apparatus scans in the main scan direction at the first time to record only black data corresponding to the site indicated by the white circle in the figure within the area to be recorded. In this case, the nozzles of K are the seventh to twelfth nozzles.

Then, the recording head 121 and the paper 106 are relatively moved by moving the paper in a counter direction to the Y direction. Subsequently, as shown in FIG. 12B, the second scan in the main scan direction is performed. The K data is recorded at the site as indicated by the black circle within the area to be recorded, and the YMC data is recorded in the area as indicated by A having a one-half width that of the area as described earlier. That is, the K nozzles are all of the first to the twelfth nozzles and the CMY nozzles are all of the first to the sixth nozzles at the second scan. Also, the site of the black circle forms a complementary pattern with the site of the white circle at which is recorded in black at the first scan within the area as indicated by A. The pattern as shown in the figure is a so-called cross and counter-cross pattern.

In this way, to record a part of K ahead of other colors is effective for preventing the blur of ink from spreading over other colors because that part is fixed earlier on the recording sheet than the inks of other colors to be recorded later.

With the above operation, the recording of the area as indicated by A is ended. Subsequently, the recording is repeated successively until completed. At the final scan, K uses the first to the sixth nozzles.

The recording of K (black) is performed in a cross and counter-cross pattern which is complementary at the first scan and the second scan to avoid recorded pixels approaching to the closest. Therefore, the fixing of the ink onto the paper is improved, the CMY inks to be applied after K produce less blur into the region recorded in K, resulting in the recording quality being remarkably improved.

Also, in spite of more or less dispersed jetting directions of ink droplets through the nozzles of K ink, or dispersed ink jetting volumes through a number of nozzles, the use of the complementary pattern in recording can relieve such dispersion by recording adjacent recording pixels with the ink jetted through different nozzles than by recording with the same nozzle, resulting in improved recording quality.

Herein, the complementary pattern is not limited to a cross and counter-cross pattern. For example, the complementary pattern may be divided into two patterns randomly, or in a pixel block consisting of two or more pixels in the main scan or sub-scan direction.

Also, the scan for the recording operation at the even number of times, e.g., the second scan, may be along the return path of the carriage movement in a −X direction counter to the arrow as indicated in FIGS. 12A and 12B. By performing this operation, a twice higher recording speed can be expected.

With the above constitution, the remarkable improvement of image quality at the color recording can be made simply by scanning in the main scan direction one time more than conventionally.

As a result, the use frequency of K nozzles becomes lower than the use frequency of nozzles of other colors, so that the life of recording head of K is increased. Generally, when printing with a color image incorporated in a part of the document, the use frequency of K is particularly higher, and with the recording apparatus having a recording mode of using only K, the use frequency of K is naturally higher. In the present invention, there is a merit of lengthening the life of recording head as a whole by lowering the use frequency of K in the color mode.

From the above discussion, it follows that the relative scan number of a nozzle group of the recording head relative to the recording medium is greater for K color for which more nozzles are provided than that of other colors, in printing the particular region consisting of a set of recording pixels. With this recording method, this embodiment is set forth.

The recording pixel charging frequency PA per nozzle in a nozzle group for K having the greatest number of nozzles and the recording pixel charging frequency PB of nozzle group B for other colors (CMY) have a relation.

$$PB‰6/12=PA$$

where the number of nozzles for K is NA and the number of nozzles for other colors is NB. Typically, if NA≧2NB, $$PB\cdot NB/NA \leqq PA < PB$$

holds.

In recording the particular region, the relative scan of the recording head to the recording medium is $$SA=2\cdot SB$$

where the average number of scans for the nozzle group of K is SA and the average number of scans for the nozzle group of other colors is SB. Typically, if NA≧2NB, $$SA \geqq 2\cdot SB$$

holds.

(Embodiment 5)

It is possibly conceived to record a part of K after other colors in the embodiment 4. Specifically, this can be implemented by shifting upward the nozzles of K in the recording head 121 by the amount of six nozzles, as shown in FIG. 13, with the result of the same effects.

In this case, at the first scan, the seventh to twelfth nozzles are used for K, and the first to sixth nozzles used for CMY. Then, the first main scan is made for CMY, and the pixels in one-half the total nozzle width are recorded for K. At the second scan, after the relative movement of the recording medium to the recording head by the amount of six pixels in the sub-scan direction, the pixels of the next main scan are recorded for CMY, while the remaining pixels of the first scan are recorded for K, and one-half of the pixels of the second scan are recorded. The above operation is subsequently repeated until the final scan, where the pixel are recorded for only K.

Figure 13:
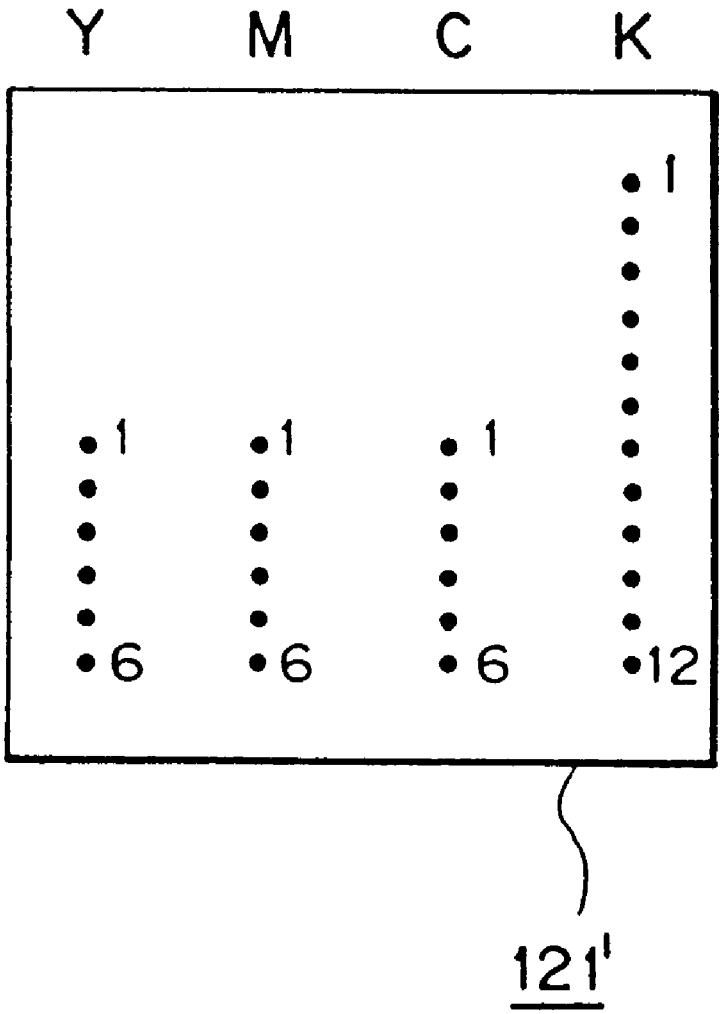
FIG. 13 is a view showing a recording head.

In this way, the same effects can be obtained for the recording head having a constitution of nozzles as shown in FIG. 13.

(Embodiment 6)

Figure 14:
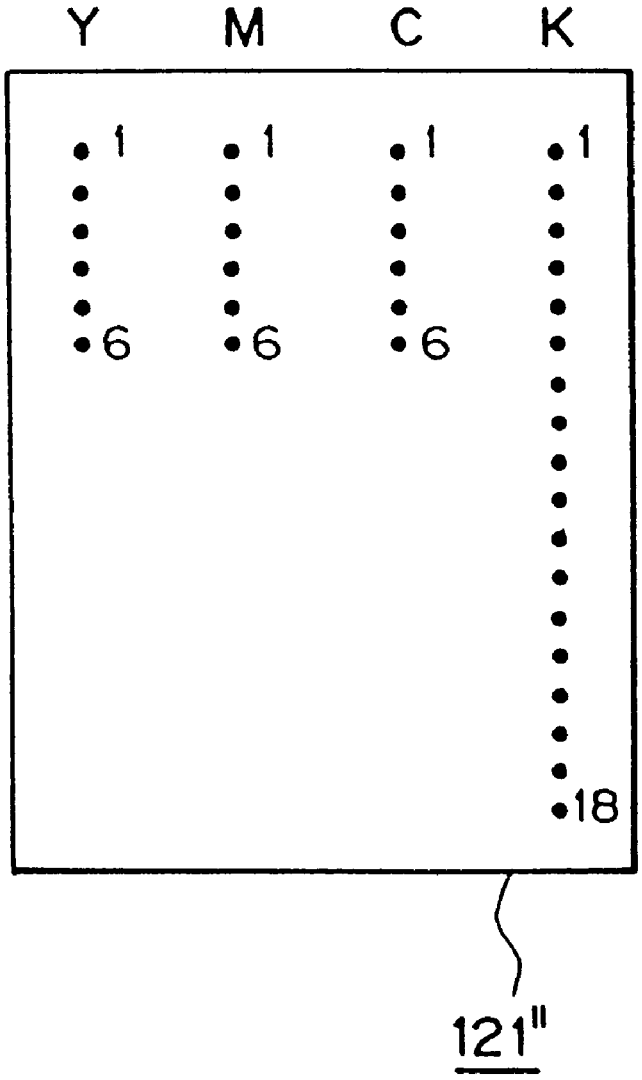
FIG. 14 is a view showing a recording head.

While in the embodiment 1, the number of nozzles Nk in the nozzle group for the ink of K color is twelve, the number of nozzles Ny for yellow is six, the number of nozzles Nm for magenta is six and the number of nozzles Nc for cyan is six, in which Nk=2Ny=2Nm=2Nc holds, the further effects can be expected with Nk=18, Ny=Nm=Nc=6 so that Nk=3Ny=3Nm=3Nc holds, as shown in FIG. 14. Specifically, the recording is performed in the following way.

At the first scan, the thirteenth to the eighteenth nozzles are used for K to record about one-third the recording pixels in the first to the sixth line. None is recorded for CMY.

At the second scan, after the relative movement of the recording medium to the recording head 121-. by the amount of six pixels in the sub-scan direction, the seventh to the eighteenth nozzles are used for K to record about two-third the recording pixels in the first to the sixth line, and about one-third the recording pixels in the seventh to twelfth line. None is recorded for CMY.

At the third scan, the first to the eighteenth nozzles are used for K to record all the recording pixels in the first to the sixth lines, about two-third the recording pixels in the seventh to twelfth lines, and about one-third the recording pixels in the twelfth to eighteenth lines. At this time, all the recording pixels in the first to sixth line of CMY are also recorded. That is, the recording for K is performed by three times of scans to record the area with a pitch width of six nozzles.

With the above recording operation, there is a merit of further improving the fixing of the K ink.

(Embodiment 7)

Figure 15:
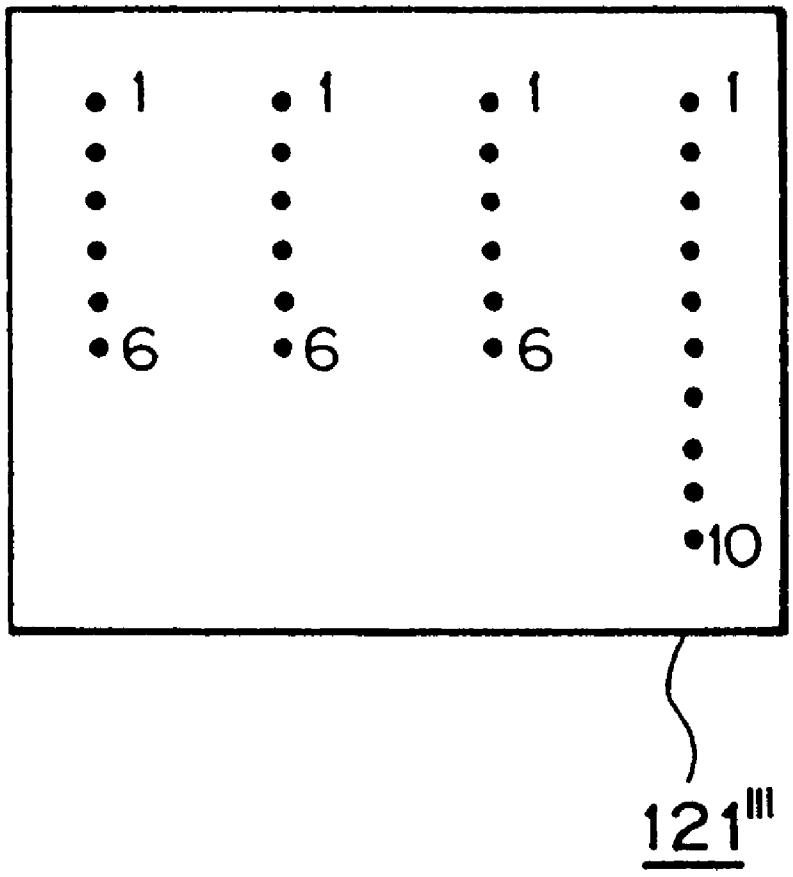
FIG. 15 is a view showing a recording head.

As shown in FIG. 15, the number of nozzles Nk in a nozzle group for the ink of K color may be less than twice the number of nozzles in the nozzle groups for the inks of other colors, such as Nk=10, while the number of nozzles Ny for yellow is 6, the number of nozzles Nm for magenta is 6 and the number of nozzles Nc for cyan is 6. That is, if at least a relation of Nk>Ny, Nm, Nc holds, the effects of the present invention can be expected. In an instance of FIG. 15, the seventh to tenth nozzles are used for K to record about one-half the recording pixels in the first to the fourth line at the first scan, and none is recorded for CMY.

At the second scan, after the relative movement of the recording medium to the recording head 121 by the amount of six pixels in the sub-scan direction, the first to tenth nozzles are used for K to record all the remaining recording pixels in the first to fourth lines, and all the recording pixels in the fifth and sixth lines. Further, they are used to record about one-half the recording pixels in the seventh to tenth lines. At this time, all the recording pixels in the first to sixth lines for CMY are also recorded.

By repeating the above operation, the fixing of K portion in which the same line is recorded by at least two scans is improved to the effects of the present invention.

(Embodiment 8)

Figure 16:
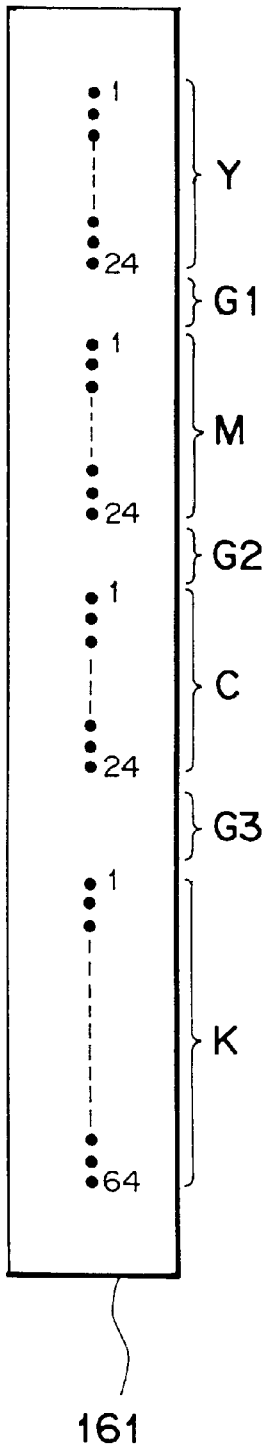
FIG. 16 is a view showing a recording head.

While in the embodiment 4, the recording head has the arrays of color nozzles in parallel, the recording head may have all the nozzles arranged linearly as shown in FIG. 16. This head has a merit that the manufacturing process is simplified.

In FIG. 16, the number of nozzles for each color is Ny=24, Nm=24, Nc=24, and Nk=64. Also, the space between adjacent color nozzle groups is a pitch of eight nozzles for G1, G2 and G3 in units of a nozzle pitch of about 70.6 micron.

Figure 18:
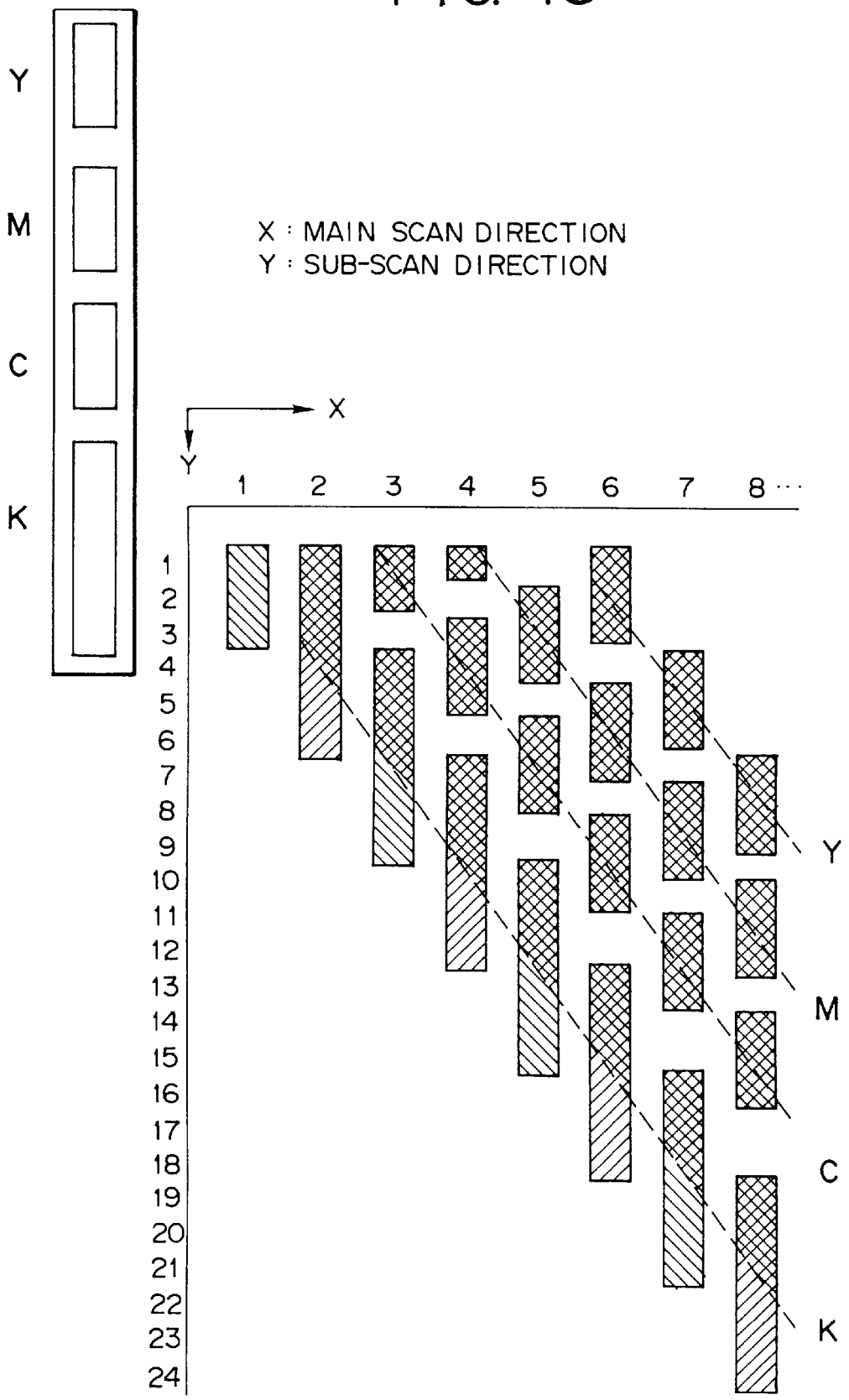
FIG. 18 is a view showing a recording process as shown in an example.

FIG. 18 is a view for explaining a recording process of using a recording head of this embodiment.

The arrow shows that the X direction is a main scan direction, and the Y direction is a sub-scan direction. The main scan was entered up to eight times, the relative position of the recording head to the recording medium being indicated for each main scan. The dot line in the figure shows up to which area each color is recorded at which time of scan. Also, 1 to 24 are entered in a unit of eight pixels (eight nozzle pitch) in the subscan direction. A unit of eight pixels is used for the explanation.

The recording head has twenty four nozzles for each of YMC, i.e., three units, and sixty four nozzles for K, among which forty eight nozzles are only used for the color recording, i.e., six units. The space between adjacent color nozzle groups is equal to a pitch of eight nozzles, or one unit.

At the first scan, only for K, the upper nozzles of three units are used to record the first to third units in a cross pattern.

At the second scan, after feeding the sheet by the amount of three units, the upper nozzles of six units for K are used to record in a counter-cross pattern. For black print, the first to third units are complementarily recorded at the second scan, whereby all the pixels are recorded.

The third scan is performed after feeding the sheet by the amount of three units. At the third scan, for K, the fourth to ninth units are recorded in counter-cross pattern. Herein, the data of K from the fourth to sixth units are recorded complementarily with the second scan, whereby all the units a rerecorded. At the same time, the first to second units are recorded for C.

The fourth scan is likewise performed by feeding the paper by the amount of three units. At the fourth scan, for K, the seventh to twelfth units are recorded in counter-cross pattern, in which the seventh to ninth units are completed by this scan, whereby all the units for K are recorded. At the same time, the third to fifth units for C and the first unit for M are recorded.

At the fifth scan, after feeding the sheet, for K, the area from the tenth to fifteenth units is recorded in cross pattern. At the fifth scan, the tenth to twelfth units for K are recorded, while at the same time the sixth to eighth units for C and the second to fourth units for M are recorded.

At the sixth scan, after feeding the sheet, the thirteenth to eighteenth units for K are recorded in counter-cross pattern, in which the thirteenth to fifteenth units are completely recorded. At the same time, the ninth to eleventh units for C, the fifth to seventh units for M and the first to third units for Y are recorded.

Thereafter, the recording is repeatedly performed in cross and counter-cross patterns for K and using all the nozzles for YMC, sequentially, until all the area is completely recorded.

The data for K is recorded alternately in cross or counter-cross pattern at each scan to provide a complementary pattern by two scans, the use frequency of K nozzles is one-half the use frequency of other color nozzles. For CMY, the recording is performed after recording K, or at a later scan. This makes it possible to obtain the longer life of recording head, as well as the improved image quality with less blur, like the embodiment 1.

Besides, a variation of this embodiment will be described below.

While the embodiment 4 was described with an instance in which the number of nozzles for K was greater than that for other colors, a general image such as a natural image is known to have a light use frequency of yellow ink. Thus, by providing a greater number of nozzles for the yellow nozzle group than that of the other color nozzle groups, the effects of the present invention can be expected.

Further, the number of nozzles for two colors of K (black) and Y (yellow) involving high use frequencies in recording characters may be more increased than that for other colors.

Figure 17:
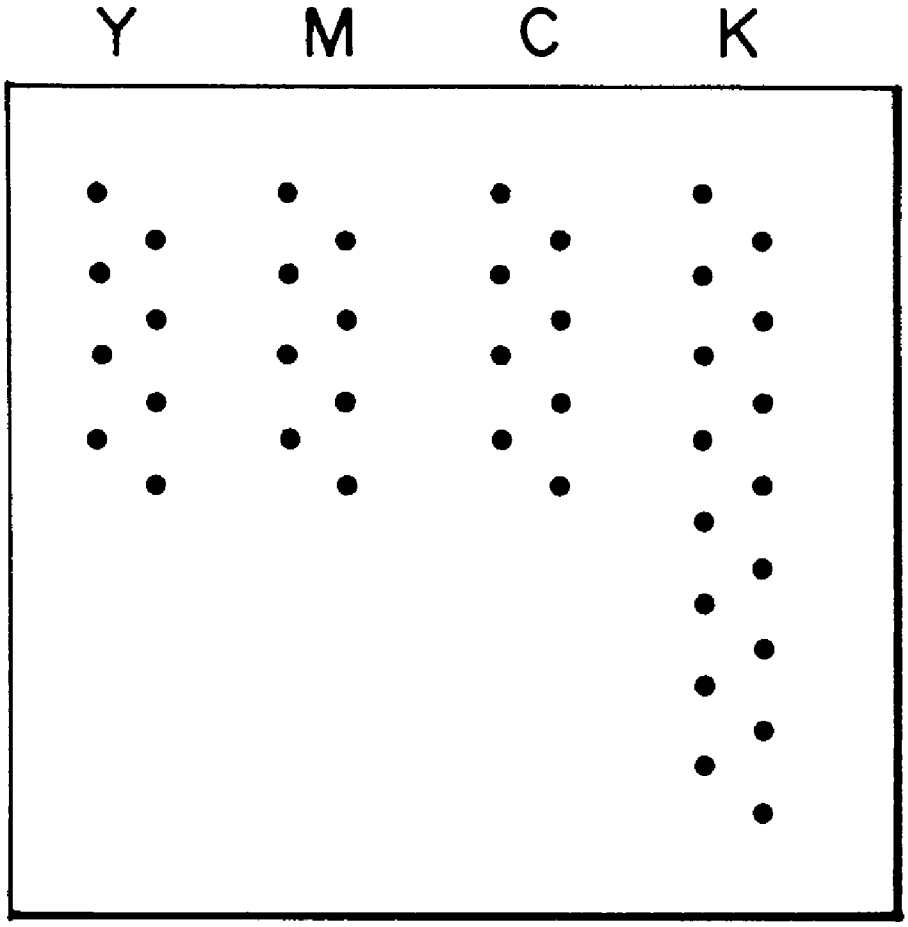
FIG. 17 is a view showing another recording head.

While the embodiment 1 was described with an instance in which the nozzle column corresponding to the ink of each color was arranged linearly in one column, the arrangement may be two columns or curvilinear, as shown in FIG. 17, and what is needed is that if the recording head having a different number of recording pixels for each color to be recorded from the nozzle group corresponding to each color is used with the relative movement between the recording head and the recording medium, the effects equivalent to those of the embodiment 4 can be obtained.

While this embodiment has been described with an instance where CMY scan is made once and K scan is made twice, it is to be noted that CMY scan may be made twice and K scan four times.

When the number of nozzles for a nozzle group A for a color having the greatest number of nozzles among the nozzle groups is NA, and the number of nozzles for a nozzle group B for a color having the smallest number of nozzles is NB, $$SB<SA$$

where the number of scans for A is SA and the number of scans for B is SB, and the further relation $$SB<SA\leqq SB\text{-}NA/NB$$

holds.

As described above, in the color recording operation, using an ink jet recording head having the number of nozzles for a specific color greater than that for other colors, the recording through the nozzles NA for the specific color having more nozzles is performed by shifting the time with the recording area to be sparse, whereby the fixing of the specific color onto the recording medium is enhanced, the color mixing with-other colors can be prevented, and a significantly higher recording quality than conventionally can be obtained.

Further, in spite of more or less dispersed jetting directions of ink droplets through NA nozzles, or dispersed ink jetted volumes through a number of nozzles, the recording in a complementary pattern allows adjacent recording pixels to be recorded with the ink jetted through different nozzles, resulting in improved recording quality.

Also, when the specific color is a color having a high use frequency, the use frequency of nozzles for the specific color is lowered than that of nozzle for other colors, so that the life of the recording head is increased. Therefore, there is the effect of lengthening the life of recording head as a whole. In this case, the increased costs with this recording method may be minimum involving the increase number of nozzles for the specific color.

Also, there is the advantage that when the specific color is black (K), the recording speed at the recording only with the color K can be higher than that at the color recording.

(Embodiment 9)

This embodiment involves an instance of performing the recording with a specific color by over-recording of two or more times to improve the recording quality.

An ink jet recording apparatus to which the present invention is applicable is the same as that shown in FIG. 9, as previously described, and its explanation will be omitted. Also, the details of carriage 101 are the same as in FIG. 19.

Figure 20A:
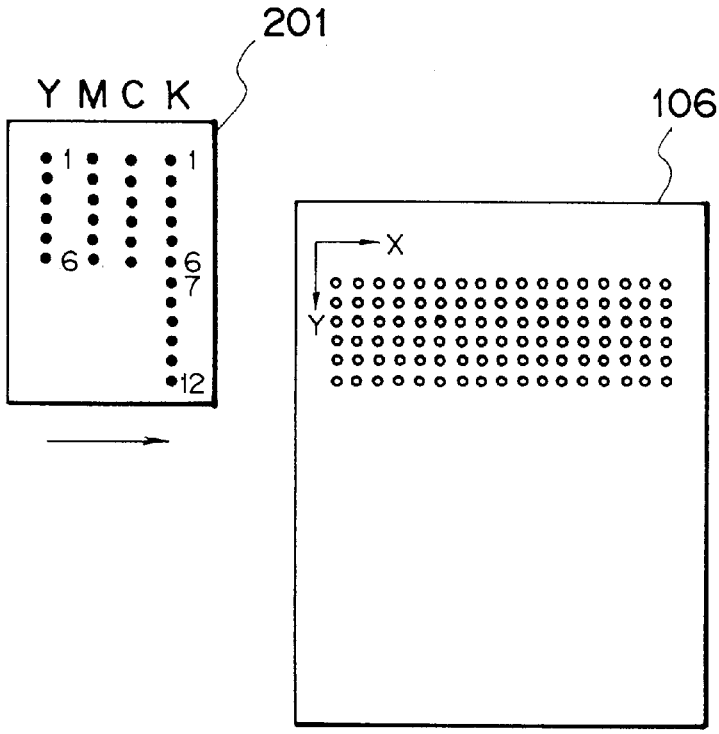
FIGS. 20A and 20B are views for explaining a recording process in an example of the present invention.
Figure 20B:
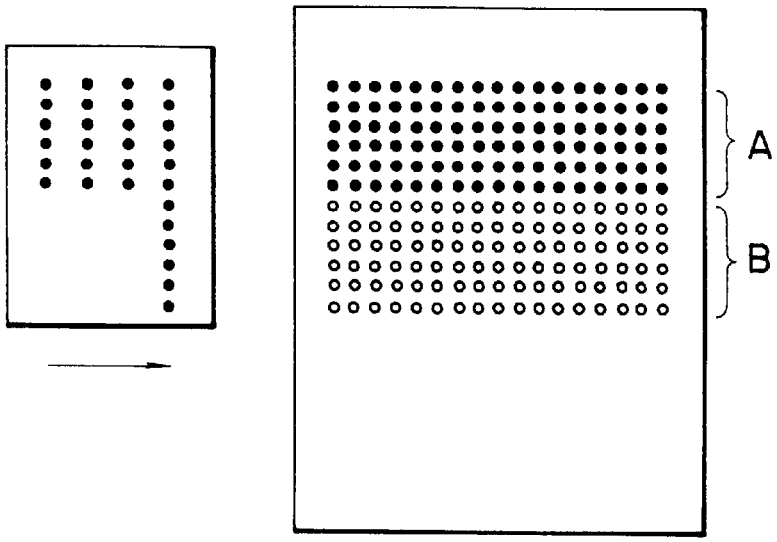

FIGS. 20A and 20B show the recorded states by this embodiment.

201 is a recording head as looking at the discharge orifice face 191 of the print head 102 as shown in FIG. 19. The black point on the discharge orifice face as shown in the figure indicates the nozzle position.

The recording head 201 has six nozzles for each of Y (yellow), M (magenta) and C (cyan), and twelve nozzles or twice the nozzles for other colors for K (black).

The jetting of ink droplets from the recording head can be accomplished by bubbles arising in the ink due to the heat generated by applying electrical energy to the heat generators provided near the nozzles.

The recording head 201 moves relative to the paper 106 which is a recording medium. In FIG. 20A, the X direction as indicated by the arrow is a main scan direction, and the Y direction orthogonal to the main scan direction is a sub-scan direction.

The nozzles of each color in the recording head are arranged substantially linearly and in parallel for each color. The arrangement pitch of the nozzles of each color is about 70.6 micron, which is equal to the pitch of recording pixels. That is, the recording is performed at a recording density of 360 dpi. This is controlled to be similar in the X direction.

The average amount of ink jetted from each nozzle is about 40 pl for C, M and Y, and about 38 pl for K, or slightly lesser than that of CMY, in the normal recording of image data.

The recording method of applying the ink onto the paper for each pixel is performed in such a manner that CMY is excluded in K portion and C+M+Y is replaced with K for an image signal preinput to be recorded. That is, the recording is performed in eight cases of K, C, M, Y, C+M, M+Y, Y+C and no recording.

First, in FIG. 20A, the recording head 201 secured to the carriage of the recording apparatus scans in a main scan direction of the arrow at the first time to record only black data corresponding to the sites indicated by the white circle in the figure within the area to be recorded. In this case, the nozzles of K for use are the seventh to twelfth nozzles.

Then, the recording head 201 and the paper 106 are relatively moved by moving the paper in a direction counter to the Y direction. Subsequently, as shown in FIG. 20B, the second scan in the main scan direction is performed to record the K data corresponding to the sites as indicated by the black circle and YMC data, i.e., the area as indicated by A, within the area to be recorded. The nozzles for YMCK are the first to sixth nozzles. At this time, the ink for K is jetted at the second time onto the same pixels as at the first scan. At the same time, the data for K color corresponding to the sites as indicated by the white circle, i.e., the area as indicated by B, is recorded. The K nozzles for use are all of the seventh to the twelfth nozzles.

Subsequently, the above operation is repeated successively, until the recording of one page is ended.

In this way, to perform the first recording for K ahead of other colors is effective for preventing the blur of ink from spreading over other colors because that K part is fixed earlier on the recording sheet than the inks of other colors to be recorded later. Therefore, the fixing ability onto the recording sheet is enhanced, and the recording quality is improved.

Also, in spite of more or less dispersed jetting directions of ink droplets through the nozzles of K ink, or dispersed ink jetting volumes through a number of nozzles, the same pixel is recorded by two scans using different nozzles, resulting in improved recording quality.

Also, as with the second scan, the scan for the recording operation at the even time may be a return path of the carriage movement in the −X direction counter to the arrow of FIGS. 20A and 20B. This operation allows twice higher recording speed.

With the above constitution, the recording can be made at a higher image quality simply by scanning in the main scan direction one time more than conventionally.

While the six nozzles for each of YMC and twelve nozzles for K are used in this embodiment, it will be appreciated that one nozzle for each of YMC and two nozzles for K may be used with the same effects. Also, as shown in FIG. 14, six nozzles for YMC and eighteen nozzles for K may be used. That is, if the number of nozzles for the specific color is twice or more that for other colors, twice or more over-recordings of the specific color can be made. In general, supposing that N and M are integers equal to or greater than 2, where $N \geqq M$, if the number of nozzles for the specific color is N times or more that for other colors, the M times over-recording of the specific color can be made.

While there has been described that the jetting of ink droplets from the recording head is accomplished by bubbles arising in the ink due to the heat generated by applying electrical energy to the heat generators provided near the nozzles, it will be appreciated that electromechanical conversion elements provided near the nozzles may be used for the application of electrical energy.

The recording medium is not limited to a plain paper, but may be a cloth or an OHP sheet.

Also, a part of black can be recorded later than other colors, with the same effects. With the constitution of nozzles as shown in FIG. 13 and previously described in the embodiment 5, the same effects can be obtained. Note that the sheet feeding operation in this case is performed in a similar manner to the embodiment 5. Also, the present invention is applicable to a recording head with all the nozzles arranged in one line, as shown in FIG. 15, in such a manner as to perform the main scan and the sub-scan at adequate times and by appropriate amounts.

Further, while the embodiment 9 has been described with an instance where the nozzle column corresponding to the ink of each color is linearly arranged in one column, the arrangement may be two columns or curvilinear, as shown in FIG. 17, and what is needed is that if the recording head having a different number of recording pixels for each color to be recorded from the nozzle group corresponding to each color is used with the relative movement between the recording head and the recording medium, the effects equivalent to those of the embodiment 9 can be obtained.

While this embodiment has been described with an instance where the number of nozzles for K color is N times that of other colors, it is known that the use frequency of Y is higher in the typical image such as a natural image.

Thus, by making the number of Y nozzles N times that of other colors, the effects of the present invention to prevent the color mixing with other colors can be expected.

Further, the nozzles for two colors of K and Y having higher use frequencies in recording characters may be N times that of other colors.

As described above, using an ink jet recording head in which the number of nozzles for the specific color is twice or more that of other colors at the color recording operation, the recording through the nozzles for the specific color is performed by twice or more over-recordings onto the same pixel with different nozzles, whereby the recording density of the specific color onto the recording medium can be increased, and the recording quality improved. At this time, the color mixing with other colors can be prevented by twice over-recordings.

Further, in spite of more or less dispersed jetting directions of ink droplets through the nozzles for the specific color, or dispersed ink jetted volumes through a number of nozzles, the twice or more over-recordings onto the same site with different nozzles can relieve such dispersion, resulting in improved recording image quality.

In this case, the increased costs with this recording method may be minimum involving the increased number of nozzles for the specific color.

Also, there is the advantage that the recording speed at the recording only with the specific color can be higher than that at the recording using all the colors.

(Embodiment 10)

A method for suppressing black unevenness occurring due to the biased use of black nozzles when the number of black nozzles is greater than that for other colors will be described below.

A recording apparatus to which the present invention is applicable is as shown in FIG. 9, and its explanation is omitted. The details of carriage 101 are the same as shown in FIG. 19.

The details of print head 12 are the same as those shown in FIG. 10. 201 is a silicone substrate for forming a heater based on the ink jet discharge principle. 202 is a printed board including a drive circuit of the print head 12. 203 is an aluminum plate having the silicone substrate 201 and the printed board 202. 204, 205, 206, 207 are pipes for supplying the ink from a color cartridge 110 and a black cartridge 111 through a distributor 208 to discharge units of the print head 12. Each of 2Y, 2M, 2C and 2Bk is a group of nozzles for discharging the ink of each of yellow, cyan, magenta and black. The print head 12 according to the present invention has the nozzles of each color arranged in one column. The number of nozzles for each color is 24 for 2Y, 24 for 2M, 24 for 2C, and 64 for 2Bk. And an interval by the amount of eight nozzles at a pitch equal to that of nozzles 2Y, 2M, 2C and 2Bk is provided between the nozzles 2Y and 2M and between the nozzles 2M and 2C.

Figure 21:
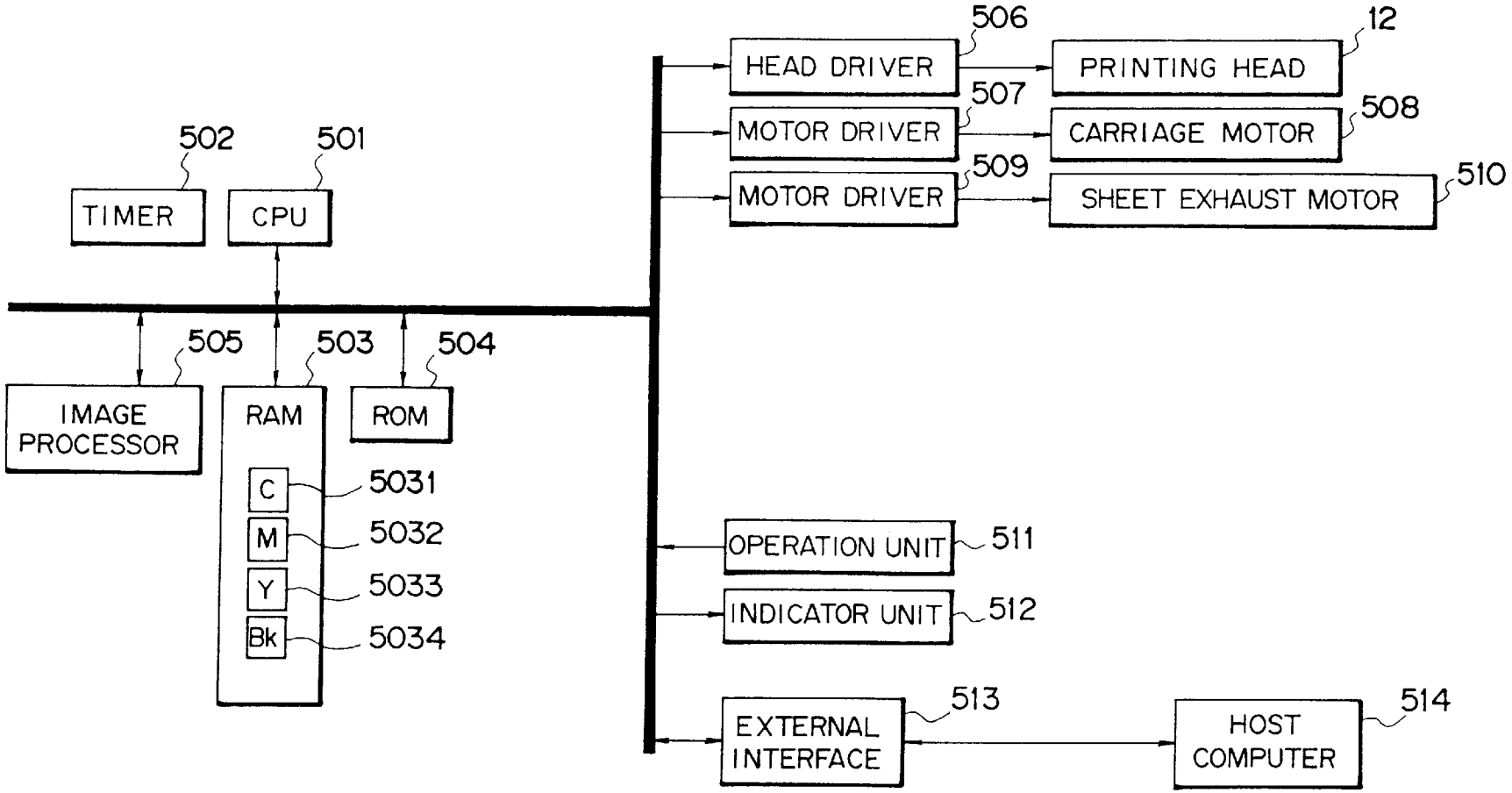
FIG. 21 is a diagram showing an electrical circuit configuration of an ink jet recording apparatus of the present invention.

FIG. 21 shows an electrical circuit block diagram of a color ink jet recording apparatus according to the present invention. 501 is a CPU for controlling the overall color ink jet recording apparatus, including a circuit for processing the macro operation such as data transfer by itself. 502 is a timer for generating the timing necessary for the control and a system clock for the overall logical circuit portion.

Print data transmitted from a host computer 514 is input into an external interface section 513 constituted of a hardware, and sent out on to the bus line, the print data being temporarily stored in a buffering area of RAM 503 under the control of CPU 501. The CPU 501 expands the data into image data by linking with an image processor 505 with a program stored in a ROM 504. When the data is a character code, the image data of the ROM 504 corresponding to the character code is read and stored in an image buffer area of the RAM 503. Or the image data corresponding to the character code is created by a logical circuit. When the image data is color, cyan data of the image data, magenta data of the image data, yellow data of the image data, and black data of the image data are stored in a cyan image buffer area 5031, a magenta image buffer area 5032, a yellow image buffer area 5033 and a black image buffer area 5034 of the RAM 503, respectively. The above image data is transmitted to a head driver 506 by a data transfer control circuit contained in the CPU 501, and recorded by a recording head 12. The head driver 506 includes an electric power element for driving the recording head 12. Also, it has separate head driving circuits for yellow, cyan, magenta and black mounted. And image data corresponding to each color is transferred to each circuit. An operation unit 511 has a man-machine interface to make the designation of font, the switching of on-line/off-line, and the line feed, and the CPU 501 displays a response to the operation on an indicator unit 512. The motor drivers 507, 509 are controlled by the CPU 501 to drive a carriage motor 508 and a sheet exhaust motor 510.

Figure 22A:
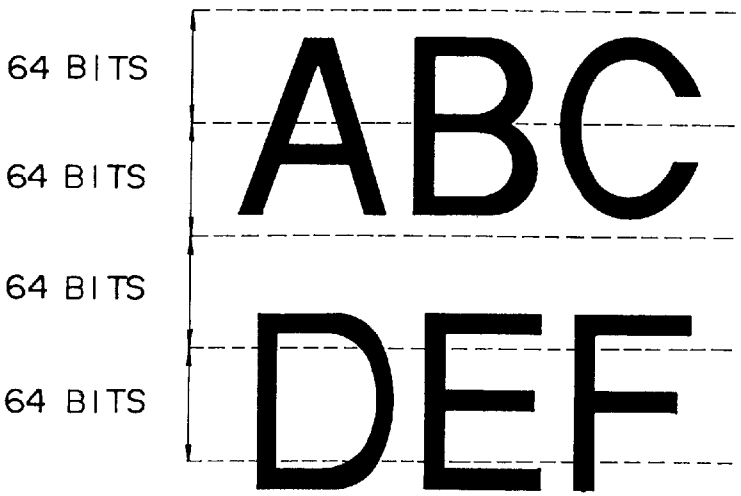
FIGS. 22A and 22B are views for explaining a scan process in performing the monochrome printing to make clear the technical background of the present invention.
Figure 22B:
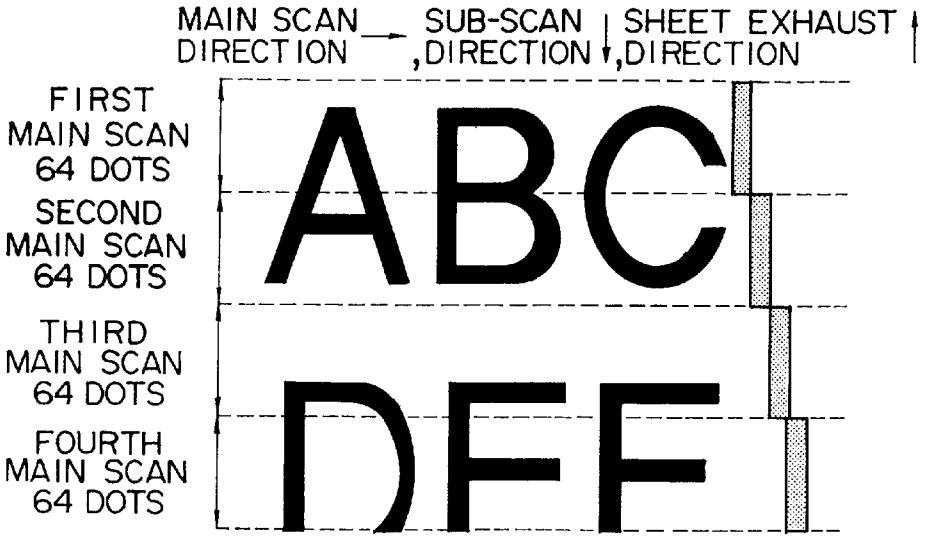

FIGS. 22A and 22B show a scan process of the print head 12 in performing the monochrome printing.

The number of black nozzles 2Bk of the print head 12 according to the present invention is sixty four. Character data transmitted from the host computer 514 is expanded into image data by the processings of the image processor 505 and the CPU 501, and stored in a buffer area 5034 for the storage of image data provided in the RAM 503. The image data is picked up by 64 bits each time in a direction of the nozzle array for black head or a sub-scan direction in accordance with the scan of the carriage 11 by the processing of the CPU 501, and sent out to the head driver 506. FIG. 22A represents the data in an image data buffer 5034 for black. FIG. 22B shows the state of printing the image data, or the scan process. If the printing amounting to 64 bits is completed, the print head 12 performs the recording again by moving the recording medium in the sub-scan direction by the amount of 64 bits.

Figure 23A:
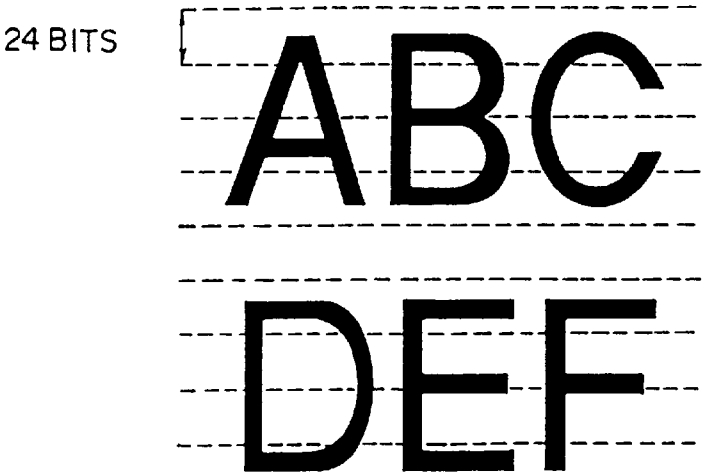
FIG. 23A PRIOR ART
FIGS. 23A and 23B are views for explaining a scan process in performing the color printing to make clear the technical background of the present invention.
Figure 23B:
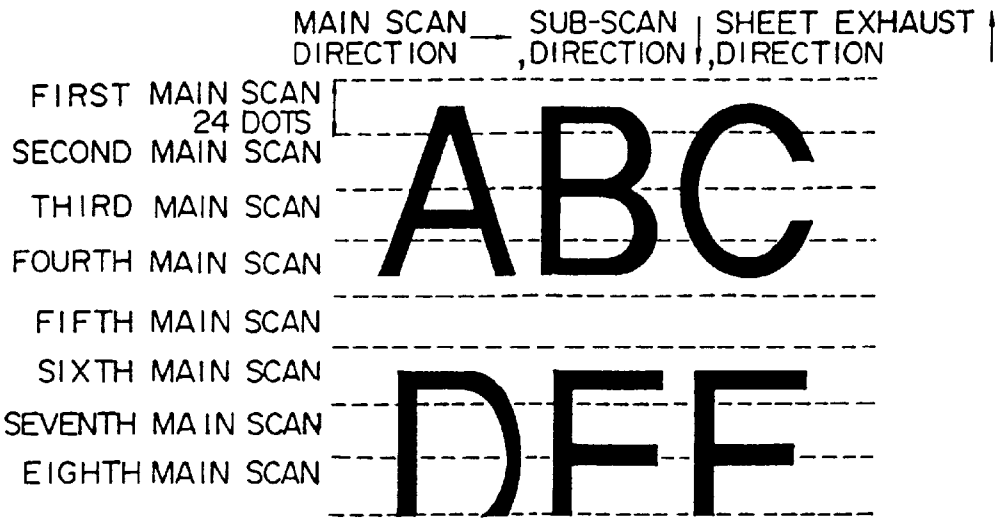
FIG. 23B PRIOR ART

FIGS. 23A and 23B show a conventional scan process of the print head 12 in peforming the color printing.

The number of nozzles for yellow, magenta and cyan 2Y, 2M and 2C of the print head 12 according to the present invention is equal to twenty four. The number of nozzles for black 2Bk is greater than that for other colors, i.e., equal to sixty four, because they have a higher use frequency and are required to have the high speed at the monochrome recording. Character data transmitted from the host computer 514 is expanded into image data by the processings of the image processor 505 and the CPU 501, and stored in the buffer area 5034 for the storage of image data provided in the RAM 503. The image data is picked up in a direction of the nozzle array or the sub-scan direction in accordance with the scan of the carriage 11 by the processing of the CPU 501, and sent out to the head driver 506. And the printing amounting to 24 dots is performed in the sub-scan direction. At this time, the black nozzles Bk used are from the first to the twenty fourth nozzles.

In the case of the color printing, the heads of cyan, magenta and yellow each have twenty four nozzles, and one main scan is performed for each twenty four nozzles. FIG. 23A represents image data for one color in the image data buffers 5031, 5032, 5033, 5034. FIG. 23B shows the state where the printing of image data is completed up to the eighth scan.

By the way, the print head 102 according to the present invention has the nozzles for each color arranged in one column. Also, the number of nozzles for each color is 24 for 2Y, 24 for 2M, 24 for 2C, and 64 for 2Bk. And a space by the amount of eight nozzles at a pitch equal to that of the nozzles 2Y, 2M, 2C and 2Bk is provided between the nozzles 2Y and 2M and between the nozzles 2M and 2C. Also, a space by the amount of sixteen nozzles is provided between the nozzles 2C and 2Bk. To allow this print head 102 to make the printing for each twenty four nozzles, a scan process as shown in FIG. 24 is required.

Figure 24:
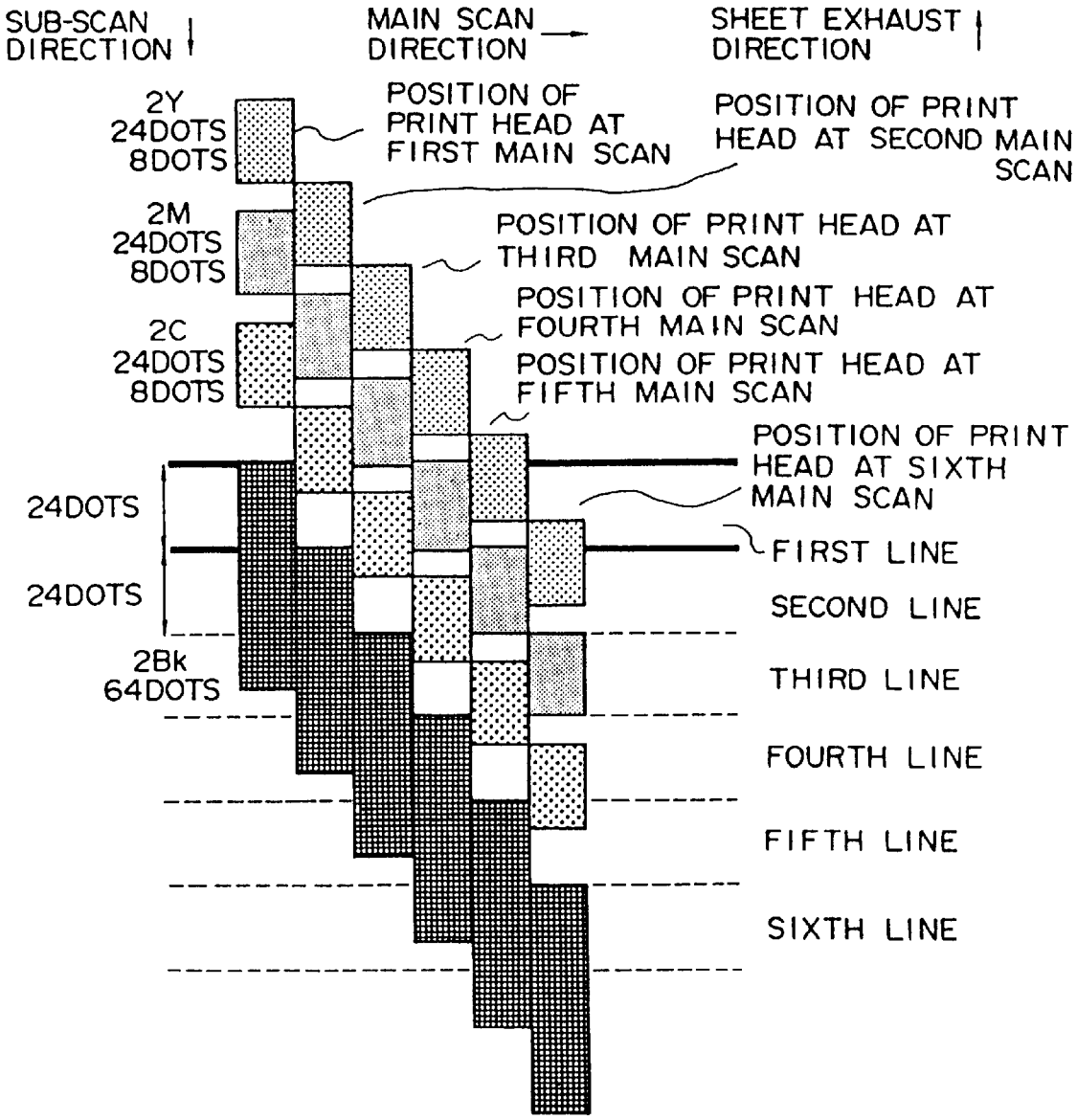
FIG. 24 PRIOR ART
FIG. 24 is a view for explaining a scan process in performing the color printing to make clear the technical background of the present invention.

In FIG. 24, at the first main scan, the first to twenty fourth nozzles among the black nozzles 2Bk are used for the printing on the first line with.

At the second main scan, the seventeenth to twenty fourth nozzles among the cyan nozzles 2C are used for the printing on the first line with. At this time, the first to twenty fourth nozzles of the black nozzles 2Bk perform the printing on the second line.

At the third main scan, the first to sixteenth nozzles among the cyan nozzles 2C perform the printing on the first line. At this time, the seventeenth to twenty fourth nozzles of the cyan nozzles perform the printing on the second line. Also, the first to twenty fourth nozzles among the black nozzles 2Bk perform the printing on the third line.

At the fourth main scan, the twenty four nozzles of the magenta nozzles 2M perform the printing on the first line. At this time, the first to sixteenth nozzles of the cyan nozzles 2C perform the printing on the second line. The seventeenth to twenty fourth nozzles of the cyan nozzles 2C perform the printing on the third line. Further, the first to twenty fourth nozzles among the black nozzles 2Bk perform the printing on the fourth line.

At the fifth main scan, the ninth to twenty fourth nozzles among the yellow nozzles 2Y perform the printing on the first line. At this time, the twenty four nozzles of the magenta nozzles 2M perform the printing on the second line. The first to sixteenth nozzles of the cyan nozzles 2C perform the printing on the third line. The seventeenth to twenty fourth nozzles of the cyan nozzles 2C perform the printing on the fourth line. Further, the first to twenty fourth nozzles among the black nozzles 2Bk perform the printing on the fifth line.

At the sixth main scan, the first to eighth nozzles of the yellow nozzles 2Y perform the printing on the first line. At this time, the ninth to twenty fourth nozzles among the yellow nozzles 2Y perform the printing on the second line. The twenty four nozzles of the magenta nozzles 2M perform the printing on the third line. The first to sixteenth nozzles of the cyan nozzles 2C perform the printing on the fourth line. The seventeenth to twenty fourth nozzles of the cyan nozzles 2C perform the printing on the fifth line. Further, the first to twenty fourth nozzles among the black nozzles 2Bk perform the printing on the sixth line.

With the above scan processes of six times, it is normally considered to perform the color printing in a width of twenty four nozzles.

However, when the temperature of the nozzles of the ink jet head has not been retained at a temperature suitable for the discharge in performing the ink discharge, or when any predischarge with which recording is made on the recording medium or paper has not been performed, the excellent ink discharge characteristic can not be obtained.

When the color printing is performed by a plurality of print heads having different numbers of nozzles, as previously described, a print head having more nozzles than other heads, i.e., a black print head in the conventional embodiment, must discharge the ink using a part of a plurality of nozzles, i.e., twenty four nozzles among sixty four nozzles. There was a problem that when a transfer was made from the color printing to the monochrome printing of using all the black print head nozzles, the discharge characteristic of a nozzle group used was not matched with that of a nozzle group not used, causing an image unevenness in the main scan direction, resulting in less high quality printing. Further, there was another problem that owing to the difference in degradation between nozzles caused by the bias in the use frequency of nozzle, image unevenness might occur by a change with the elapse of time, resulting in less high quality recording.

Figure 25:
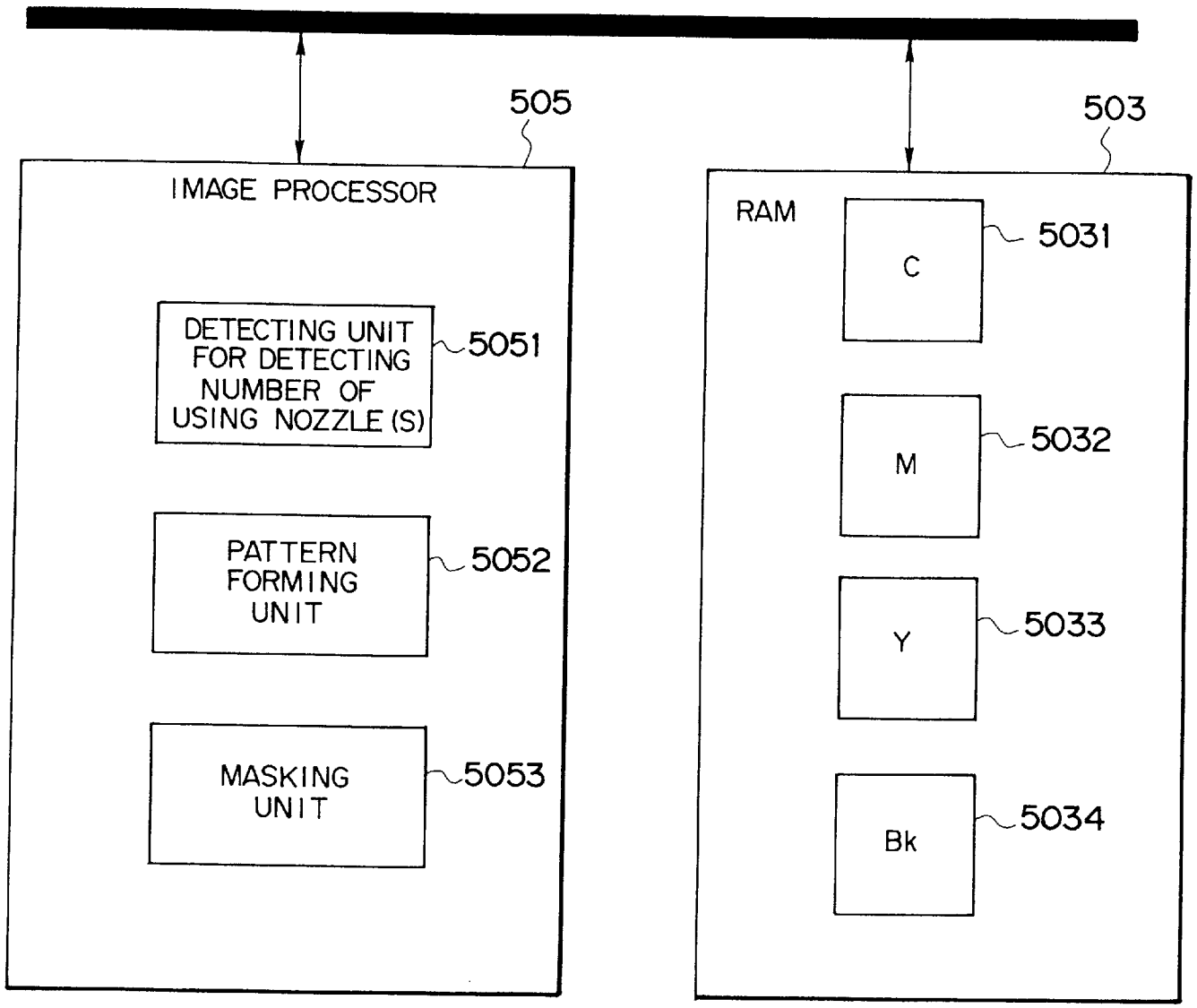
FIG. 25 is a block diagram showing the principle units of the ink jet recording apparatus according to an embodiment of the present invention.

FIG. 25 is a block diagram of an electrical circuit portion which represents the features of the present invention most appropriately. Other electrical circuit portions are the same as those of FIG. 21.

5051 is a nozzle use number detecting unit for detecting whether or not the color printing is to be performed for image data produced by the data received from the host computer 514.

5052 is a pattern forming unit for forming a pattern of equalizing the use frequency of each head to that of a print head having more nozzles than other heads, i.e., a black print head in this embodiment, upon a detection signal from the nozzle use number detecting unit 5051.

Figure 26A:
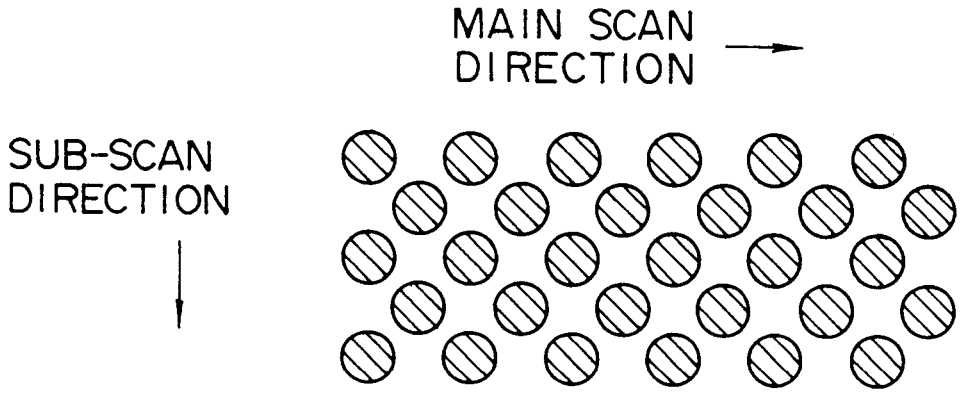
FIGS. 26A to 26C are views showing the masking patterns in driving a print head of black.
Figure 26B:
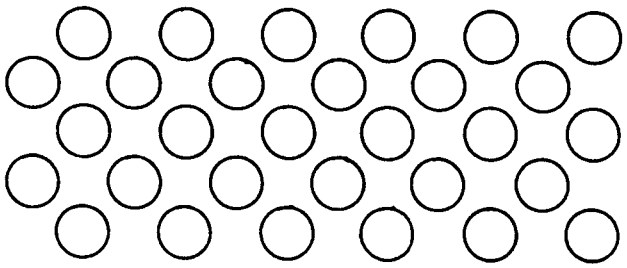

5053 is a masking unit for taking a logical sum between the pattern produced by the pattern forming unit 5052 and a print pattern within the image buffer 5034 that must be printed in practice. This pattern consists of two kinds of patterns as shown in FIGS. 26A and 26B. The dot as represented is logic "1" in two patterns, and the other portion where the dot is locking is logic "0". The image data of the image buffer 5034 corresponding to the portion of logic "1" is printed. Hereinafter, the pattern of FIG. 26A is a normal pattern, and the pattern of FIG. 26B is a reverse pattern.

Figure 26C:
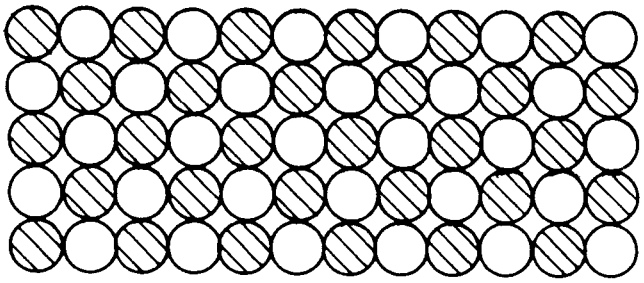

If the two normal and reverse patterns are superposed one on the other, FIG. 26C results. That is, when the two patterns are superposed, the recording of the image data of the original image buffer 5034 can be completed.

Next, the operation to be performed when the color printing is required will be described with reference to FIG. 27.

When the color printing is required for the data transmitted from the host computer 514, the nozzle use number detecting unit 5051 transmits a detection signal to the pattern forming unit 5052. Then, the pattern forming unit 5052 sends out the normal pattern data to the first to thirty second nozzles of the black nozzles 2Bk and the reverse pattern data to the thirty third to sixty fourth nozzles of the black nozzles 2Bk via the masking unit 5053. The masking unit 5053 draws out image data by the amount of sixty four dots in the sub-scan direction and the amount of one dot in the main scan direction from the image buffer 5034. However, in the first main scan for recording, the data in the first to thirty-second nozzles of the black nozzles 2Bk is sent out to a black print head driver of the head driver 506, without being processed in the masking unit 5053. The data in the thirty third to sixty fourth nozzles of the black nozzles 2Bk is processed in the masking unit 5053 which takes a logical sum with the reverse pattern, and sends out its result to the black print head driver. The print head driver performs the printing based on the image data sent thereto. Likewise, the masking unit 5053 draws out image data by the amount of sixty four dots in the main scan direction and the amount of one dot in the sub-scan direction, whereby the printing at the first scan is performed with image data itself in the first to thirty second nozzles of the black nozzles 2Bk, and the reverse pattern in the thirty third to sixty fourth nozzles. The first to twenty second nozzles of the black nozzles 2Bk correspond to the first line, the twenty fifth to forty eighth nozzles to the second line, and the forty ninth to sixty fourth nozzles to the third line.

Then, the recording sheet 16 is exhausted by the amount of a pitch of 24 dots, so that the carriage 101 returns to a home position. While the carriage 101 returns, the following processing is performed. The cyan image data at the second main scan is drawn by the amount of eight dots in the sub-scan direction and the amount of one dot in the main scan direction from the image buffer 5031 under the control of the CPU 501, which image data is sent out to a cyan print head driver of the head driver 506. The image data of cyan is continuous eight dots. The image data is printed at the first line using the seventeenth to twenty fourth nozzles of the cyan nozzles 2C.

Then, the recording sheet 16 is exhausted by the amount of a pitch of 8 dots. The carriage 101 returns to the home position. While the carriage 101 returns, the following printing is performed. The nozzle use number detecting unit 5051 transmits a detection signal to the pattern forming unit 5052. Then, the pattern forming unit 5052 sends out the normal pattern data to the first to thirty second nozzles of the black nozzles 2Bk and the reverse pattern data to the thirty third to sixty fourth nozzles of the black nozzles 2Bk via the masking unit 5053. The masking unit 5053 draws out image data by the amount of sixty four dots in the sub-scan direction and the amount of one dot in the main scan direction from the image buffer 5034 to take a logical sum between the image data and the pattern. The resulted image data consisting of the amount of sixty four dots in the sub-scan direction and the amount of one dot in the main scan direction is sent out to the black print head driver of the head driver 506. The image data consisting of the amount of sixty four dots in the sub-scan direction and the amount of one dot in the main scan direction is subjected to a masking process of the masking unit 5053, which then sends out the data to the print head driver, where the printing at the third main scan is performed as shown in FIG. 27. This printing corresponds to the ninth to sixty fourth dots in the second line. The first to sixteenth nozzles of the black nozzles 2Bk corresponds to the second line, the seventeenth to fortieth nozzles to the third line, and the forty first to sixty fourth nozzles to the fourth line.

Then, the recording sheet 16 is exhausted by the amount of a pitch of 16 dots, so that the carriage 101 returns to the home position. While the carriage 101 returns, the same processing as at the second main scan is performed. The cyan image data is continuous twenty four dots. Based on the image data, the printing at the fourth main scan is performed as shown in FIG. 27. In the first line, the printing with the first to sixteenth nozzles of the cyan nozzles 2C is performed. Concurrently, the seventeenth to twenty fourth nozzles are printing the second line.

Then, the recording sheet 16 is exhausted by the amount of a pitch of 16 dots. Then, the carriage 101 returns to the home position. While the carriage 101 returns, the processing at the fifth main scan with the black nozzles 2Bk is performed in a similar manner to that at the third main scan. The printing is for the seventeenth to sixty fourth dots in the third line. The first to eighth nozzles of the black nozzles 2Bk correspond to the third line, the ninth to thirty second nozzles to the fourth line, the thirty third to fifty sixty nozzles to the fifth line, and the fifty seventh to sixth fourth nozzles to the sixth line. The normal pattern as shown in FIG. 26A is stored for the first to thirty second nozzles of the black nozzles of the black print head, and the reverse pattern as shown in FIG. 26B is stored for the third to sixty fourth nozzles.

Then, the recording sheet 16 is exhausted by the amount of a pitch of 8 dots, so that the carriage 101 returns to the home position. While the carriage 101 returns, the same processing as at the second and fourth main scan is performed. The cyan image data is continuous twenty four dots. Based on the image data, the printing at the sixth main scan is performed as shown in FIG. 27. In the second line, the printing with the first to sixteenth nozzles of the cyan nozzles 2C is performed. Concurrently, the seventeenth to twenty fourth nozzles are printing the third line. Also, twenty four dots of the magenta nozzles 2M are printed in the first line.

Then, the recording sheet 16 is exhausted by the amount of a pitch of 24 dots. The carriage 101 returns to the home position. While the carriage 101 returns, the processing for the seventh main scan with the black nozzles 2Bk is performed in a similar manner to that at the third and fifth main scan. The printing is the first to sixty fourth dots in the fifth line. The first to twenty fourth nozzles of the black nozzles 2Bk correspond to the fifth line, the twenty fifth to forty eighth nozzles to the sixth line, and the forty ninth to sixty fourth nozzles to the seventh line. Among the black nozzles of the black print head, the odd- numbered nozzles are used for the first to thirty second nozzles, and the even numbered nozzles are used for the thirty third to sixty fourth nozzles. Also, the printing for twenty four dots of cyan and magenta is performed under the control of the CPU 501, and further, the ninth to twenty fourth nozzles of the yellow nozzles 2Y prints the second line.

In the same manner, the printing is then performed in the normal pattern for the first to thirty second nozzles among all the sixty four nozzles of the black nozzles, and in the reverse pattern for the thirty third to sixty fourth nozzles. That is, a scan process for recording using thirty two nozzles among sixty four nozzles at all times is repeatedly performed, so that sixty four nozzles are substantially uniformly used.

In the above way, the black print head performs the printing while driving thirty two nozzles in accordance with a pattern formed by the pattern forming unit 5052. The print heads of cyan, magenta and yellow perform the printing using all the twenty four nozzles.

With the above action, the black print head could be used without any bias in the number of used nozzles of the black print head at the color printing. With the effect, the temperature of the print head can be equalized, and when a transfer from the color printing to the monochrome printing using all the black print head nozzles is made, image unevenness in the main scan direction can be eliminated, resulting in high quality recording. Further, the difference in degradation between nozzles caused by the bias in the use frequency of nozzle can be removed, resulting in reduced image unevenness produced by the change with the elapse of time.

Figure 27:
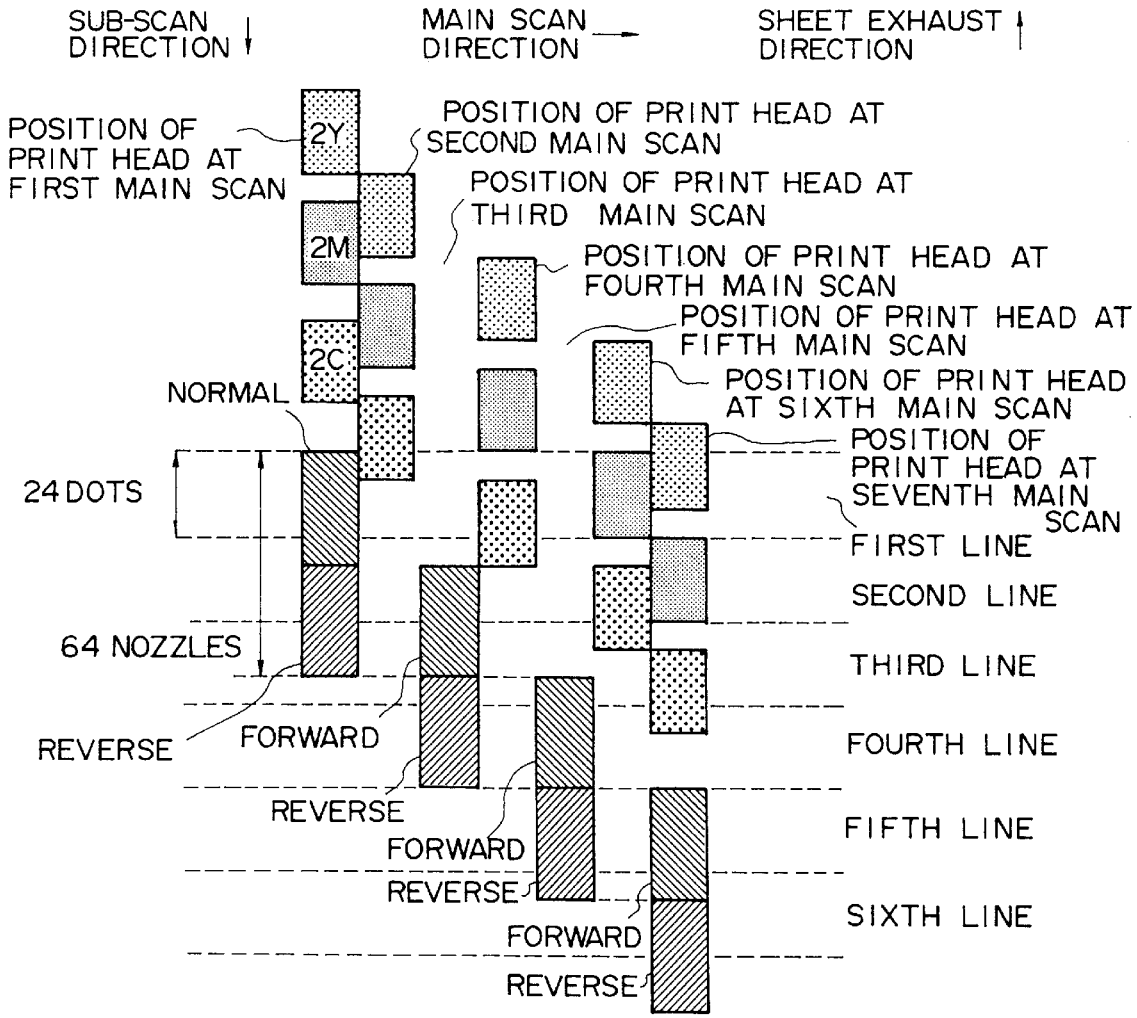
FIG. 27 is a view representing the overall scan process of the print head as shown in the embodiment.

In this embodiment, the first to thirty second nozzles of the black nozzles 2Bk were subjected to the masking processing in the masking unit 5053 in the one main scan, as shown in FIG. 27. The present invention is not limited thereto. For example, the area for the first to thirty second nozzles of the black nozzles 2Bk in the one main scan in FIG. 27 may be stored in the reverse pattern with the thirty third to sixty fourth nozzles of the black nozzles 2Bk in the previous main scan.

Figure 28:
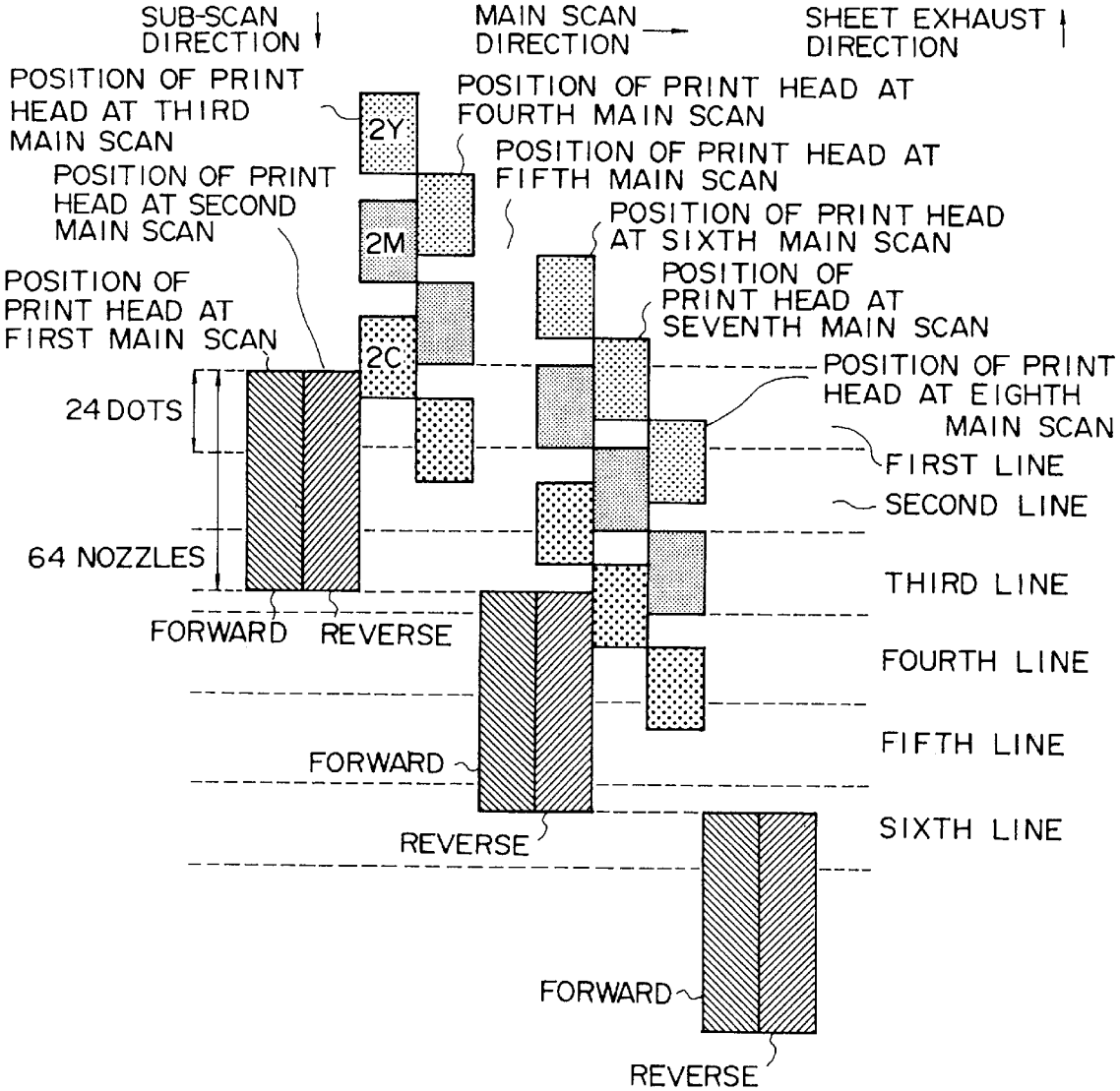
FIG. 28 is a view representing the overall scan process of the print head as shown in the embodiment.

FIG. 28 is a view representing another scan process to prevent the color unevenness from arising due to the use frequencies of black nozzles.

The operation to be performed when the color printing is required will be described with reference to FIG. 28.

When the color printing is required for the data transmitted from the host computer 514, the nozzle use number detecting unit 5051 transmits a detection signal to the pattern forming unit 5052. Then, the pattern forming unit 5052 sets a normal pattern and sends out the normal pattern data to the masking unit 5053. The masking unit 5053 draws out image data by the amount of sixty four dots in the sub-scan direction corresponding to the first, second and third lines and the amount of one dot in the main scan direction from the image buffer 5034, and takes a logical sum between the image data and the pattern. The resulted image data consisting of sixty four dots in the sub-scan direction and one dot in the main scan direction is sent out to the black print head driver of the head driver 506. Based on the image data, the data processed in the masking unit is sent out to the print head driver for the printing of the first main scan of FIG. 28. The first to sixty fourth nozzles of the black print head are used to print in the normal pattern as shown in FIG. 26A.

Then, the recording sheet 16 is not exhausted, and the carriage 101 returns to the home position. While the carriage 101 returns, the following processing is performed.

The pattern forming unit 5052 sets a reverse pattern and sends out the reverse pattern data to the masking unit 5053. The masking unit 5053 draws out image data by the amount of sixty four dots in the sub-scan direction and the amount of one dot in the main scan direction from the image buffer 5034, like the normal pattern, and takes a logical sum between the image data and the pattern. The resulted image data consisting of sixty four dots in the sub-scan direction and one dot in the main scan direction is sent out to the black print head driver of the head driver 506. Based on the image data, the printing for the second main scan of FIG. 28 is performed. At the second main scan, the first to sixty fourth nozzles of the black print head are used to print in the reverse pattern as shown in FIG. 26A.

Then, the recording sheet 16 is exhausted by the amount of a pitch of 24 dots. The carriage 101 returns to the home position. While the carriage 101 returns, the following processing is performed. Under the control of the CPU 501, the image data by the amount of eight dots for the cyan print head is read from the image buffer 5031, and sent out to the print head driver for the cyan print head of the head driver 506. Based on the image data, the printing at the third main scan as shown in FIG. 28 is performed. The seventeenth to twenty fourth nozzles of the cyan print head are used.

Then, the recording sheet 16 is exhausted by the amount of a pitch of 24 dots. The carriage 101 returns to the home position. While the carriage 101 returns, the same processing as at the third main scan is performed. Under the control of the CPU 501, the printing with the first to twenty fourth nozzles of the cyan print head is performed.

Then, the recording sheet 16 is exhausted by the amount of a pitch of 16 dots. The carriage 101 returns to the home position. While the carriage 101 returns, the same processing as at the first main scan is performed.

Subsequently, the scan process is repeatedly performed in such a manner that the black printing is performed in a normal pattern of 32 dots of the black nozzles and in a reverse pattern of 32 dots.

In the above manner, the black print head performs the printing by alternately driving thirty two nozzles among sixty four nozzles at all times in accordance with a pattern formed by the pattern forming unit 5052. The print heads of cyan, magenta and yellow perform the printing using all the twenty four nozzles.

With the above action, all the nozzles of the black print head care used to perform the printing. With the effect, the temperature of the print head can be equalized, and when a transfer from the color printing to the monochrome printing using all the black print head nozzles is made, image unevenness in the main scan direction can be eliminated, resulting in high quality recording. Further, the difference in degradation between nozzles caused by the bias in the use frequency of nozzle can be removed, resulting in reduced image unevenness produced by the change with the elapse of time.

Figure 29:
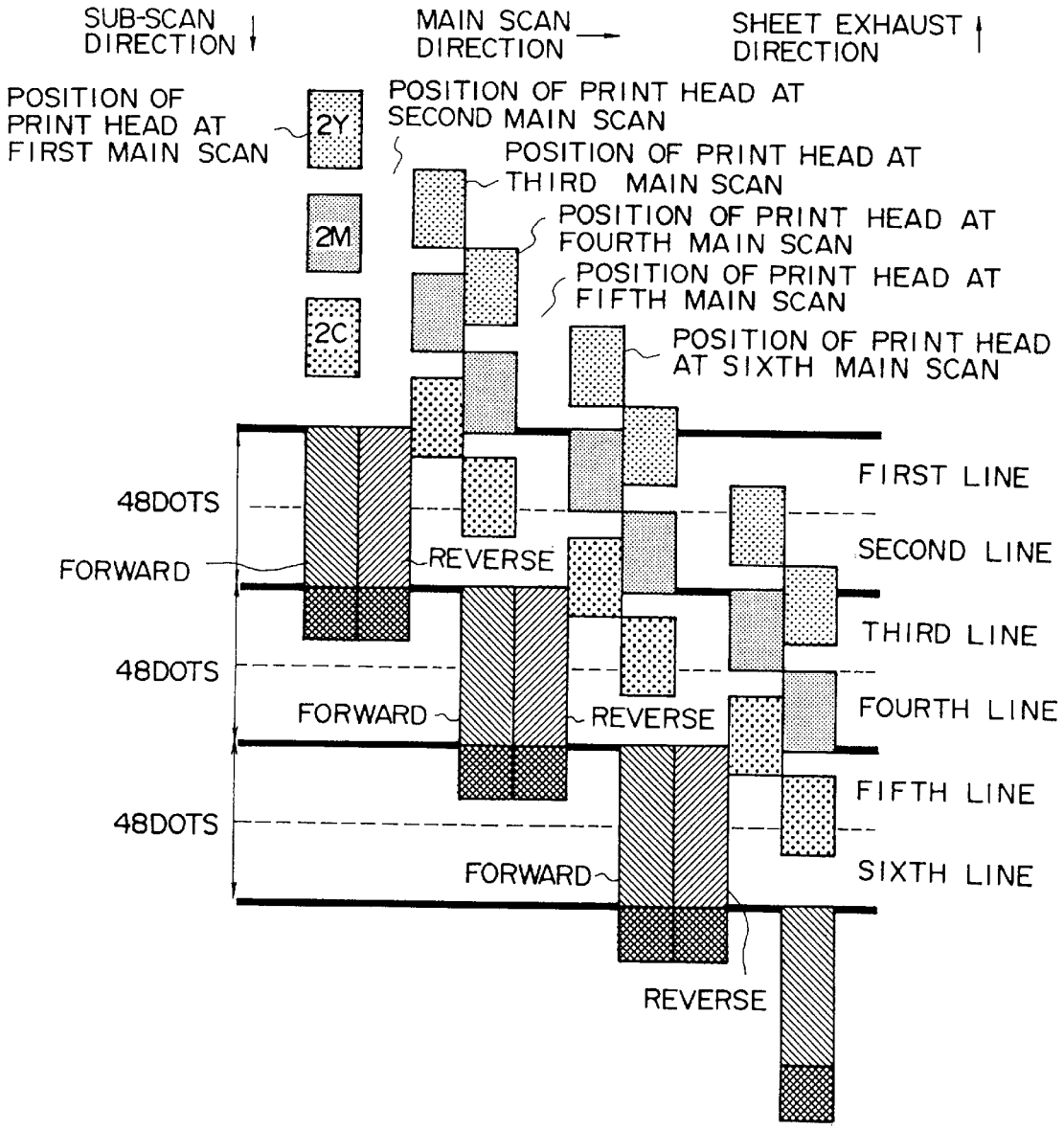
FIG. 29 is a view representing the overall scan process of the print head as shown in the embodiment.

FIG. 29 is a view representing another scan process to reduce the color unevenness due to the use frequencies of black nozzles.

The operation to be performed when the color printing is required will be described with reference to FIG. 29.

When the color printing is required for the data transmitted from the host computer 514, the nozzle use number detecting unit 5051 transmits a detection signal to the pattern forming unit 5052. Then, the pattern forming unit 5052 sets a normal pattern and sends out the normal pattern data to the masking unit 5053. The masking unit 5053 draws out image data by the amount of forty eight dots in the sub-scan direction corresponding to the first and second lines and the amount of one dot in the main scan direction from the image buffer 5034, and takes a logical sum between the image data and the pattern. The resulted image data consisting of forty eight dots in the sub-scan direction and one dot in the main scan direction is sent out to the black print head driver of the head driver 506. Based on the image data, the printing for the first main scan of FIG. 29 is performed. The first to forty eighth nozzles of the black print head are used to print in the normal pattern as shown in FIG. 26A. The forty ninth to sixty fourth nozzles are not used.

Then, the recording sheet 16 is not exhausted, and the carriage 101 returns to the home position. While the carriage 101 returns, the following processing is performed.

The pattern forming unit 5052 sets a reverse pattern and sends out the reverse pattern data to the masking unit 5053. The masking unit 5053 draws out image data by the amount of forty eight dots in the sub-scan direction and the amount of one dot in the main scan direction from the image buffer 5034, like the normal pattern, and takes a logical sum between the image data and the pattern. The resulted image data consisting of sixty four dots in the sub-scan direction and one dot in the main scan direction is sent out to the black print head driver of the head driver 506. Based on the image data, the printing for the second main scan of FIG. 29 is performed. The first to forty eighth nozzles of the black print head are used to print in the reverse pattern as shown in FIG. 26A. The forty ninth to sixty fourth nozzles are not used, like the first main scan.

Then, the recording sheet 16 is exhausted by the amount of a pitch of 24 dots. The carriage 101 returns to the home position. While the carriage 101 returns, the following processing is performed. Under the control of the CPU 501, the image data by the amount of eight dots for the cyan print head is read from the image buffer 5031, and sent out to the print head driver for the cyan print head of the head driver 506. Based on the image data, the printing for the third main scan as shown in FIG. 29 is performed. The seventeenth to twenty fourth nozzles of the cyan print head are used.

Then, the recording sheet 16 is exhausted by the amount of a pitch of 24 dots. The carriage 101 returns to the home position. While the carriage 101 returns, the same processing as at the first main scan is performed. At the fourth main scan, the cyan print head and the black print head perform the printing.

Under the control of the CPU 501, the image data by the amount of 24 dots for the cyan print head is read from the image buffer 5031, and sent out to the cyan print head driver of the head driver 506. Based on the image data, the printing for the fourth main scan of FIG. 29 is performed. The first to twenty fourth nozzles of the cyan print head are all used.

The pattern forming unit 5052 sets a normal pattern and sends out the normal pattern data to the masking unit 5053. The masking unit 5053 draws out image data by the amount of forty eight dots in the sub-scan direction corresponding to the third and fourth lines and the amount of one dot in the main scan direction from the image buffer 5034, and takes a logical sum between the image data and the pattern. The resulted image data consisting of forty eight dots in the sub-scan direction and one dot in the main scan direction is sent out to the black print head driver of the head driver 506. Based on the image data, the printing for the fourth main scan of FIG. 29 is performed. The first to forty eight nozzles of the black print head are used to print in the normal pattern as shown in FIG. 26A, like the first main scan.

In the above manner, the black print head performs the printing by driving forty eight nozzles in total in accordance with a pattern formed by the pattern forming unit 5052. The print heads of cyan, magenta and yellow perform the printing using all the twenty four nozzles.

Subsequently, the scan process is repeatedly performed using the upper forty eight nozzles of the black nozzles.

With the above action, the total percentage of using the print head could be raised by increasing the number of used nozzles for the black print head at the color printing. With the effect, the temperature of the print head can be more equalized than when using only twenty four nozzles, and when a transfer from the color printing to the monochrome printing using all the black print head nozzles is made, image unevenness in the main scan direction can be improved, resulting in high quality recording. Further, the difference in degradation between nozzles caused by the bias in the use frequency of nozzle can be removed, resulting in reduced image unevenness produced by the change with the elapse of time.

Figure 30:
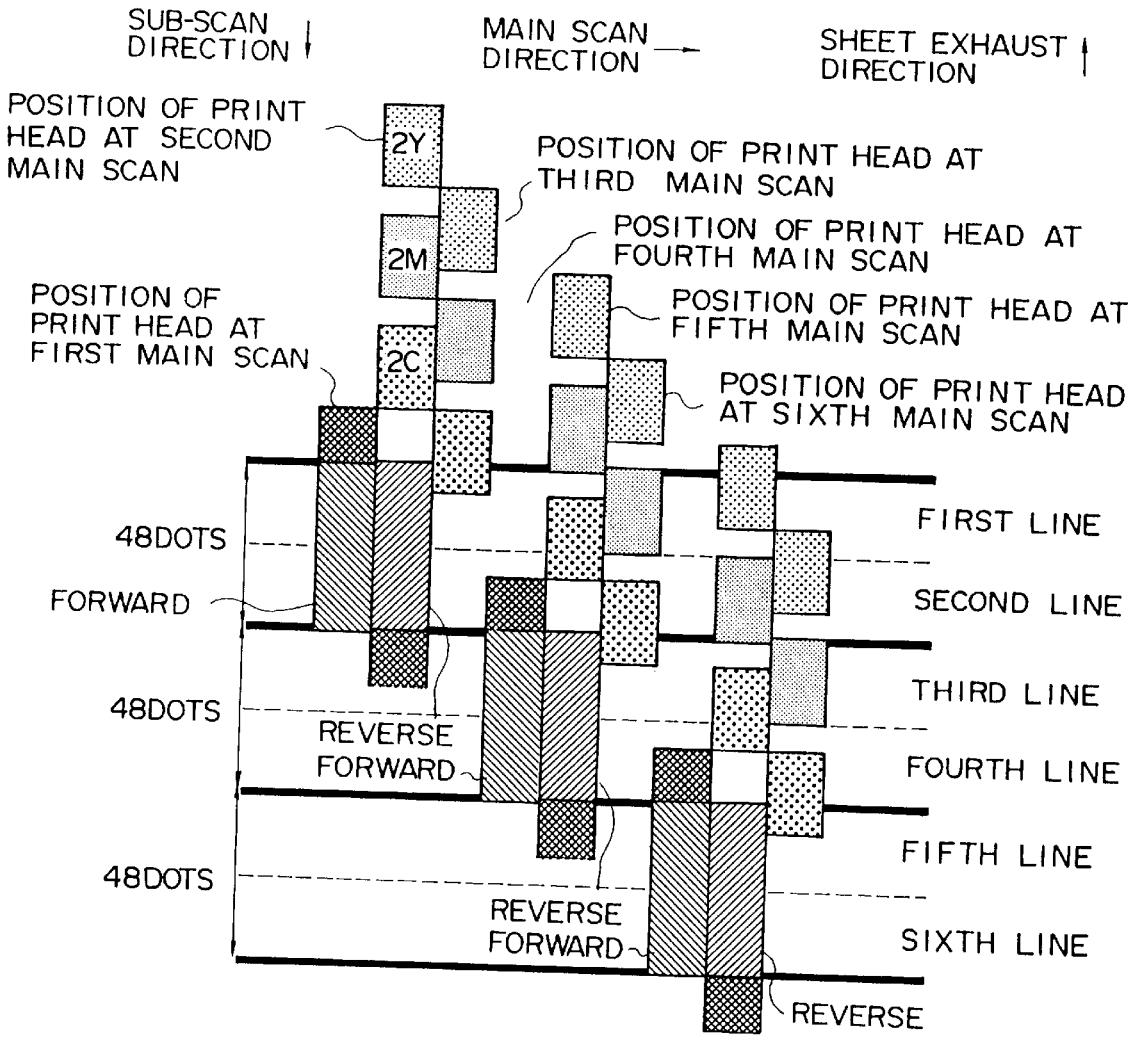
FIG. 30 is a view representing the overall can process of the print head as shown in the embodiment.

FIG. 30 is a view representing another scan process to reduce the color unevenness due to the use frequencies of black nozzles.

The operation to be performed when the color printing is required will be described with reference to FIG. 30.

When the color printing is required for the data transmitted from the host computer 514, the nozzle use number detecting unit 5051 transmits a detection signal to the pattern forming unit 5052. Then, the pattern forming unit 5052 sets a normal pattern and sends out the normal pattern data to the masking unit 5053. The masking unit 5053 draws out image data by the amount of forty eight dots in the sub-scan direction corresponding to the first and second lines and the amount of one dot in the main scan direction from the image buffer 5034, and takes a logical sum between the image data and the pattern. The resulted image data consisting of forty eight dots in the sub-scan direction and one dot in the main scan direction is sent out to the black print head driver of the head driver 506. Based on the image data, the printing for the first main scan of FIG. 30 is performed. The seventeenth to sixty fourth nozzles of the black print head are used to print in the normal pattern as shown in FIG. 26A. The first to sixteenth nozzles are not used at the first main scan.

Then, the recording sheet 16 is exhausted by the amount of a pitch of 16 dots, and the carriage 101 returns to the home position. While the carriage 101 returns, the following processing is performed.

The pattern forming unit 5052 sets a reverse pattern and sends out the reverse pattern data to the masking unit 5053. The masking unit 5053 draws out image data by the amount of forty eight dots in the sub-scan direction and the amount of one dot in the main scan direction from the image buffer 5034, like the normal pattern, and takes a logical sum between the image data and the pattern. The resulted image data consisting of forty eight dots in the sub-scan direction and one dot in the main scan direction is sent out to the black print head driver of the head driver 506. Based on the image data, the printing for the second main scan of FIG. 30 is performed. The first to forty eighth nozzles of the black print head are used to print in the reverse pattern as shown in FIG. 26A. At the second main scan, the forty ninth to sixty fourth nozzles are not used.

Then, the recording sheet 16 is exhausted by the amount of a pitch of 24 dots. The carriage 101 returns to the home position. While the carriage 101 returns, the following processing is performed. Under the control of the CPU 501, the image data by the amount of eight dots for the cyan print head is read from the image buffer 5031, and sent out to the print head driver for the cyan print head of the head driver 506. Based on the image data, the printing for the third main scan as shown in FIG. 30 is performed. The seventeenth to twenty fourth nozzles of the cyan print head are used.

Then, the recording sheet 16 is exhausted by the amount of a pitch of eight dots. The carriage 101 returns to the home position. While the carriage 101 returns, the same processing as at the first main scan is performed.

Subsequently, the scan process is repeatedly performed by alternately using the upper forty eight nozzles and the lower forty eight nozzles of the black print head.

In the above manner, the black print head alternately uses the upper forty eight nozzles and the lower forty eight nozzles among sixty four nozzles in total to drive twenty four nozzles among forty eight nozzles in accordance with a pattern formed by the pattern forming unit 5052 to perform the printing. The print heads of cyan, magenta and yellow perform the printing using all the twenty four nozzles.

With the above action, the total percentage of using the print head could be raised by increasing the number of used nozzles for the black print head at the color printing. With the effect, the temperature of the print head can be more equalized from the first to sixty fourth nozzle than when using only twenty four nozzles, and when a transfer from the color printing to the monochrome printing using all the black print head nozzles is made, image unevenness in the main scan direction can be improved, resulting in high quality recording. Further, the difference in degradation between nozzles caused by the bias in the use frequency of nozzle can be removed, resulting in reduced image unevenness produced by the change with the elapse of time.

Figure 31:
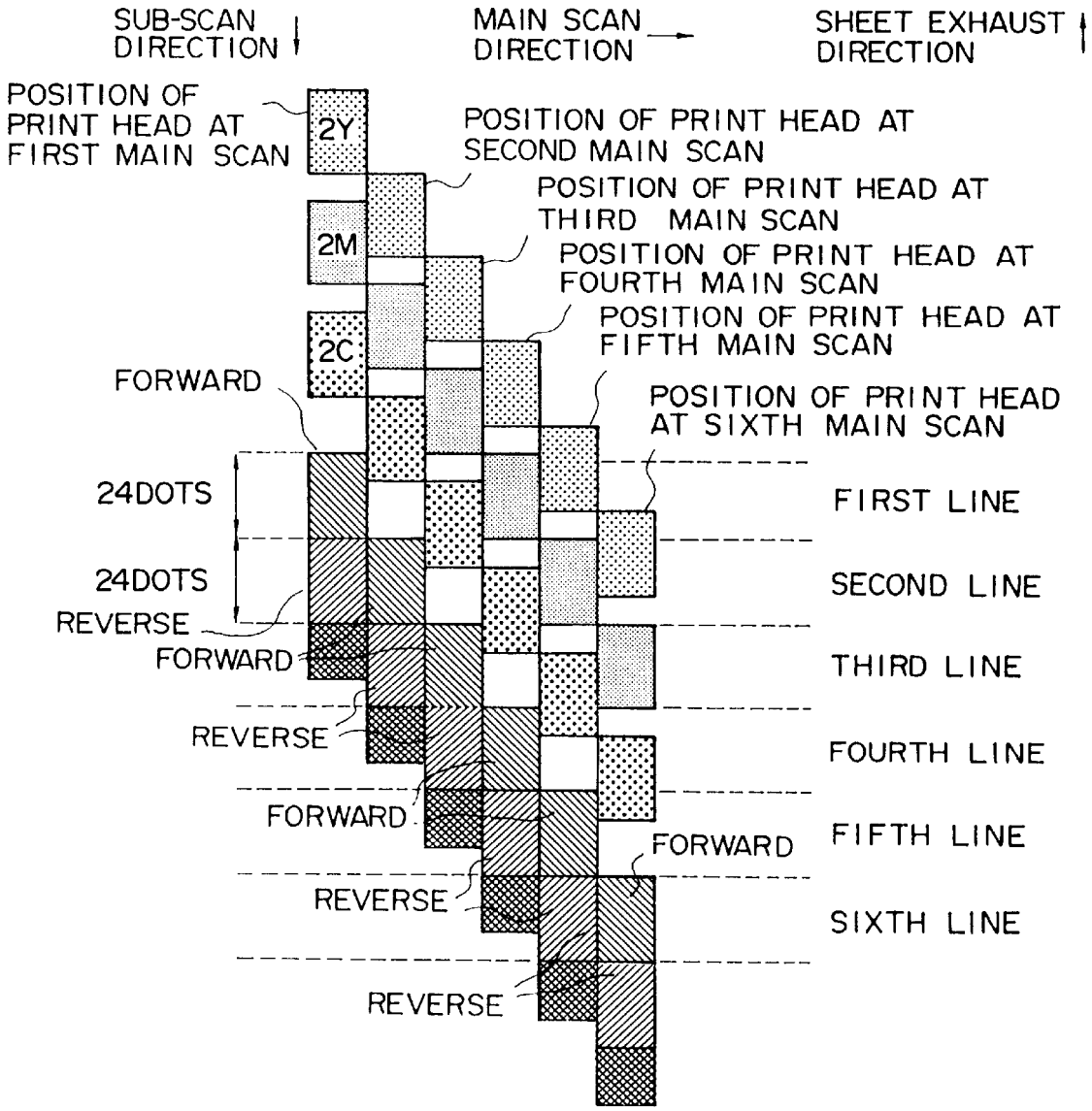
FIG. 31 is a view representing the overall scan process of the print head as shown in the embodiment.

FIG. 31 is a view representing another scan process to reduce the color unevenness due to the use frequencies of black nozzles.

The operation to be performed when the color printing is required will be described with reference to FIG. 31.

When the color printing is required for the data transmitted from the host computer 514, the nozzle use number detecting unit 5051 transmits a detection signal to the pattern forming unit 5052. Then, the pattern forming unit 5052 sends out the normal pattern data to the first to twenty fourth nozzles of the black nozzles 2Bk and the reverse pattern data to the twenty fifth to forty eighth nozzles of the black nozzles 2Bk in the masking unit 5053. The masking unit 5053 draws out image data by the amount of forty eight dots in the sub-scan direction and the amount of one dot in the main scan direction from the image buffer 5034, and takes a logical sum between the image data and the pattern. The resulted image data consisting of forty eight dots in the sub-scan direction and one dot in the main scan direction is sent out to the black print head driver of the head driver 506. Based on the image data, the printing for the first main scan of FIG. 30 is performed. The first to twenty fourth nozzles of the black nozzles 2Bk are used for the printing of the first line, and the twenty fifth to forty eighth nozzles for the printing of the second line. The first to twenty fourth nozzles of the black nozzles 2Bk print in the normal pattern as shown in FIG. 26A, and the twenty fifth to forty eighth nozzles print in the reverse pattern as shown in FIG. 26B. For the color printing in this embodiment, the forty ninth to sixty fourth nozzles are not used.

Then, the recording sheet 16 is exhausted by the amount of a pitch of 24 dots, and the carriage 101 returns to the home position. While the carriage 101 returns, the following processing is performed. Under the control of the CPU 501, the masking unit 5053 draws out image data of cyan for the second main scan by the amount of eight dots in the sub-scan direction and the amount of one dot in the main scan direction from the image buffer 5034, and sends out the image data to the cyan print head driver of the head driver 506. The cyan image data is continuous eight dots. The image data is printed in the first line using the seventeenth to twenty fourth nozzles of the cyan nozzles 2C. Further, the first to forty eighth nozzles of the black nozzles 2Bk are used for the printing of the second and third lines, like the first main scan.

Then, the recording sheet 16 is exhausted by the amount of a pitch of 24 dots, and the carriage 101 returns to the home position. While the carriage 101 returns, the same processing as at the second main scan is performed. The cyan image data is continuous twenty four dots. Based on the image data, the printing at the third main scan of FIG. 31 is performed. The first to sixteenth nozzles of the cyan nozzles 2C are used for the printing in the first line. At this time, the seventeenth to twenty fourth nozzles of the cyan nozzles 2C are performing the printing in the second line. Further, the first to forty eighth nozzles of the black nozzles 2Bk are used for the printing of the third and fourth lines, like the second main scan.

Then, the recording sheet 16 is exhausted by the amount of a pitch of 24 dots, and the carriage 101 returns to the home position. While the carriage 101 returns, the same processing as at the third main scan is performed. The magenta and cyan image data each consist of continuous twenty four dots. Based on the image data, the printing at the fourth main scan of FIG. 31 is performed. The first to twenty fourth nozzles of the magenta nozzles 2M are used for the printing in the first line. Concurrently, the first to sixteenth nozzles of the cyan nozzles 2C are performing the printing in the second line, and the seventeenth to twenty fourth nozzles of the cyan nozzles 2C in the third line. Further, the first to forty eighth nozzles of the black nozzles 2Bk are used for the printing in the fourth and fifth lines, like the third main scan.

Subsequently, the scan process is repeatedly performed in the same manner as above described, by using forty eight nozzles, at all times, among the sixty four nozzles in total of the black nozzles 2Bk to record the normal pattern by twenty four nozzles and the reverse pattern by twenty four nozzles. When the normal and reverse patterns are applied to the black nozzles 2Bk, it is possible to use the black nozzles 2Bk from the seventeenth nozzle, but not the first nozzle.

In the above manner, the black print head performs the printing by alternately driving twenty four nozzles in accordance with a pattern formed by the pattern forming unit 5052. The print heads of cyan, magenta and yellow perform the printing using all the twenty four nozzles.

With the above action, the black print head could be used without any bias in the number of using nozzles at the color printing. As a result, the temperature of the print head can be equalized, and when a transfer from the color printing to the monochrome printing using all the black print head nozzles is made, image unevenness in the main scan direction can be reduced, resulting in high quality recording. Further, the difference in degradation between nozzles caused by the bias in the use frequency of nozzle can be removed, resulting in reduced image unevenness produced by the change with the elapse of time.

(Embodiment 11)

The eleventh embodiment of the present invention will be described below.

A recording head to which the present invention is applicable is configured as shown in FIG. 1, in which a nozzle group 10*a*, 10*b*, 10*c*, 10*d* for each color to discharge the ink of yellow, magenta, cyan or black is arranged not to be overlapped, each nozzle being continuously disposed.

If using the recording head as shown in FIG. 1, the recording of multi-color image may be met with only one recording head, which is very suitable for inexpensive and small-sized apparatuses. The time taken for the printing is longer than when four recording heads are used, resulting in less blur of the ink and higher image quality.

FIGS. 32 and 33A to 33F show the printing method of printing various images by using this recording head.

Figure 32:
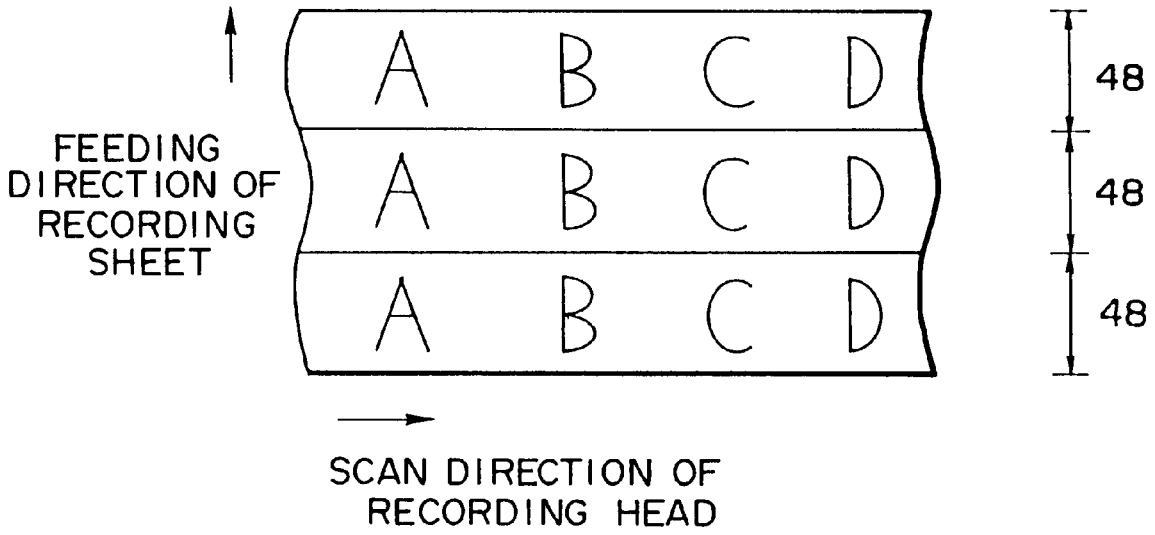
FIG. 32 is a view for explaining a process of printing only black image.

FIG. 32 shows an instance of printing only black image using the nozzle group 10*d* for the discharge of black ink, wherein all the nozzles (forty eight nozzles in this embodiment) for the nozzle group 10*d* are used, and the recording sheet is fed by the amount of forty eight nozzles to print the next line after the scan of the recording head is ended. This method is effective particularly when one page has only black image, as shown in FIG. 8A, or in printing the black image portion (area a and area c in FIG. 8B) when one page has a black image and a color image mixed, as shown in FIG. 8B but the black image and the color image are separated in a feed direction of recording sheet, and has the advantage that the recording speed is high. Note that when this type of recording head is used, the feed pitch of recording sheet in the color image portion (area b in FIG. 8B) is basically the number of nozzles for the discharge of color inks (here, twenty four nozzles).

FIGS. 33A to 33F show an instance of printing a color image using the color ink discharging nozzles 10*a*, 10*b*, 10*c* and the black ink discharging nozzle 10*d*, wherein twenty four nozzles are used for each color. In the same figure, the nozzles for discharging the black ink are those arranged on the side of the cyan ink discharging nozzle 10*c*. In the figure, Y is printed with yellow ink, M is printed with magenta ink, C is printed with cyan ink, and B is printed with black ink.

Figure 33A:
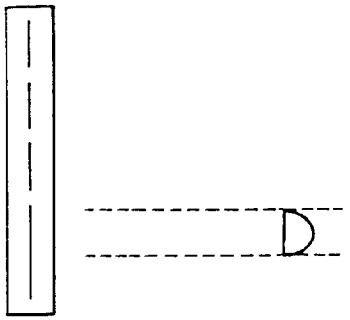
FIG. 33A to 33F are views for explaining a process of printing color image.
Figure 33B:
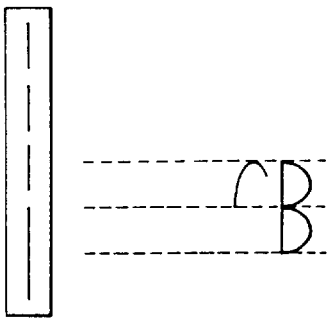
Figure 33C:
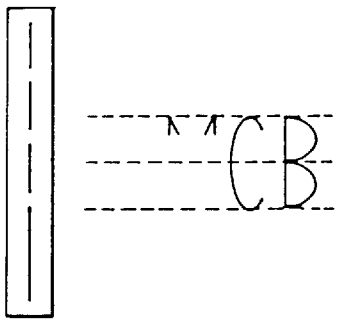
Figure 33D:
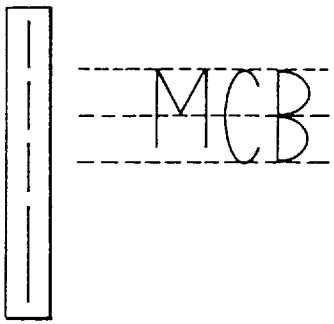
Figure 33E:
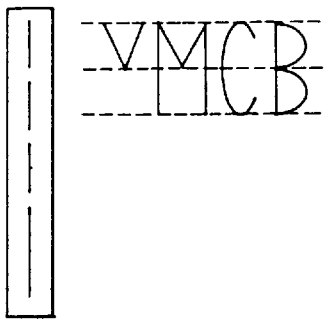
Figure 33F:
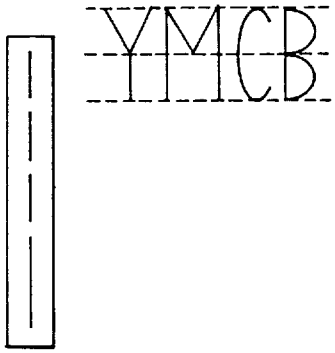
Figure 34A:
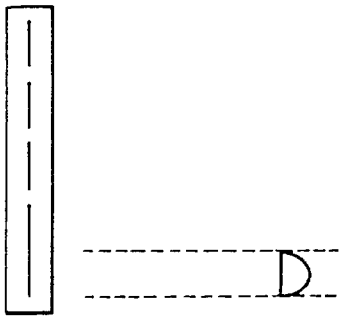
FIGS. 34A to 34G are views for explaining processes of printing color image in an embodiment 1.
Figure 34B:
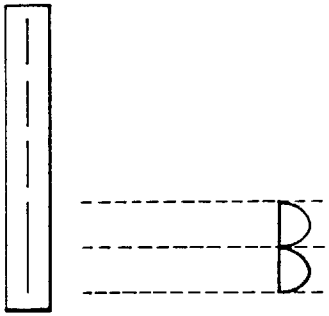
Figure 34C:
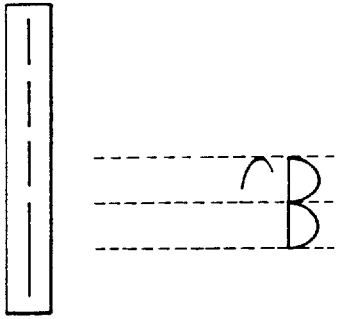
Figure 34D:
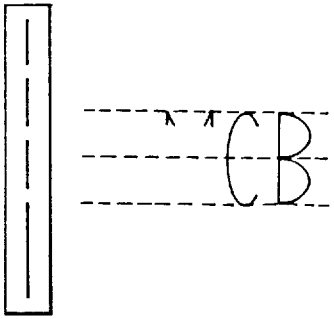
Figure 34E:
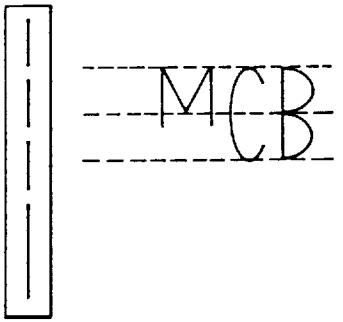
Figure 34F:
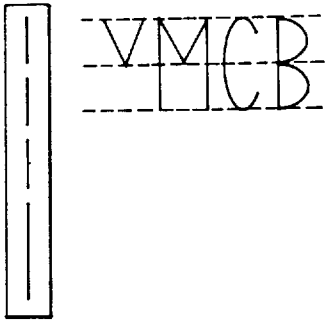
Figure 34G:
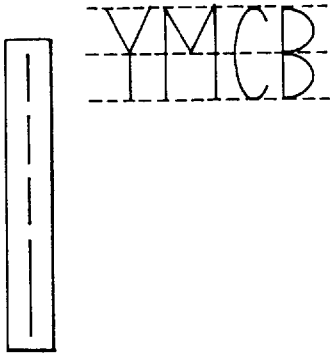

A process of forming a color image will be described using FIGS. 33A to 33E. FIG. 33A shows an instance of scanning the recording head 1 at a position as shown, where the upper part of a black character "B" corresponding to twenty four nozzles is printed. Subsequently, the recording sheet is fed by the amount of twenty four nozzles, and the remaining lower part of black character "B" and the upper part of a cyan character "C" are printed from a state of FIG. 33B. Further, the recording sheet is fed by the amount of twenty four nozzles, the lower part of cyan character "C" corresponding to twenty four nozzles, as well as the upper part of a magenta character "M" corresponding to twenty four nozzles, are printed as shown in FIG. 33C. The above operation is further performed as shown in FIGS. 33D and 33E until the printing of four colors is ended.

In this embodiment, the recording head configured as shown in FIG. 1 is used. As previously described, the nozzle group 10*a*, 10*b*, 10*c*, 10*d* for each color is arranged not to be overlapped, each of the nozzle group 10*a*, the nozzle group 10*b* and the nozzle group 10*c* having twenty four nozzles, and the nozzle group 10*d* having forty eight nozzles at a density of 360 dpi.

Further, the black nozzle 10*d* discharges a black ink of about 80 ng, and each of the nozzles 10*a*, 10*b*, 10*c* discharges a color ink of about 40 ng.

The basic process of printing the black image and the color image as shown in FIGS. 8A and 8B using this recording head is the same as described in FIGS. 32 and 33A to 33F, but in this embodiment, a processing of switching the nozzles for discharging the black ink to be used is performed for each page, so that the density difference may not arise due to the difference in the use frequency between each nozzle for discharging the black ink, as previously described.

That is, when printing the color image, the printing process of FIGS. 33A to 33F and the printing process of FIGS. 34A to 34G are switched for each page. In the process as shown in FIGS. 33A to 33F, twenty four nozzles closer to the cyan ink discharging nozzles 10*c* are used among the black ink discharging nozzles 10*d*, but in the process as shown in FIGS. 34A to 34G, twenty four nozzles farthest from the cyan ink discharging nozzles 10*c* are used. As a result, in the process as shown in FIGS. 33A to 33F and 34A to 34G, the black ink discharging nozzles for use are switched completely for each page.

The number of scans in the process as shown in FIGS. 34A to 34G is once more than that in the process as shown in FIGS. 33A to 33F, because the black ink discharging nozzles for use are far away from the cyan ink discharging nozzles amounting to twenty four nozzles, but the time taken to record one page is substantially negligible.

As described above in the embodiment, the black ink discharging nozzles for use are switched between pages, so that even though only the color image is continuously printed by a plurality of sheets, all the black ink discharging nozzles are used evenly, and the density difference will not occur due to the difference in the use frequency.

(Embodiment 12)

In this embodiment, a method of printing the high quality black image by switching the nozzles for use among the black ink discharging nozzles, as in the embodiment 11, will be described.

The outline of a recording head for use in this embodiment is the same as shown in FIG. 5, wherein 1 is a recording head, 10 is a nozzle, 10*a* is a nozzle for discharging the yellow ink, 10*b* is a nozzle for discharging the magenta ink, 10*c* is a nozzle for discharging the cyan ink, and 10*d* is a nozzle for discharging the black ink. The nozzle group for each color is arranged not to be overlapped, and a space 10*e*, 10*f*, 10*g* by the amount of eight nozzles is provided between adjacent nozzle groups for color to easily form a liquid chamber for supplying the ink to the nozzles of each color. Each of the nozzle group 10*a*, the nozzle group 10*b* and the nozzle group 10*c* has twenty four nozzles arranged, and the nozzle group 10*d* has sixty four nozzles arranged at a density of 360 dpi.

Further, the black nozzle 10*d* discharges a black ink of about 80 ng, and each of the nozzles 10*a*, 10*b*, 10*c* discharges a color ink of about 40 ng, as in the embodiment 11.

Next, the printing method of printing various images by using this recording head will be described.

When only the black image is printed using the black ink discharging nozzle group 10*d*, sixty four nozzles in the nozzle group 10*d* are all used, like the previous method described with reference to FIG. 2, and if the scan of the recording head is ended, the recording sheet is fed by the amount of sixty four nozzles to print the next line.

FIGS. 35A to 35G show an instance of printing the color image using the color ink discharging nozzle groups 10*a*, 10*b*, 10*c* and the black ink discharging nozzle group 10*d*, with twenty four nozzles provided for each color. In the figure, Y is printed with yellow ink, M is printed with magenta ink, C is printed with cyan ink, and B is printed with black ink.

A process of forming a color image will be described using FIGS. 35A to 35E. Note that in the process of forming the color image of the same figure, the nozzles for discharging the black ink are forty eight nozzles located closer to the cyan ink discharging nozzle group 10*c*.

Further, the black image is not formed by one time of scan by the recording head, but by dividing the black image into two images and forming the divided images by two scans. In this embodiment, the black image can be formed in such a manner as to divide the black image into complementary checked patterns, as shown in FIGS. 26A and 26B and described previously, and print black images corresponding to respective patterns by separate scans. The normal pattern and reverse pattern as shown in FIGS. 26A and 26B are printed one on the other to complement each other, so that all dots are printed as shown in FIG. 26C. In an image without adjacent dots printed concurrently and having a higher print ratio of black, there is the problem of the ink overflow across such adjacent dots, whereby a high quality image can be printed with favorable fixing ability.

Figure 35A:
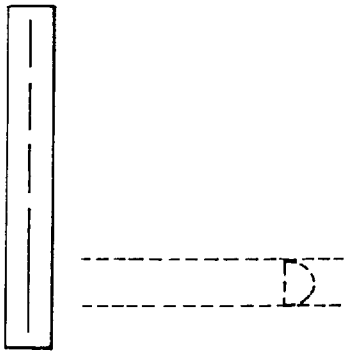
FIGS. 35A to 35G are views for explaining a process of printing color image in an embodiment 2.

FIG. 35A shows an instance of scanning the recording head 1 at a position as shown, where the upper part of a black character "B" corresponding to twenty four nozzles is printed. Then, the upper part of the black character "B" is printed only for the black image corresponding to a pattern of FIG. 26A.

Figure 35B:
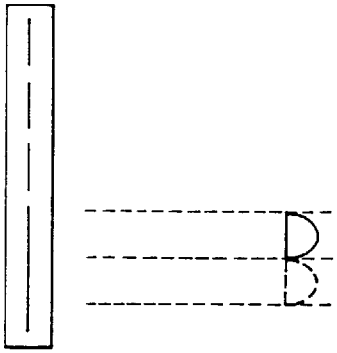

Subsequently, the recording sheet is fed by the amount of twenty four nozzles, and the upper part and the lower part of black character "B" are printed as shown in FIG. 35B. At this time, the black image corresponding to the pattern as shown in FIG. 26B is printed. As a result, the image formation for the upper part of black character "B" is completed.

Figure 35C:
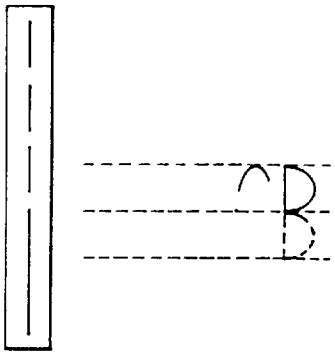

Then, the recording sheet is fed by the amount of twenty four nozzles, and the lower part of black character "B" and a part of cyan character "C" are printed as shown in FIG. 35C. The lower part of black character "B" is printed with the black image corresponding to the pattern as shown in FIG. 26A. At this step, the image formation for the black character "B" is completed.

Figure 35D:
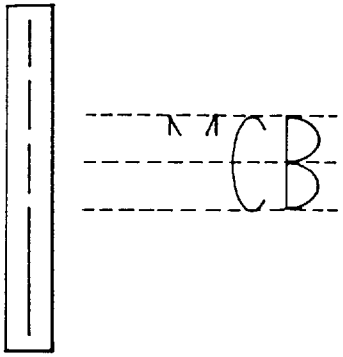
Figure 35E:
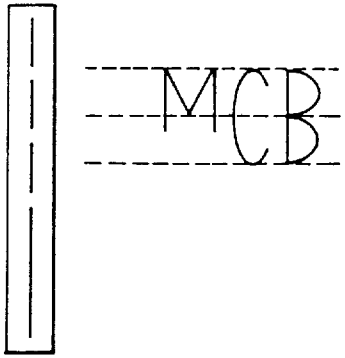
Figure 35F:
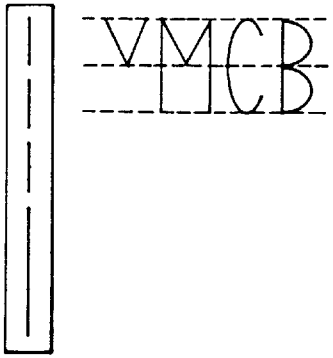
Figure 35G:
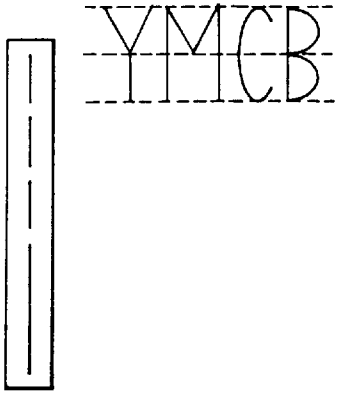

Then, the recording sheet is fed by the amount of twenty four nozzles, and a part of cyan character "C" and a part of magenta character "M" are printed as shown in FIG. 35D. Then, the recording sheet is fed by the amount of twenty four nozzles, and the remaining part of cyan character "C" and a part of magenta character "M" are printed as shown in FIG. 35E. Subsequently, in the same manner, the remaining part of magenta character "M" and a yellow character "Y" are printed as shown in FIG. 35F and FIG. 35G, and the printing with four colors is completed.

FIGS. 36A to 36H show a color image forming process in which the black ink discharging nozzles used for forming the black image are forty eight nozzles farthest from the cyan ink discharging nozzles. Like the embodiment 11, the number of scans is one more than the instance of FIGS. 35A to 35G.

In this embodiment, the image forming process as shown in FIGS. 35A to 35G and 36A to 36H is switched for each page. As a result, the density difference can be prevented from arising due to the difference in the use frequency between black ink discharging nozzles. Further, in this embodiment, only the black image is divided into two patterns, each of which is printed by a separate scan, resulting in less density unevenness and higher quality black image.

(Embodiment 13)

In this embodiment, a method will be described in which the same recording head as in the embodiment 12 is used, all the black ink discharging nozzles are used evenly without switching for each page, and the density difference can be prevented from arising due to the difference in the use frequency.

Figure 37:
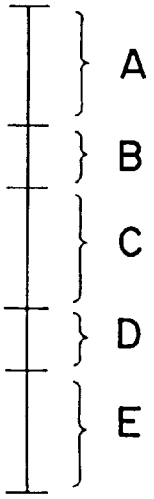
FIG. 37 is a view for explaining how to divide black ink discharge nozzles in an embodiment 3.

FIG. 37 shows the black ink discharging nozzle 10*d*. When it is assumed that the nozzle located closest to the cyan ink discharging nozzle is the first nozzle, and the nozzle located farthest therefrom is the sixty fourth nozzle, a nozzle part A is comprised of the first to sixteenth nozzles, a nozzle part B is comprised of the seventeenth to twenty fourth nozzles, a nozzle part C is comprised of the twenty fifth to fortieth nozzles, a nozzle part D is comprised of the forty first to forty eighth nozzles, and a nozzle part E is comprised of the forty ninth to sixty fourth nozzles, wherein the forming process for black image is different between the nozzle parts A, C, E and the nozzle parts B, D.

Figure 38A:
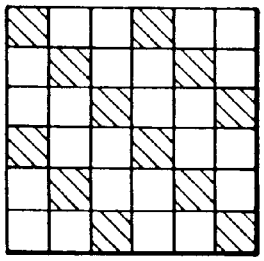
FIGS. 38A to 38C are views for explaining the patterns of dividing the black image in the embodiment 3.
Figure 38B:
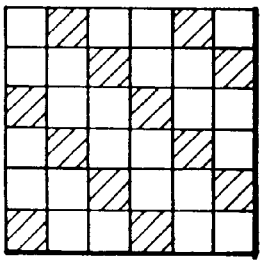
Figure 38C:
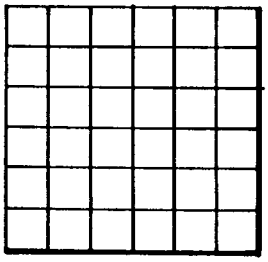

That is, in the nozzle parts A, C, E, the black image is divided into three sections, corresponding to patterns as shown in FIGS. 38A to 38C, and divided black image sections are printed by three scans of the recording head. On the other hand, in the nozzle parts B, D, like the embodiment 2, the black image is divided into two sections, as shown in FIG. 24, and divided black image sections are printed by two scans of the recording head. A process of forming the image with the above-described method will be described with reference to FIGS. 39A to 39H.

Figure 39A:
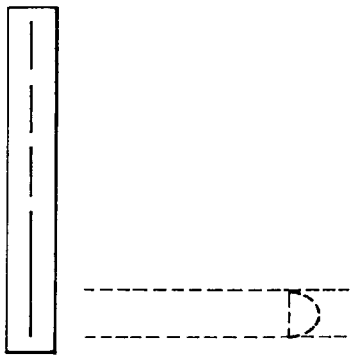
FIGS. 39A to 39H are views for explaining a process of printing color image in the embodiment 3.
Figure 40:
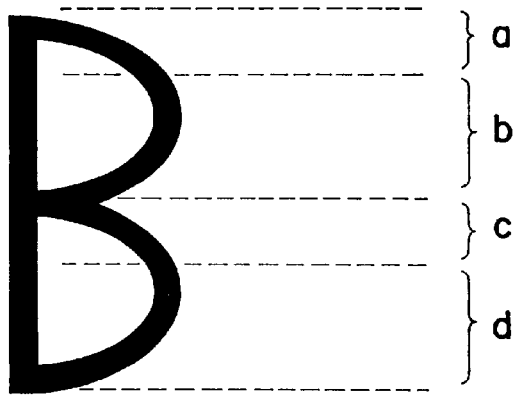
FIG. 40 is a view for explaining how to divide the black image in the embodiment 3.

First, as shown in FIG. 39A, the upper part of a black character "B" is printed. At this time, the black image corresponding to a pattern of FIG. 26A among the area a of the character "B" as shown in FIG. 40 is printed by the nozzle part D of the black ink discharging nozzle 10*d*, and the black image corresponding to a pattern of FIG. 38A among the area b of character "B" as shown in FIG. 40 is printed by the nozzle part E.

Figure 39B:
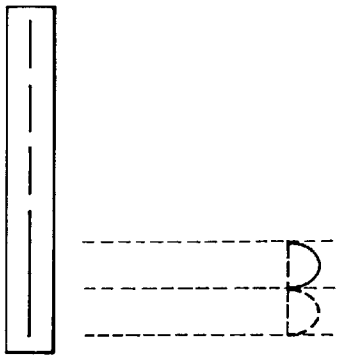

Then, the recording sheet is fed by the amount of twenty four nozzles, and the printing is performed as shown in FIG. 39B. That is, the black image corresponding to a pattern of FIG. 26B among the area a as shown in FIG. 40 is printed by the nozzle part B, and the black image corresponding to a pattern of FIG. 38B among the area b as shown in FIG. 40 is printed by the nozzle part C. Further, the black image corresponding to a pattern of FIG. 26B among the area c as shown in FIG. 40 is printed by the nozzle part D, and the black image corresponding to a pattern of FIG. 38B among the area d as shown in FIG. 40 is newly printed by the nozzle part E. At this step, the formation of black image for the area a as shown in FIG. 40 is completed.

Figure 39C:
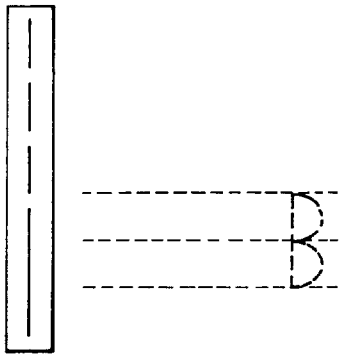

Then, the recording sheet is fed by the amount of twenty four nozzles, and the printing as shown in FIG. 39C is performed. That is, the black image corresponding to a pattern of FIG. 38C among the area b as shown in FIG. 40 is printed by the nozzle part A, the black image corresponding to a pattern of FIG. 26A among the area c as shown in FIG. 40 is printed by the nozzle part B, and the black image corresponding to a pattern of FIG. 38C among the area d as shown in FIG. 40 is printed by the nozzle part C. At this step, the formation of black image for the areas b and c as shown in FIG. 40 is completed.

Figure 39D:
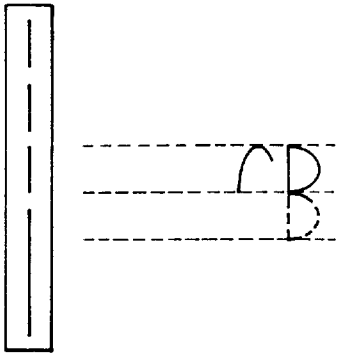
Figure 39E:
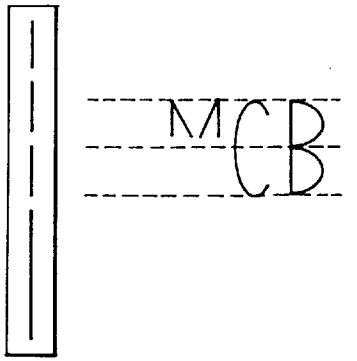
Figure 39F:
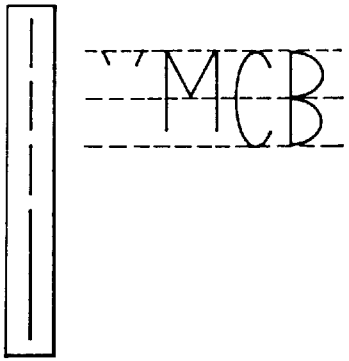
Figure 39G:
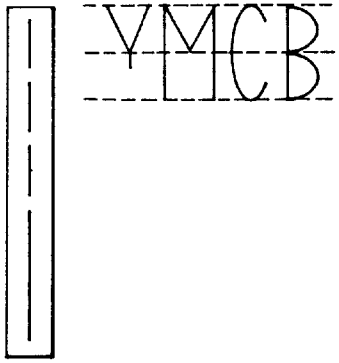
Figure 39H:
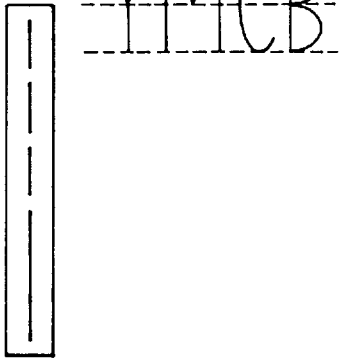

Subsequently, the recording sheet is fed by the amount of twenty four nozzles. The image formation of black character "B" as shown in FIG. 39D is ended, and the image formation of color character is started. That is, the black image corresponding to a pattern of FIG. 38A among the area d as shown in FIG. 40 is printed by the nozzle part D, and a part of cyan character "C" is printed by the cyan ink discharging nozzle 10*c*.

Further, the recording sheet is fed by the amount of twenty four nozzles, and then a color character as shown in FIGS. 39E to 39H is printed. The image formation of color character is basically the same process as in the embodiment 2, and the explanation thereof is omitted.

As described above, all the nozzles can be used substantially evenly without switching the black ink discharging nozzles used for each page in this embodiment, and the density difference can be prevented from arising due to the difference in the use frequency. Also, like the embodiment 12, the black image is divided into plural sections, which are printed by a plurality of scans, resulting in higher quality image.

While in the embodiment 12, the black ink discharging nozzles for use are switched between the first to forty eighth nozzles and the seventeenth to sixty fourth nozzles for each page, in each of which the black image is divided into two image sections, which are printed by two scans, it will be appreciated that the black ink discharging nozzles for use may be divided into three sections of the first to twenty fourth nozzles, the twenty fifth to forty eighth nozzles, and the forty first to sixty fourth nozzles, which are switched for each page. In this case, the black image is not necessary to be divided particularly, but may be printed by one scan.

Also, while in the embodiment 12 and embodiment 13, the black image is divided into a plurality of groups, each black image of which is printed by a separate scan of the recording head, it will be appreciated that the dividing method into plural groups is not limited to the patterns as shown in FIGS. 26A to 26C and 38A to 38C, but may be accomplished in arbitrary patterns. Further, this pattern is not necessary to be fixed patterns, but may be completely random patterns.

Figure 41A:
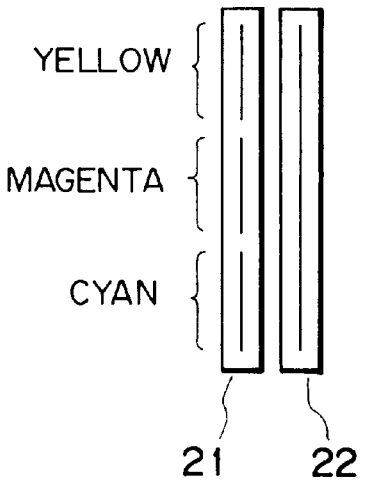
FIGS. 41A and 41B are views showing another example of color recording head.
Figure 41B:
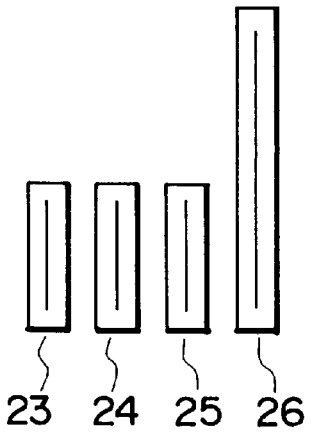

Also, while in the embodiments 11 to 13, a recording head with the nozzle groups for discharging the inks of a plurality of colors are constituted integrally, it will be appreciated that the recording head 21 for the discharge of color inks and the recording head 22 for the discharge of black ink may be separately constituted, as shown in FIG. 41A, or the recording heads 23, 24, 25 for discharging the color inks and the recording head 26 for the discharge of black ink may be separately constituted, as shown in FIG. 41B, in which the present invention is applicable to either case.

As described above, with the present invention, the temperature within the print head can be equalized, and when a transfer from the color printing to the monochrome printing using the whole of black print head nozzles is made, image unevenness in the main scan direction is eliminated, resulting in higher quality of recording. Further, the difference in the degradation between nozzles can be prevented from arising due to the bias in the use frequency between nozzles, resulting in the reduced image unevenness caused by the change with the elapse of time. Moreover, the black printing is performed in cross pattern prior to the printing of cyan, magenta and yellow, so that the black ink dries earlier with no degradation of image caused by wetting of ink.

Also, as described above, with the present invention, the nozzles for use are switched for each page, so that the black ink discharging nozzles may not be the same at all times in printing the color image, or more nozzles are provided and uniformly used in printing, whereby the difference in the use frequency between black ink discharging nozzles is less likely to occur, resulting in a higher image quality with less density unevenness.

(Embodiment 14)

A color ink jet recording apparatus to which the present invention is applicable is the same as shown in FIG. 9, and the detailed explanation has been described before and thus is omitted.

An ink cartridge is comprised of a color ink cartridge 110 accommodating three colors of yellow, magenta and cyan, and a black ink cartridge 111 accommodating only the black ink, each of which is separately inserted into a cartridge guide 103. On the front face of the recording head 102, the nozzle groups for yellow, magenta, cyan and black are linearly arranged, the number of nozzles in each nozzle group being N for yellow, magenta and cyan, and M for black, which is greater than that for yellow, magenta and cyan. And the space between adjacent nozzle groups is equal to or greater than a nozzle pitch (see FIG. 10). Note that in the following embodiment, the number of nozzles for yellow, magenta and cyan is twenty four, and the number of nozzles for black is 64.

The details of recording head unit are the same as shown in FIG. 10.

The nozzles which form the ink discharge orifices of recording head 102 are connected with ink liquid channels for supplying the ink from the cartridge to the nozzles, the ink cartridge for supplying the ink is disposed rearward of those ink liquid channels disposed. The ink liquid channels corresponding to the nozzles are provided with electricity-heat converters for generating the heat energy which ink droplets are discharged through the nozzles, and electric wirings for supplying the electric power to the electricity-heat converters. If the ink is supplied into the ink liquid channels, the electricity is supplied to the electricity-heat converters, in accordance with an image data, for generating the heat within the ink liquid channels. When the ink expands, ink droplets are discharged via each nozzle onto the recording sheet 106 such as paper or cloth, whereby an image in accordance with the image data the recorded on the recording sheet which is recording medium.

Figure 42:
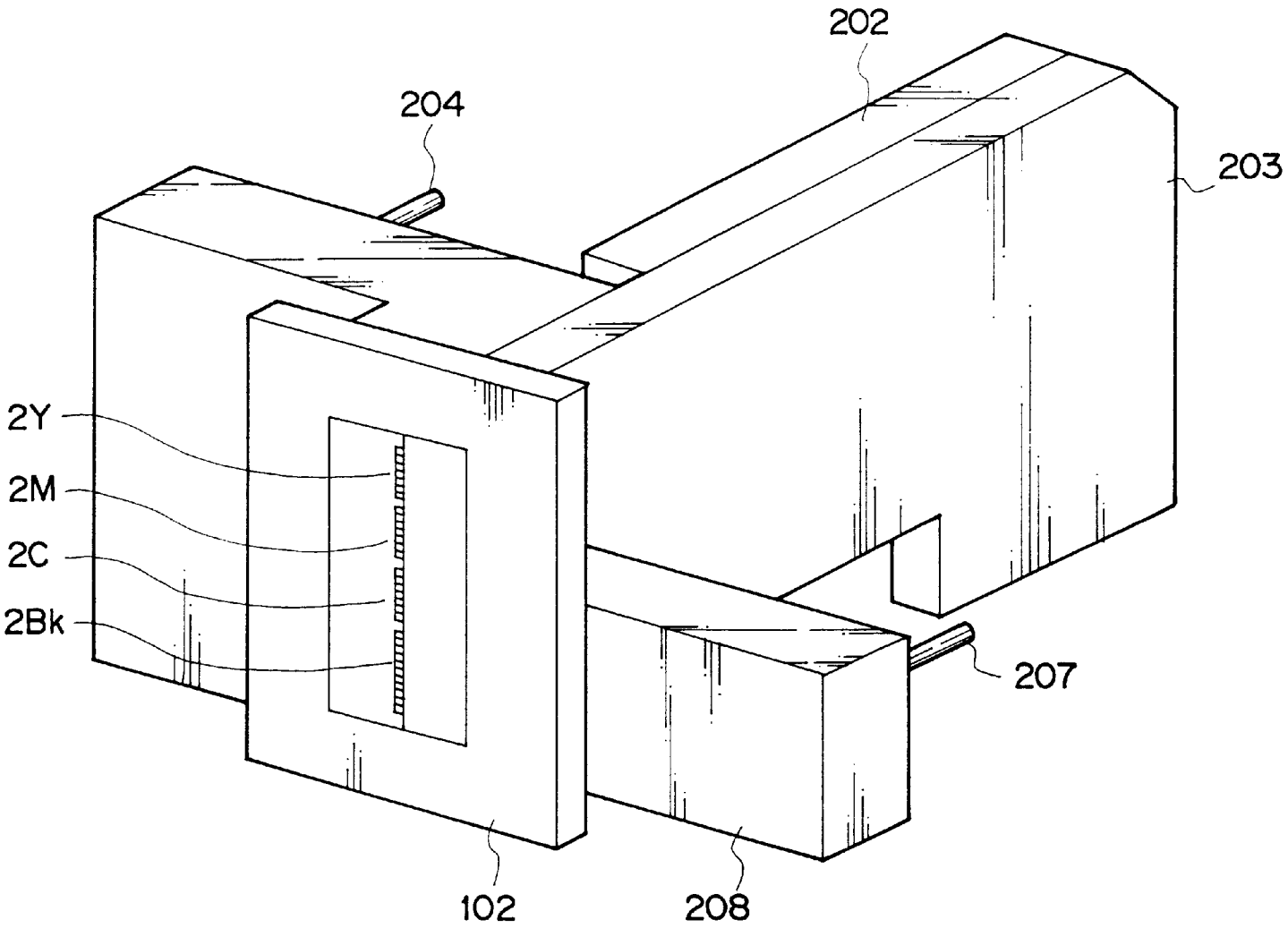
FIG. 42 is an enlarged view of a recording head unit according to an embodiment of the present invention on the front side.

Herein, 204 is a pipe for yellow, 205 is a pipe for magenta, 206 is a pipe for cyan, and 207 is pipe for black. There are four flow passages for a distributor 208 corresponding to yellow, magenta, cyan and black, each of which connects a common liquid chamber to each pipe as above described. In FIG. 10 and FIG. 42, 2Y is a yellow ink jet head having twenty four nozzles, 2M is a magenta ink jet head having twenty four nozzles, 2C is a cyan ink jet head having twenty four nozzles, and 2Bk is a black ink jet head having sixty four nozzles.

Figure 43:
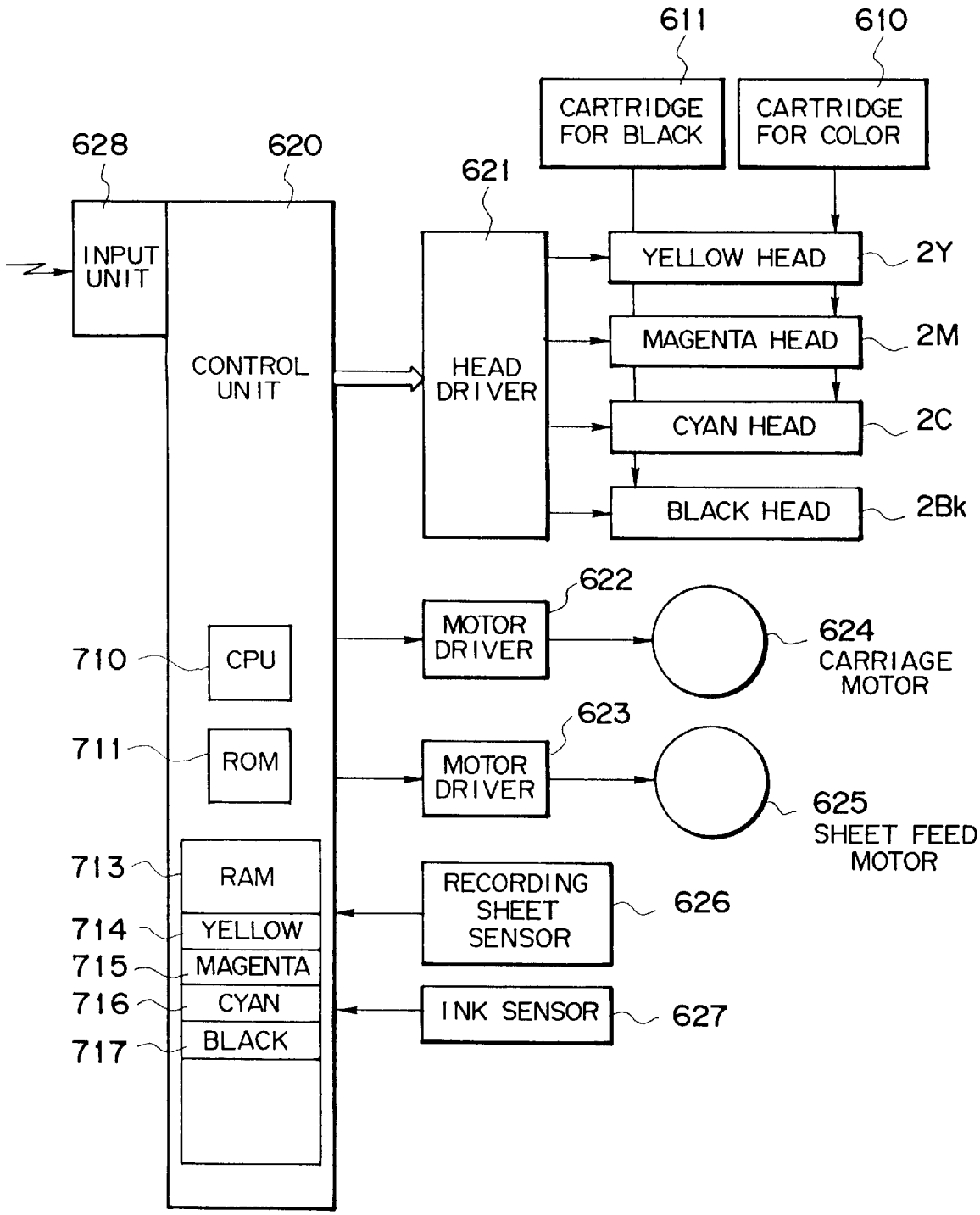
FIG. 43 is a block diagram showing the schematic configuration of an ink jet printer according to one embodiment of the present invention.

FIG. 43 is a block diagram showing the schematic configuration of an ink jet printer in this embodiment, the common parts to those of previous drawings are given the same numbers, and their explanation is omitted.

In FIG. 43, 620 is a control unit, comprising a CPU 710, such as for example a microprocessor, a ROM 711 for storing the control programs for the CPU and various data, and a RAM 713 for use as the work area of the CPU 710. 621 is a head driver for driving the recording head corresponding to each color in accordance with record data by inputting the record data from the control unit 620. 624 is a carriage motor for conveying and driving the carriage 101. 625 is a sheet feed motor for feeding the recording sheet 106 by driving a sheet supply roller 107 or a sheet feed roller 108 in rotation. Each of 622, 623 is a motor driver for driving a corresponding motor in accordance with an instruction of the control unit 620. 626 is a recording sheet sensor for sensing the presence of recording sheet 106, and 627 is an ink sensor for sensing the presence of an ink cartridge mounted and the ink remaining amount.

628 is an input unit for receiving the recording data input from an external equipment such as a host computer, in which it informs the control unit 620 that the recording data has been received. Then, the control unit 620 stores the recording data in one of the buffers 714 to 717 of the RAM 713 in accordance with the color. That is, the recording yellow data as input is stored in a yellow buffer 714, magenta data in a magenta buffer 715, cyan data in a cyan buffer 716, and black data in a black buffer 717. Herein, if the received data from the host computer contains the data of at least two colors of yellow, magenta, cyan and black, the color mode is determined, while if only the black data is input, the monochrome mode is determined. Thus, the recording data stored in the buffer corresponding to each color is read synchronously with the scan in the main scan direction by the carriage 1, and sent out to the head driver 21, which distributes and outputs each color data to each of yellow head 2Y, cyan head 2M, magenta head 2C and black head 2Bk.

Figure 44:
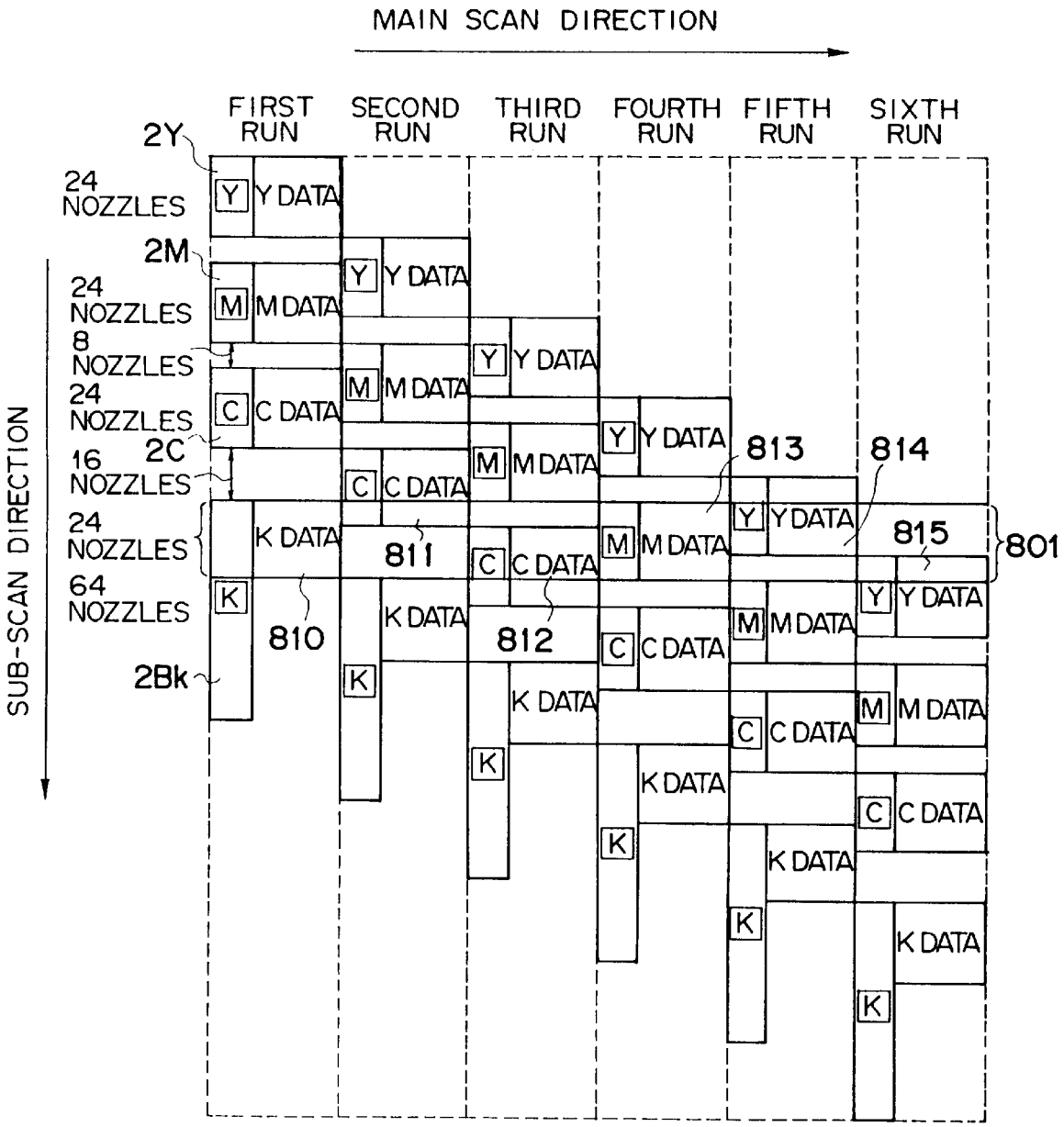
FIG. 44 is a typical view showing the operation of recording color image in units of 24 nozzles in the embodiment of the present invention.
Figure 45:
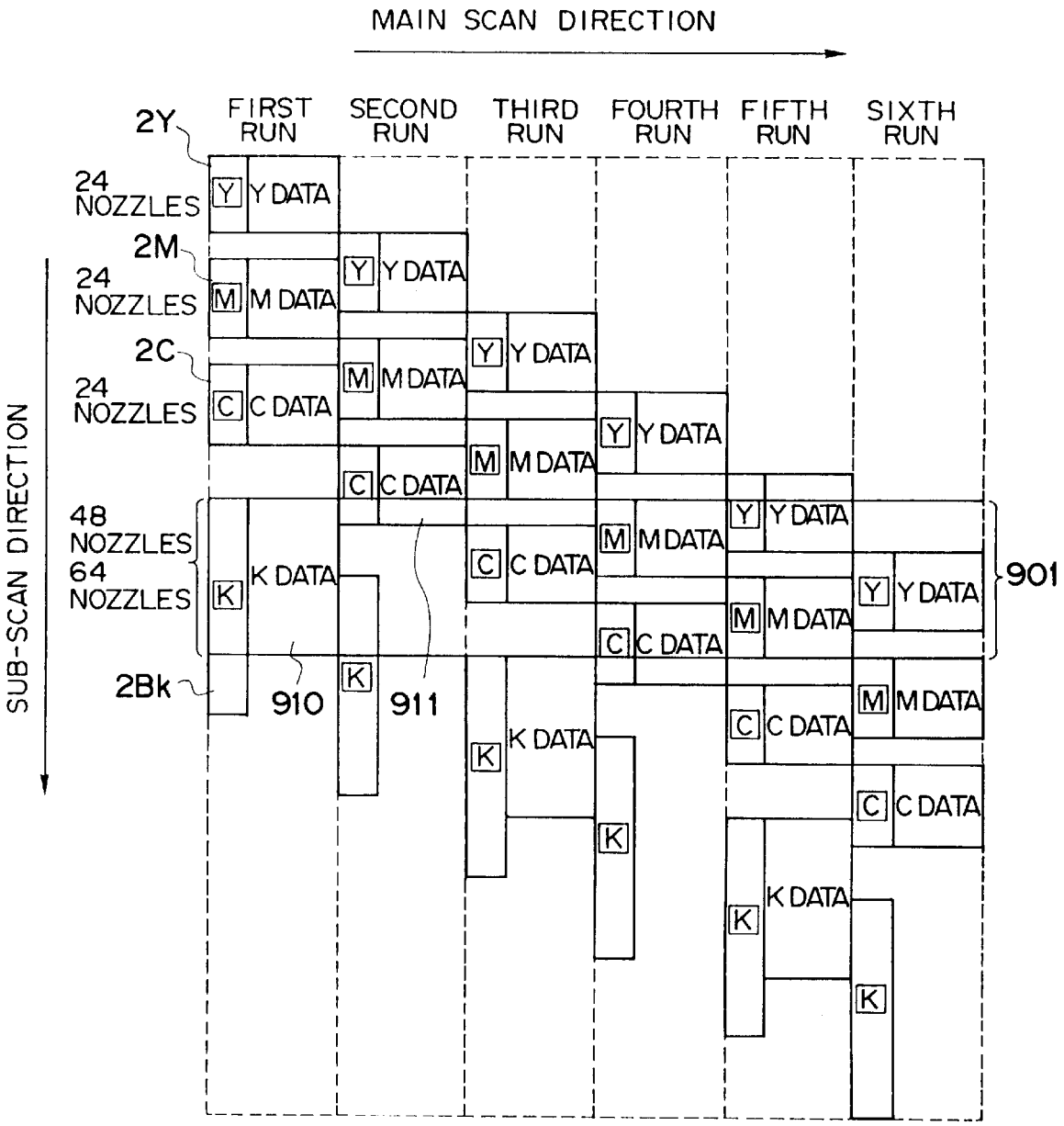
FIG. 45 is a typical view showing the operation of recording color image in units of 48 nozzles in the embodiment.

The recording operation in the ink jet printer of this embodiment has two recording modes as shown in FIGS. 44 and 45.

FIG. 44 is a typical view showing the state of recording the color image data in a width of twenty four nozzles (dots) with the ink jet printer of the first embodiment, in which the first to twenty fourth nozzles are used among sixty four nozzles of black head 33 to perform the recording.

In FIG. 44, the data portion corresponding to each head is shown, which indicates that there is the data to be recorded using each head. For the yellow head 2Y to cyan head 2C, all the nozzles (twenty four nozzles) are used to perform the recording synchronously with the scan of the carriage 1 in the main scan direction. For each reciprocation of the carriage 1 in the main scan direction, the recording sheet 6 is conveyed by the amount of twenty four nozzles in the sub-scan direction. Also, the space between the yellow head 2Y and the magenta head 2M and between the magenta head 2M and the cyan head 2C is equal to the amount of 8 nozzles, and the space between the cyan head 2C and the black head 2Bk is equal to the amount of sixteen nozzles.

A processing of recording on the area as indicated by 801 will be described below, based on the color image data. Note that the number of times as given in the main scan direction indicates the number of scans for the carriage 1, in which the recording sheet 106 is conveyed in the sub-scan direction by the amount of twenty four nozzles, every time the carriage 101 is reciprocated.

First, at the first scan of the carriage 101, the black data portion is recorded using twenty four nozzles from the first to twenty fourth nozzles of the black head 2Bk, as indicated by 810. Next, after the recording sheet is conveyed in the sub-scan direction by the amount of twenty four dots, the recording is performed by the second scan of the carriage 101, using the seventeenth to twenty fourth nozzles of the cyan head 2C to discharge the ink. Then, after the recording sheet is conveyed by the amount of twenty four nozzles, the cyan data is recorded by the third scan using the first to sixteenth nozzles of the cyan head 2C, as indicated by 812.

Subsequently, magenta data is likewise recorded by the fourth scan of the carriage 101 using all the nozzles of the magenta head 2M, yellow data is recorded by the fifth scan using the ninth to twenty fourth nozzles of the yellow head 2Y, and finally, the remainder of the yellow data is recorded by the sixth scan using the first to eighth nozzles of the yellow head 2Y.

In this manner, by reciprocating the carriage 1 in the main scan direction by six times, the color image can be recorded in the area 801 of the recording sheet 106 amounting to twenty four nozzles (dots), using the predetermined nozzles (first to twenty fourth nozzles) of the black head 2Bk and all the nozzles of the color recording head 2Y, 2M, 2C.

FIG. 45 is a typical view showing a sequence for recording the color image data having a width of forty eight nozzles (dots) in the area 901 of the recording sheet in the same ink jet printer of the first embodiment.

In FIG. 45, the recording is performed, using the first nozzle to twenty fourth nozzles (all nozzles) of each head 2Y, 2M, 2C of yellow, magenta and cyan, and the first to forty eighth nozzles of the black head 2Bk, while the recording sheet is conveyed in the sub-scan direction by the width of twenty four nozzles, every time the carriage 101 is reciprocated in the main scan direction.

First, at the first scan of the carriage 101, the black data portion is recorded using the first to forty eighth nozzles of the black head 2Bk, at the first scan of the carriage 101 (810). Next, at the second scan of the carriage 101, the cyan data is recorded using the seventeenth to twenty fourth nozzles of the cyan head 2C, and at the third scan, the cyan data is recorded using all the nozzles of cyan head 2C. Then, at the fourth scan, magenta data is recorded using all the nozzles of the magenta head 2M, and cyan data is recorded using the first to sixteenth nozzles of the cyan head 2C. And at the fifth scan, the yellow data is recorded using the ninth to twenty fourth nozzles of the yellow head 2Y, and the magenta data is recorded using all the nozzles of the magenta head 2M. At the sixth scan, the yellow data is recorded using all the nozzles of the yellow head 2Y, and at the final seventh scan (not shown), the yellow data is recorded using the first to eighth nozzles of the yellow head 2Y.

Of these scans of the carriage 101, at the first, third and fifth scan, the black portion of image data in a unit of forty eight dots is recorded using the first to forty eighth nozzles of the black head.

As described above, the color image can be recorded using all the nozzles of the head 2Y, 2M, 2C for each color and the specific nozzles (first to forty eighth nozzles) of the black head 2Bk, while the carriage 101 is reciprocated by multiple times.

Figure 46:
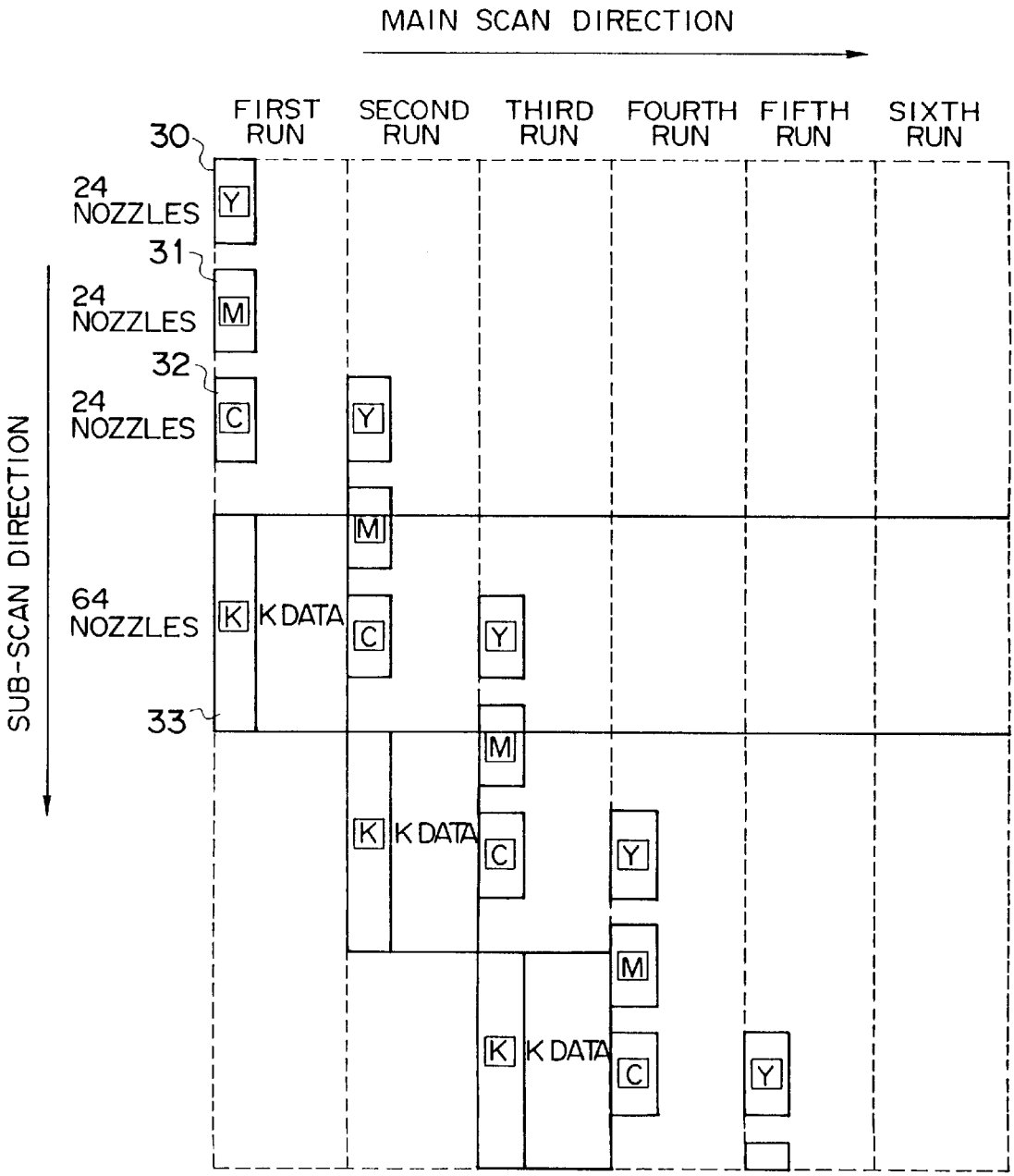
FIG. 46 is a typical view showing the operation of recording monochrome image in units of 64 nozzles in the embodiment.

FIG. 46 is a typical view showing a processing of recording a monochrome image in units of sixty four nozzles (dots) wide, using all the nozzles of the black nozzle 2Bk.

As will be clear from FIG. 46, the recording is performed by conveying the recording sheet 106 in the sub-scan direction by the amount corresponding to a width of nozzles for the black head 2Bk, every time the carriage 101 is reciprocated for the scan. This makes it possible to utilize all the nozzles of the black head 2Bk at equal rate.

Figure 47:
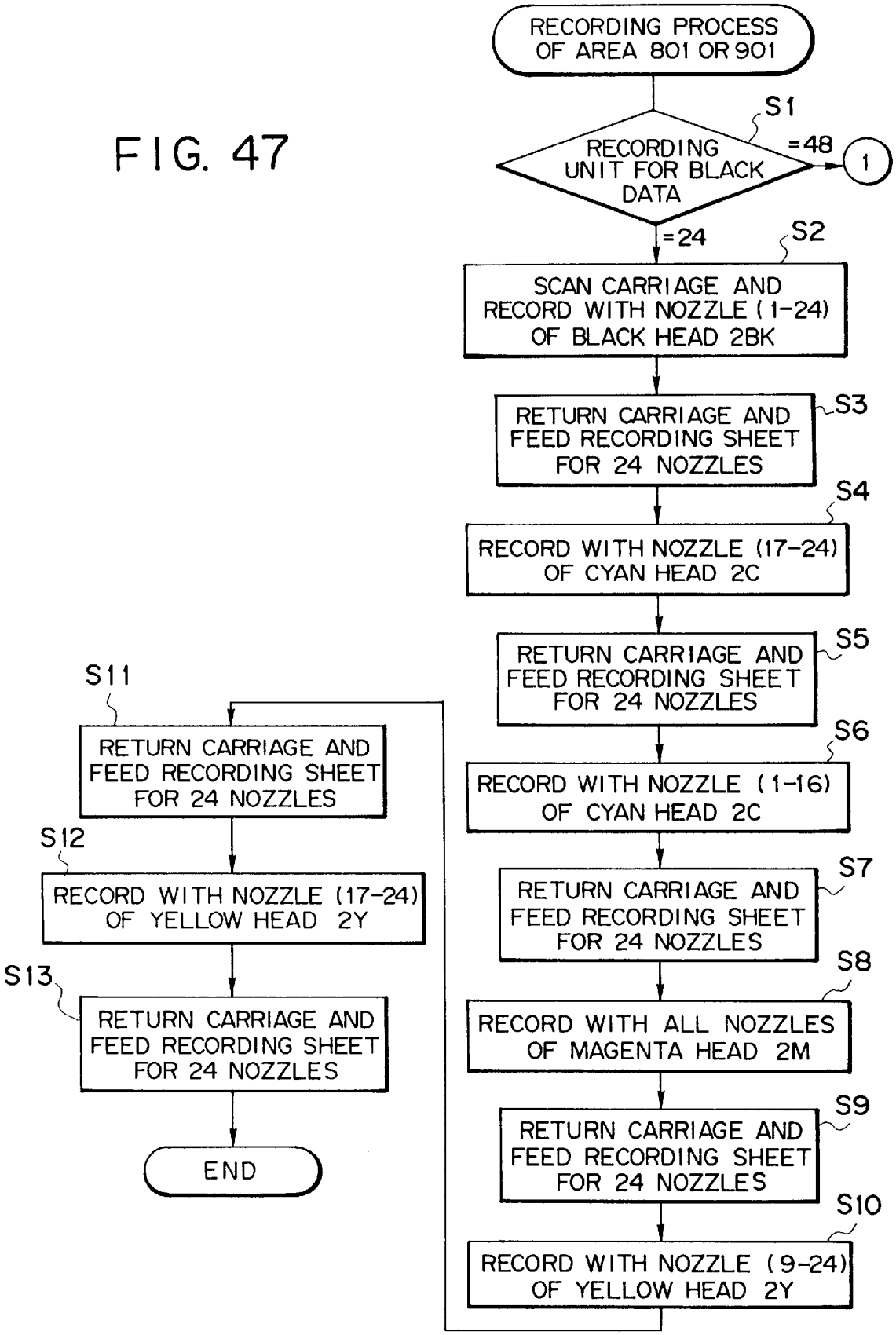
FIG. 47 is a flowchart showing a recording process in the embodiment of the present invention.
Figure 48:
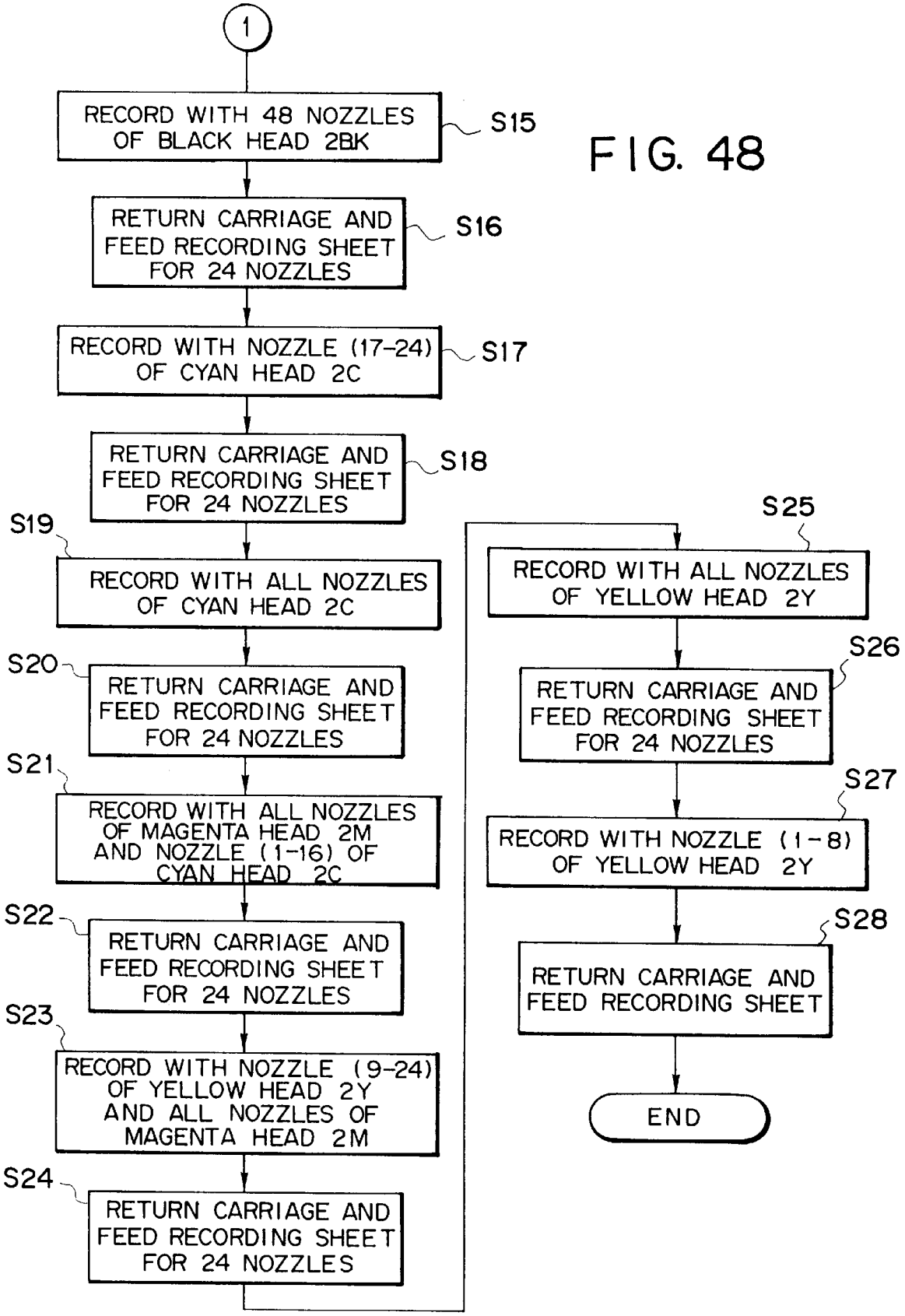
FIG. 48 is a flowchart showing the recording process in the embodiment of the present invention.

FIGS. 47 and 48 are flowcharts showing the recording processing of this embodiment as shown in FIGS. 44 and 45, a control program for executing this processing being stored in a ROM 711.

FIGS. 47 and 48 show the recording processing onto the areas 801 and 901 as shown in FIGS. 44 and 45, and to simplify the explanation, the recording operation on the other areas of the recording sheet is omitted.

First, at step S1, the number of used nozzles for the black head 2Bk is determined. This number of nozzles may be determined, for example, by the image width of black, or may be preset without regard to the recording data. As shown in FIG. 44, if the recording unit is twenty four nozzles of the black head 2Bk, the operation proceeds to step S2, or otherwise to step S15 (FIG. 48). At step S2, the carriage 101 is conveyed in the main scan direction by driving the carriage motor 624 to record the black data using the first to twenty fourth nozzles of the black head 2Bk. At step S3, the carriage return is made and the recording sheet 106 is conveyed in the sub-scan direction by the amount of twenty four nozzles. Then, at step S4, the cyan data is recorded using the seventeenth to twenty fourth nozzles of the cyan head 2C. Note that the black data by the amount of twenty four nozzles is recorded using the black head 2Bk at the same time, but the explanation for the recording operation onto other areas of the recording sheet is omitted.

Then, at step S5, the carriage return is made and the recording sheet is conveyed, like step S3, and at step S6, the remaining portion of cyan data is recorded using the first to sixteenth nozzles of the cyan head 2C. And again, the carriage return is made and the recording sheet is conveyed (step S7), and at step S8, magenta data is recorded using all the nozzles of the magenta head 2M. Then, at step S9, the carriage return is made, and the recording sheet is conveyed. Then, at step S10, the yellow data is recorded using the ninth to twenty fourth nozzles of the yellow head 2Y. At step S11, the carriage return is made and the recording sheet is conveyed, like previous steps, and at step S12, the yellow data is recorded using the seventeenth to twenty fourth nozzles of the yellow head 2Y.

When performing the recording in units of forty eight nozzles of the black head 2Bk, the operation proceeds to step S15, where the black data is recorded using forty eight nozzles of the black head 2Bk. Then, at step S16, the carriage return is made and the recording medium is conveyed, like the previous step S3, and at step S17, the cyan data is recorded using the seventeenth to twenty fourth nozzles of the cyan head 2C. At step S18, the carriage return (convey of recording sheet) is made, and then at step S19, the cyan data is recorded using all the nozzles of the cyan head 2C, while at the same time the image of next forty eight nozzles is recorded by the black head 2Bk.

At step S20, the carriage return (convey of recording sheet) is made. Then at step S21, the image is recorded using all the nozzles of the magenta head 2M, while at the same time the cyan data is recorded using the first to sixteenth nozzles of the cyan head 2C. Then, at step S22, the carriage return (convey of recording sheet) is made, and at step S23, the image is recorded using the ninth to twenty fourth nozzles of the yellow head 2Y, and using all the nozzles of the magenta head 2M. And at step S24, the carriage return (convey of recording sheet) is made. At step S25, the image is recorded using all the nozzles of the yellow head 2Y. At step S26, the carriage return (convey of recording sheet) is made, and then at step S27, the remaining portion of yellow data is recorded using the first to eighth nozzles of the yellow head 2Y.

It will be easily understood that the recording control can be made as shown in FIG. 44, when the number of nozzles used for the black head 2Bk is twenty four or less, as shown in FIG. 45 when it is from twenty four to forty eight inclusive, and basically as shown in FIG. 45.

With the ink jet printer of this embodiment, the recording is performed by fixedly using twenty four or forty eight nozzles for the black head 2Bk at the color recording. Also, when the monochrome image is recorded, the recording is performed using all the nozzles (sixty four nozzles) of the black head 2Bk. Therefore, the use frequency of nozzles may be significantly different depending on whether the color recording or the monochrome recording is made. For example, the use frequency may be different between the first to forty eighth nozzles of the black head 33 and the forty ninth to sixty fourth nozzles, so that there is a risk that density unevenness may occur when the color recording is switched to the monochrome recording.

Figure 49:
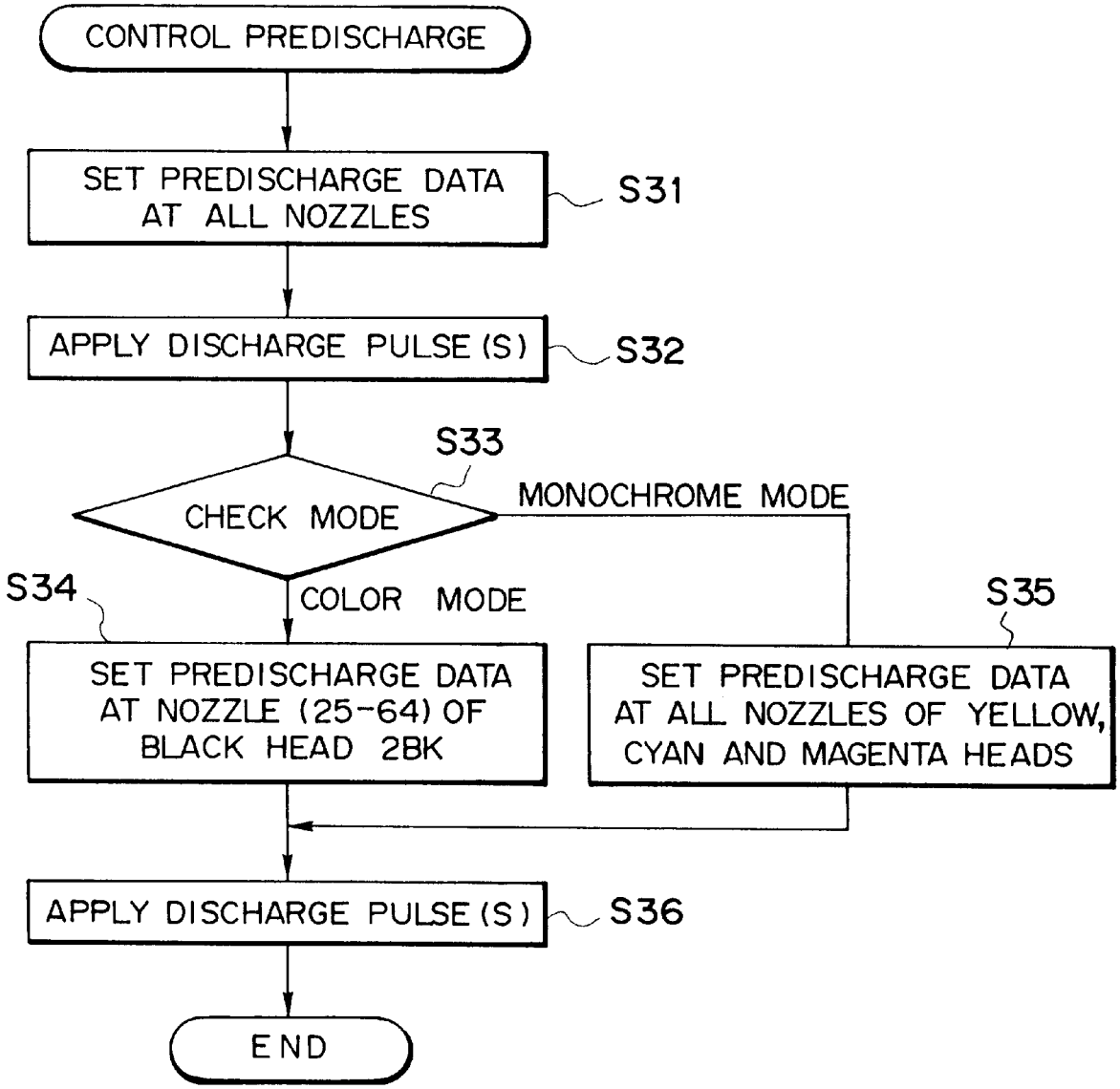
FIG. 49 is a flowchart showing a predischarge process in the embodiment.

Thus, in the fourteenth embodiment, the recording is controlled in the following manner. That is, with the ink jet printer of this embodiment, the predischarge control is made periodically to prevent the clogging of head or fixing of the ink. For example, the carriage 101 is moved to the non-recording area for performing the predischarge at the start of recording, at the end of recording, or every twelve seconds, for example, from the start of recording. FIG. 49 shows a flowchart of predischarge control when recording using the first to twenty fourth nozzles of the black head 2Bk at the color recording (FIG. 44).

First, at step S31, the predischarge data corresponding to each head stored in the ROM 711 is output to the head driver 621, to discharge ten ink droplets through each of all nozzles of the yellow head 2Y, each of all nozzles of the magenta head 2M, each of all nozzles of the cyan head 2C and each of all nozzles of the black head 2Bk (step S32). At step S33, the current recording mode is checked to determine whether it is the color mode or the monochrome mode, in which in the color mode, the operation proceeds to step S34, while in the monochrome mode, the operation proceeds to step S35. At step S34, predischarge data stored in the ROM 711 is output to the twenty fifth to sixty fourth nozzles of the black head 2Bk, and ten ink droplets are discharged (step S36). At this time, predischarge is set to be inhibited for all the nozzles of other yellow head 2Y, magenta head 2M and cyan head 2C.

In the monochrome mode, at step S35, predischarge data of the ROM 711 is output to the head driver 621 to set the predischarge data to all the nozzles of yellow head 2Y, magenta head 2M and cyan head 2C. At step S36, a heat pulse is applied to the heat converter provided inside of each head, and the ink within the discharge orifice is caused to expand by generating the heat within the head, so that ten ink droplets are discharged.

In this manner, the discharge is made using all the nozzles for all the heads at the first predischarge, and predischarge is made only for the nozzles of the head not in use in the current recording mode at the second predischarge, so that the recording image can be recorded without producing ink unevenness, even if it is changed.

It should be noted that as shown in FIG. 45, in the color mode for recording using forty eight nozzles of the black head 2Bk, predischarge may be also made for the forty ninth to sixty fourth nozzles of the black head 2Bk at step S34.

Figure 50:
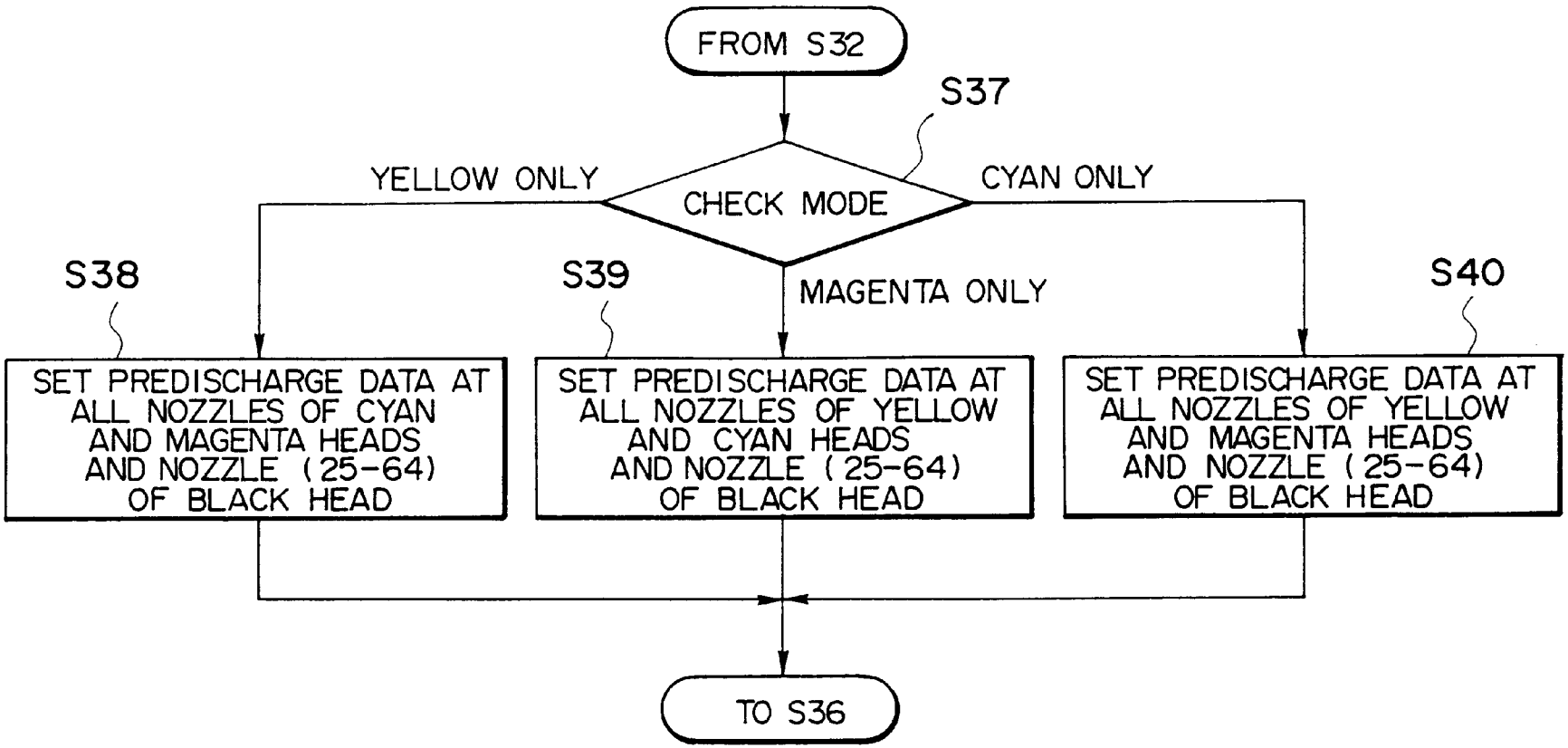
FIG. 50 is a flowchart showing a variation of predischarge process of FIG. 49.

FIG. 50 is a flowchart showing a variation of the processing of FIG. 49, in which predischarge operations in the color recording mode are shown.

This processing is executed after step S32 of FIG. 49. First, at step S37, the current color recording mode is checked. When only the yellow data and the black data are recorded, the operation proceeds to step S38, predischarge data is set to all the nozzles of the color recording heads except for the yellow head 2Y, and to the twenty fifth to sixty fourth nozzles of the black head 2Bk. Also, when only the magenta data and the black data are recorded, the operation proceeds to step S39, predischarge data is set to all the nozzles of the color recording heads except for the magenta head 2M and to the twenty fifth to sixty fourth nozzles of the black head 2Bk. Also, when only the cyan data and the black data are recorded, the operation proceeds to step S40, predischarge data is set to all the nozzles of the color recording heads except for the cyan head 2C and to the twenty fifth to sixty fourth nozzles of the black head 2Bk. Thus, if the setting of predischarge data is ended, the operation proceeds to step S39, where discharge pulses corresponding to discharge droplets are output to the heads to discharge the ink.

With this embodiment, the use frequency of nozzle for the black head 33 in the color recording and the monochrome recording can be equalized to eliminate the density unevenness of black image, as well as the image density unevenness caused by the startup characteristic of nozzles not used before in each head.

Figure 51:
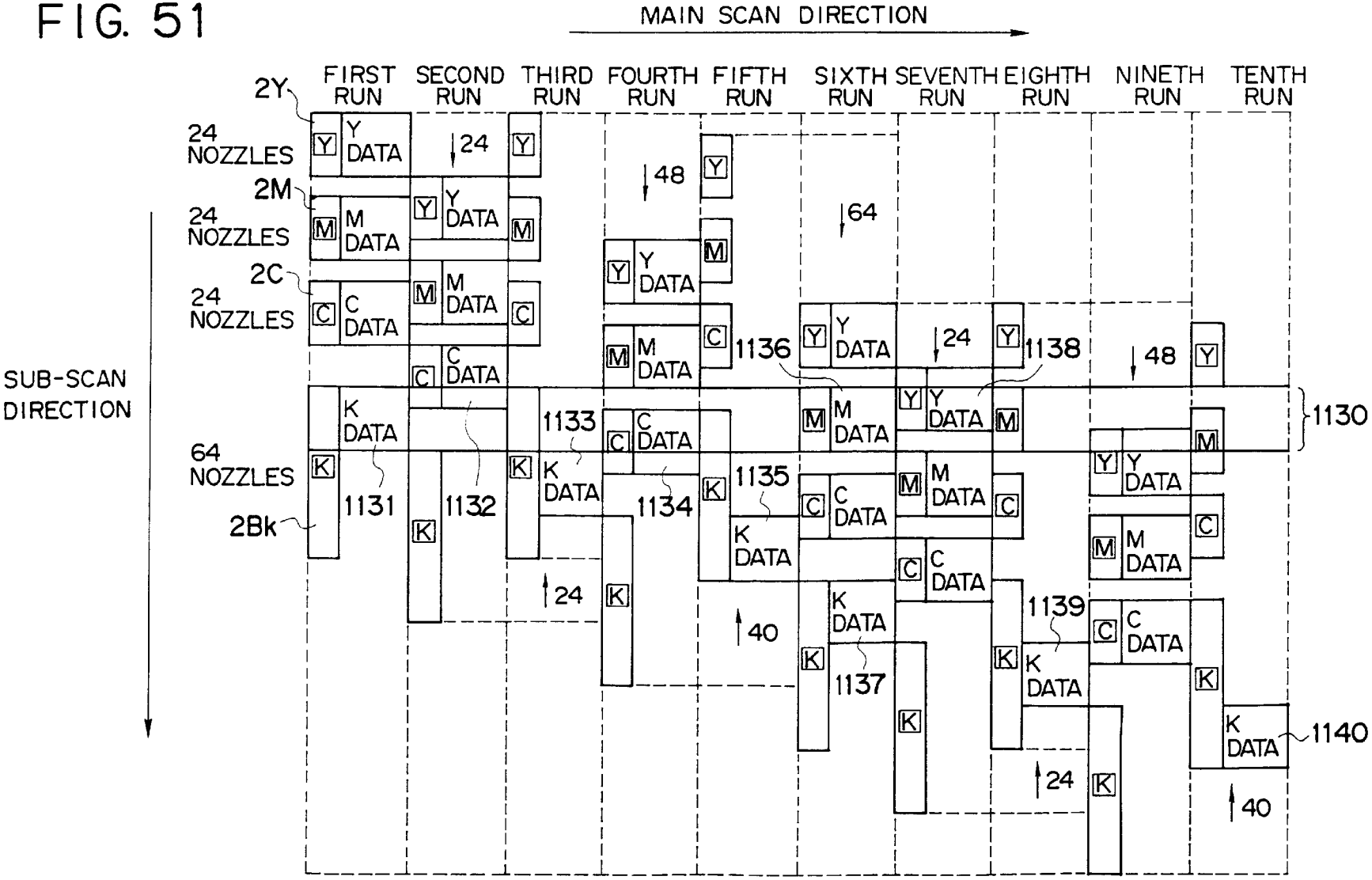
FIG. 51 is a typical view showing a process of recording color image by changing the used nozzles position of black head in the embodiment of the present invention.

Referring now to FIG. 51, the fifteenth embodiment of the present invention will be described.

FIG. 51 is a typical view showing the recording operation using all the nozzles (sixty four nozzles) of the black head 2Bk, by changing the positions of twenty four nozzles which the black head 2Bk uses at the color recording.

When the carriage 101 is moved in the main scan direction, the recording is performed using all the nozzles of yellow, magenta and cyan, while changing twenty four nozzles among the sixty four nozzles for the black head 2Bk. Note that the recording sheet is conveyed by the amount of twenty four nozzles in the sub-scan direction for each scan. This embodiment will be described with an instance of recording the area 1130.

First, at the first scan of the carriage 101, the recording is performed using the first to twenty fourth nozzles of the black head 2Bk (area 1131). Then, at the second scan, the recording is performed using the seventeenth to twenty fourth nozzles of the cyan head 2C (area 1132). Then, at the third scan of the carriage 101, the recording sheet is moved back by the amount of twenty four nozzles by rotating the sheet feed motor 625 in a counter direction, and the recording is performed using the twenty fifth to forty eighth nozzles of the black head 2Bk (area 1133). Thereby, the black data in the next area located in the sub-scan direction is recorded.

Then, at the fourth scan of the carriage 101, the cyan data is recorded using the first to sixteenth nozzles of the cyan head 2C (area 1134). Then, at the fifth scan of the carriage 101, like the second scan, the recording sheet is moved back by the amount of twenty four nozzles in the sub-scan direction by rotating the sheet feed motor 625 in a reverse direction, and the recording is performed for a next area but one 1135 located in the sub-scan direction using the forty first to sixty fourth nozzles of the black head 2Bk.

Then, at the sixth scan of the carriage 101, the magenta data is recorded using all the nozzles of the magenta head 2M (area 1135), and also recorded in an area 1137 integer times the width of twenty four nozzles apart in the sub-scan direction of the recording sheet, using the first to twenty fourth nozzles of the black head 2Bk. Then, at the seventh scan of the carriage 101, the recording is performed using the ninth to twenty fourth nozzles of the yellow head 2Y (area 1138), and at the eighth scan of the carriage 101, the recording sheet is moved back in a direction counter to the sub-scan direction by rotating the sheet feed motor 625 in the reverse direction, and the recording is performed using the twenty fifth to forty eighth nozzles of the black head 2Bk (area 1139). And at the ninth scan of the carriage 101, the recording is performed using the first to eighth nozzles of the yellow head 2Y. At the tenth scan of the carriage 101, the recording sheet is moved back in the sub-scan direction, and the recording is performed using the forty first to sixty fourth nozzles of the black head 2Bk (area 1140).

In this manner, the color recording of the recording sheet can be made by reciprocating the carriage 101 in the main scan direction by ten times, and using evenly sixty four nozzles of the black head 2Bk. This makes it possible to prevent the density unevenness of recorded image by eliminating the occurrence of less used nozzles in the black head 2Bk.

Also, if the predischarge control as described in the fourteenth embodiment is added to the above control, the density unevenness in the recorded image can be prevented.

Figure 52:
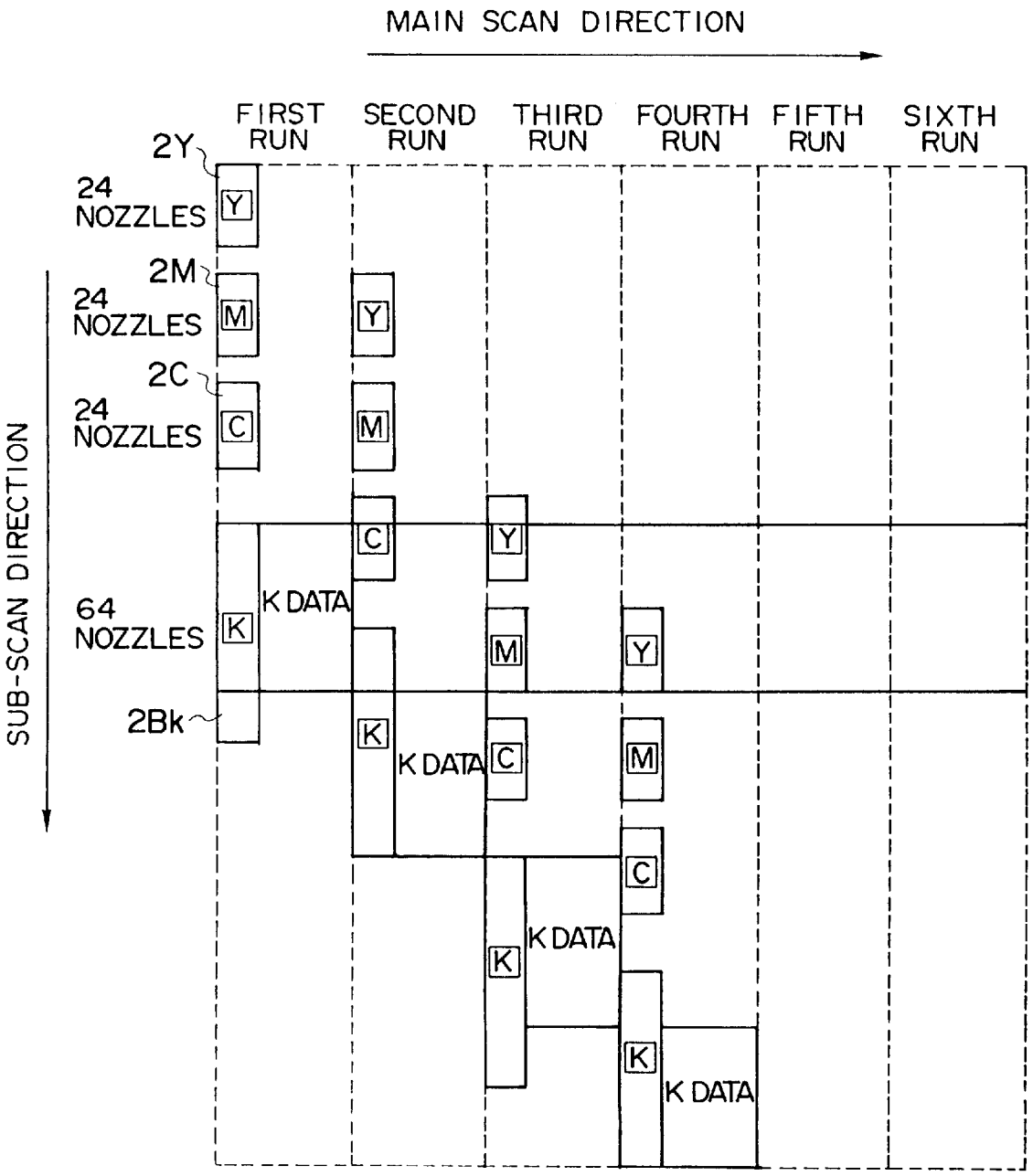
FIG. 52 is a typical view showing a process of recording monochrome image by changing the used nozzle position of black head.

As shown in FIG. 52, there will be described an instance of evenly using all the nozzles of the black head 2Bk by changing the positions of nozzles which the black head 2Bk uses, when the monochrome image is recorded. Herein, when the carriage 101 is scanned in the main scan direction, the recording is performed using forty eight nozzles among all sixty four nozzles of the black head 2Bk. Also, the recording sheet is conveyed by the amount of twenty four nozzles in the sub-scan direction for each scan of the carriage 101.

First, at the first scan of the carriage 101, the recording is performed using the first to forty eighth nozzles of the black head 2Bk. Then, at the second scan, the recording is performed using the seventeenth to sixty fourth nozzles of the black head 2Bk. Further, at the third scan of the carriage 101, the recording is performed using the first to forty eighth nozzles of the black head 2Bk, and at the fourth scan of the carriage 101, the recording is performed using the seventeenth to sixty forth nozzles of the black head 2Bk.

In this manner, the monochrome image can be recorded by the amount of 192 rasters on the recording sheet by reciprocating the carriage 101 in the main scan direction by four times, and using all the nozzles (sixty four) of the black head 2Bk twice.

As described, in the monochrome recording of this embodiment, the image density unevenness can be prevented by eliminating the occurrence of less used nozzles of the black head 2Bk because of evenly using the nozzles of the black head 2Bk.

Also, the image density can be further stabilized by adding the predischarge control as previously described in the fourteenth embodiment to this.

Figure 53:
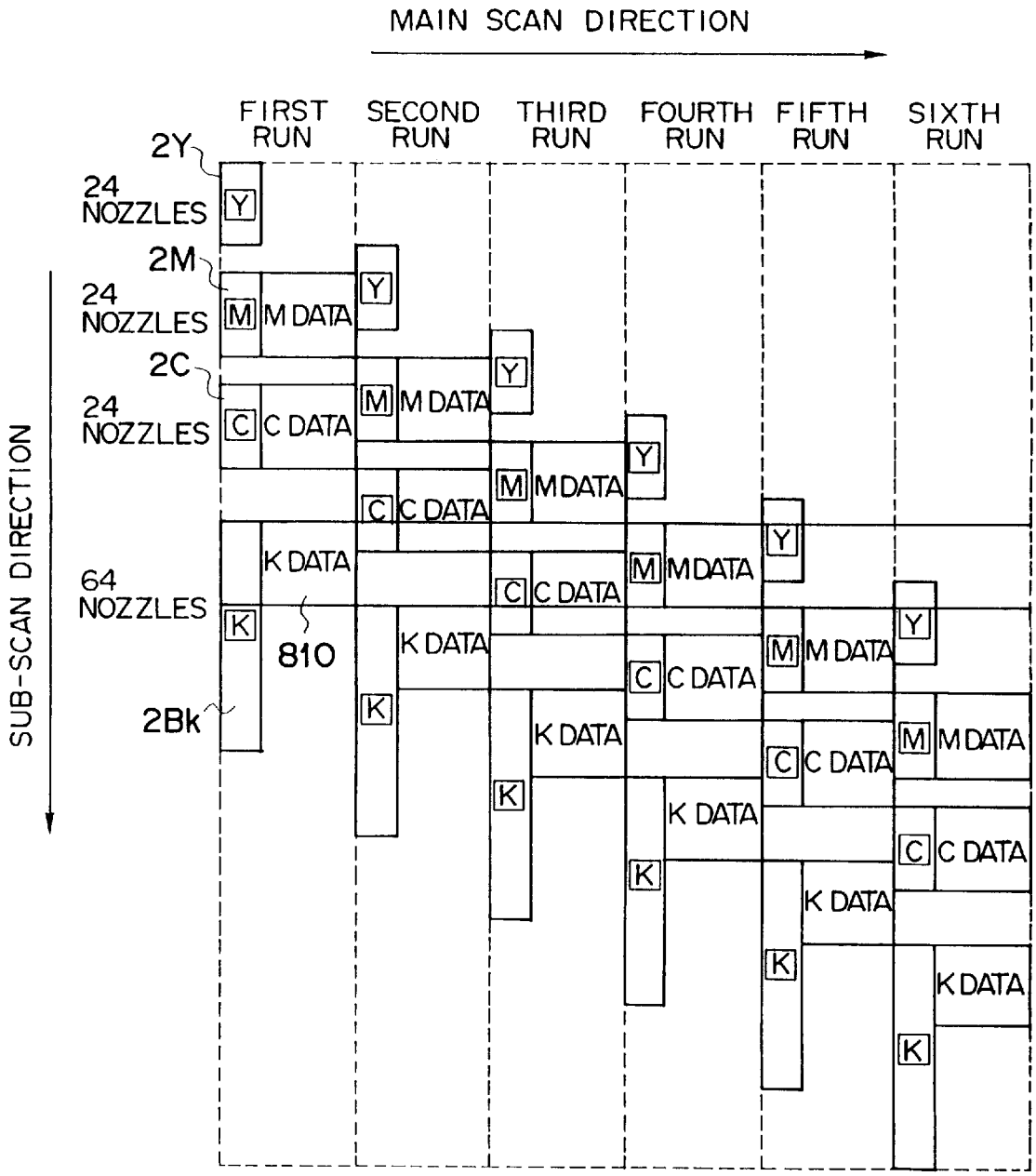
FIG. 53 is a typical view showing a color image recording operation when yellow data is not contained.

FIG. 53 is a typical view showing the operation in which only yellow data is not contained, when the color image is recorded as shown in FIG. 44, using the ink jet head in the fourteenth embodiment as previously described. In the predischarge control in this case, at step S35 of the flowchart of FIG. 49, the predischarge for the yellow head 2Y is not performed.

Figure 54:
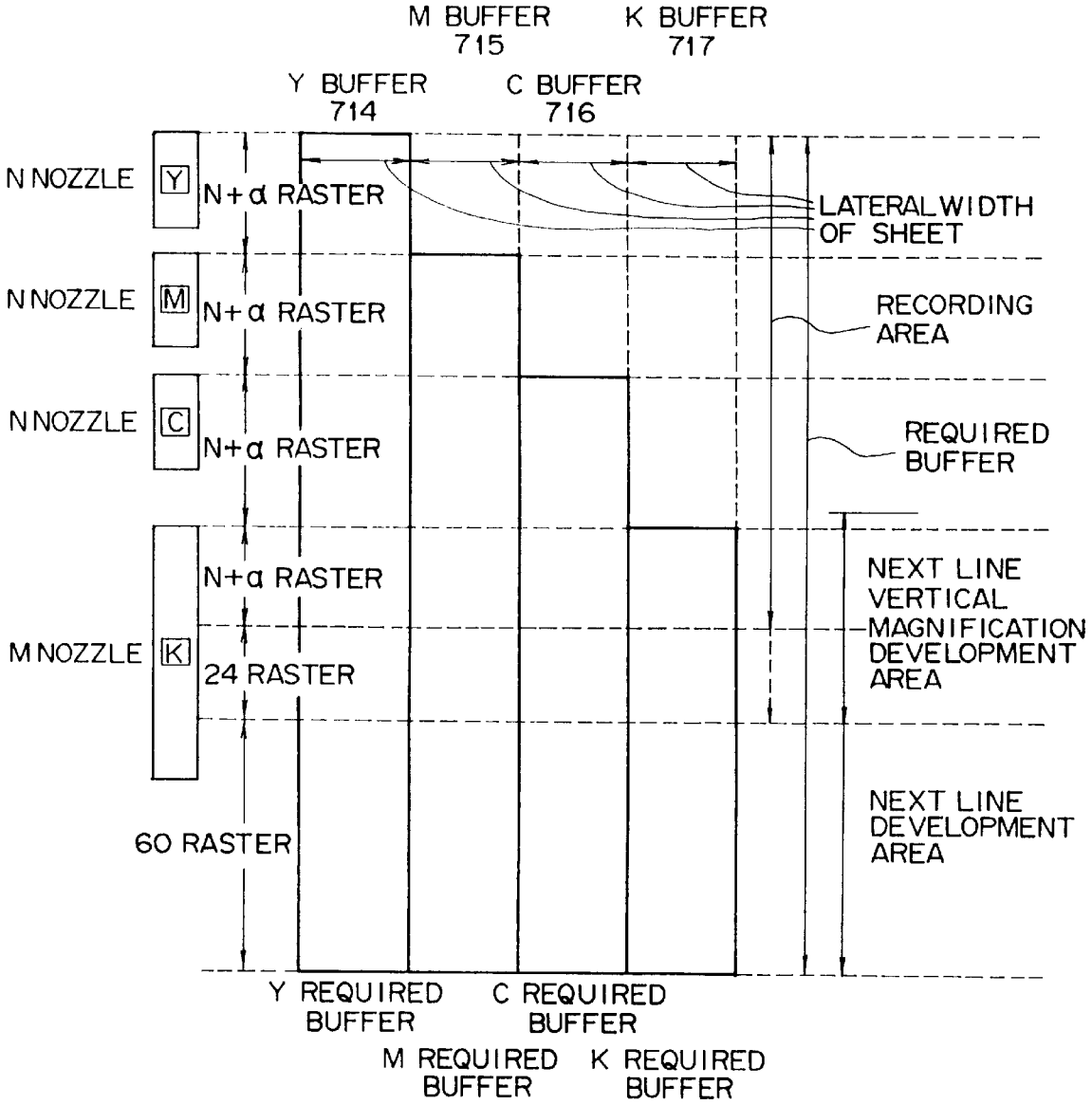
FIG. 54 is a view for explaining the content of data in a buffer of each color when recording color image.
Figure 55:
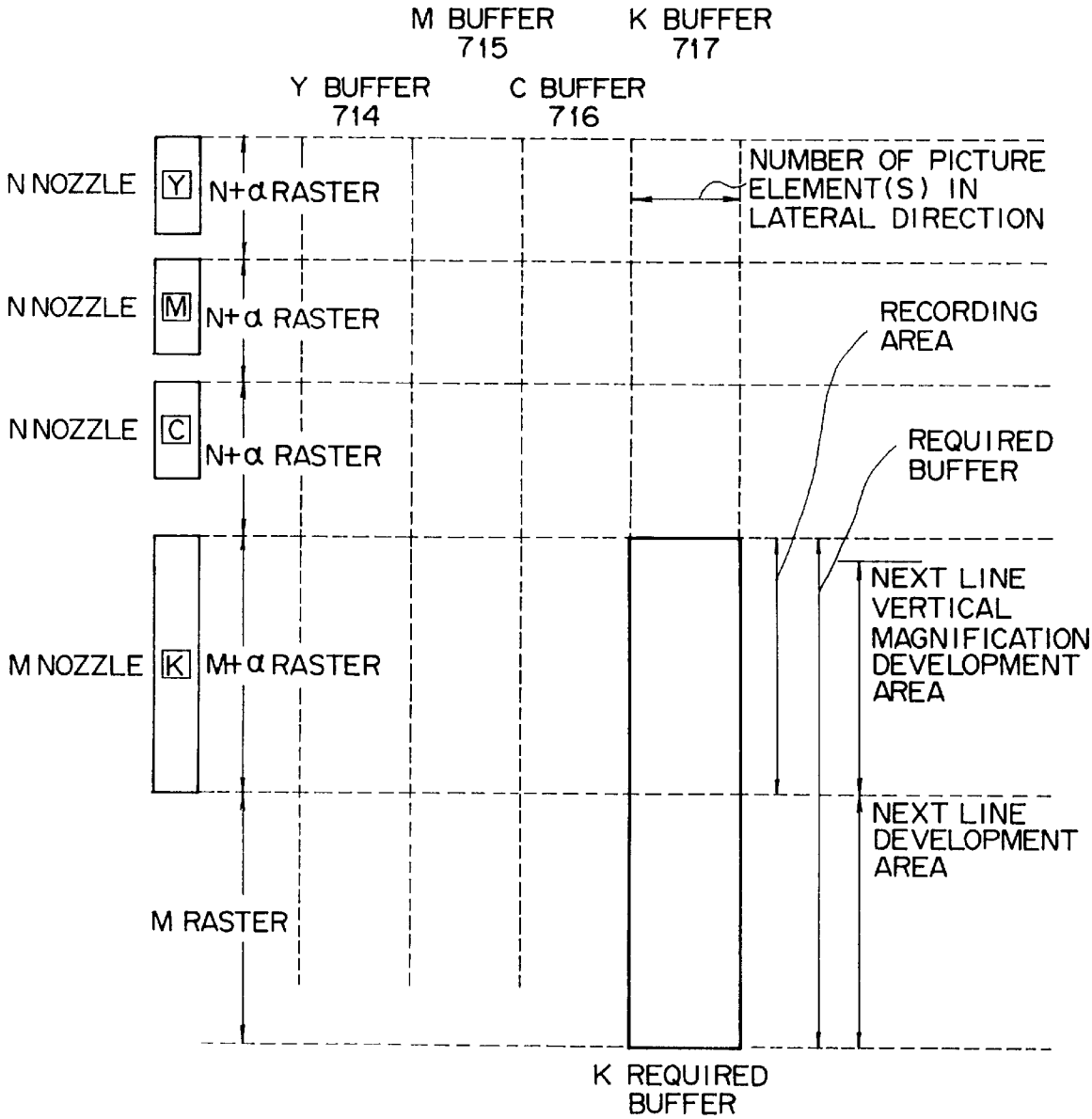
FIG. 55 is a view for explaining the content of data in a buffer of each color when recording monochrome image.

FIG. 54 shows the content of each buffer when the color image is recorded in the previous embodiments, and FIG. 55 shows the content of buffer when the monochrome data is recorded. Herein, each of the yellow head 2Y, the magenta head 2M, and the cyan head 2C has N nozzles, and the black head 2Bk has M nozzles.

Next, an ink jet printer according to the sixteenth embodiment will be described below. This ink jet printer is constituted in the same way as that of the fourteenth embodiment as previously described, but is different in the shape of ink jet head as shown in FIGS. 56 to 58.

Figure 56:
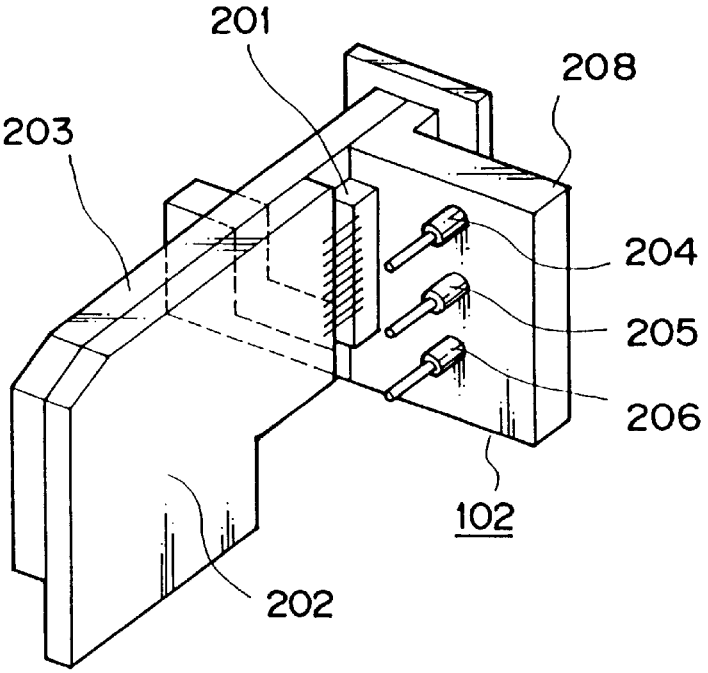
FIG. 56 is a perspective view of a recording head unit according to an embodiment of the present invention on the back side thereof.
Figure 57:
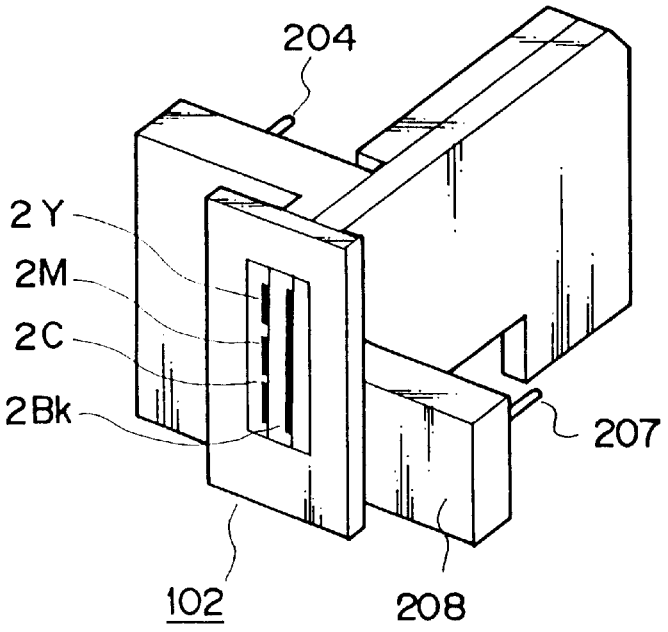
FIG. 57 is a perspective view of the recording head unit according to the embodiment of the present invention on the front side thereof.
Figure 58:
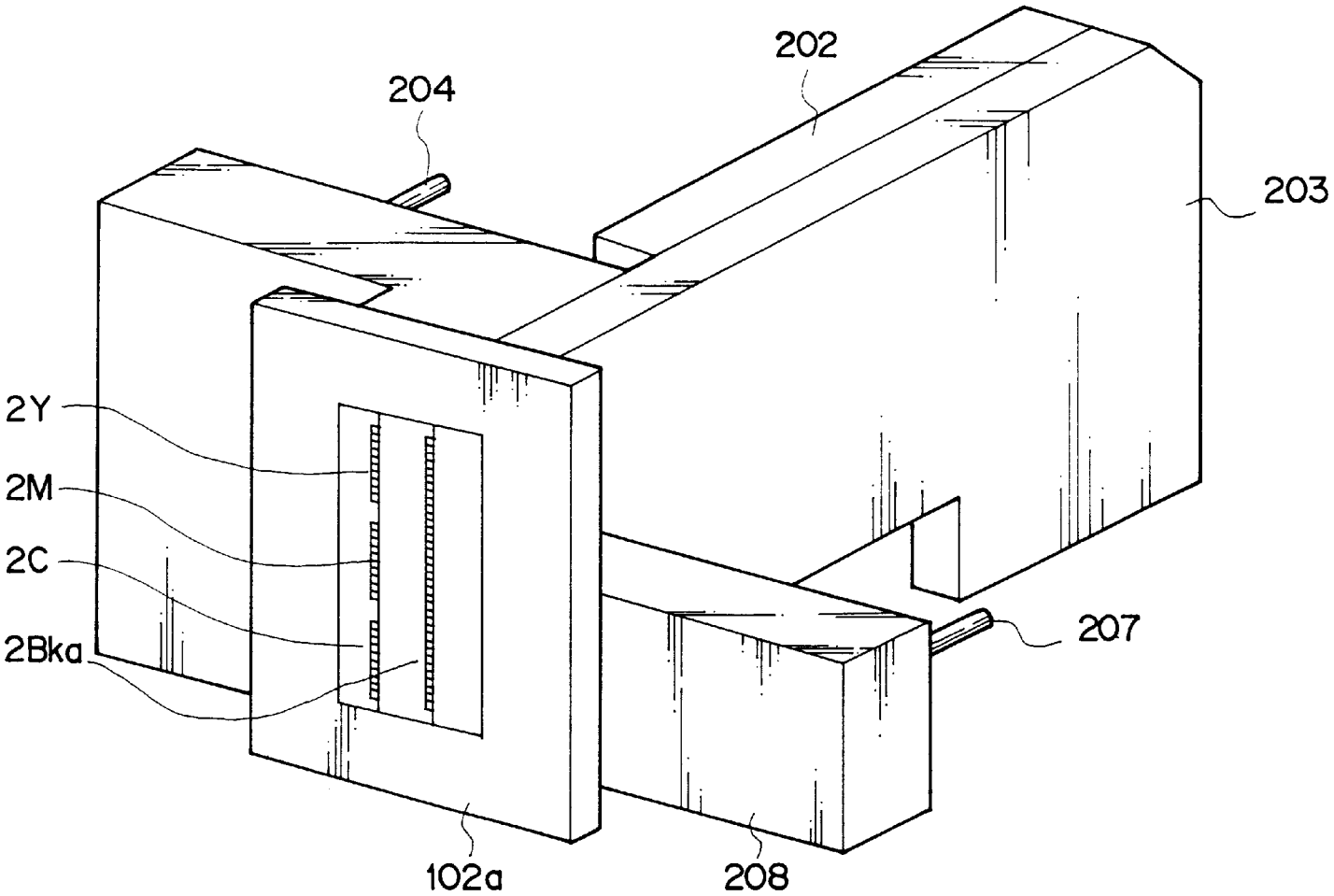
FIG. 58 is an enlarged view of the recording head unit according to the embodiment of the present invention on the front side thereof.

In FIGS. 56 to 58, the nozzle groups for yellow, magenta and cyan are arranged in one line on the left side of the front face of a recording head 102*a*, and a nozzle group for black is arranged in one line on the right side thereof. The number of nozzles for each head is N for yellow, magenta and cyan, and M for black, where M is greater than N for other heads. The space between adjacent color heads is equal to or greater than a nozzle pitch. For example, in this embodiment, the number of nozzles for each of the yellow, magenta and cyan heads (2Y, 2M, 2C) is 24, and the number of nozzles for the black head 2Bk is 88.

In the figure, 201 is a silicone substrate, 202 is a printed board, and 203 is aluminum plate. 204 is a pipe for yellow, 205 is a pipe for magenta, 206 is a pipe for cyan, and 207 is a pipe for black. Also, 208 is a distributor. Note that FIG. 58 is an enlarged view of FIG. 57.

A specific example of the recording operation with the ink jet printer of the sixteenth embodiment of the present invention will be described below.

Figure 59:
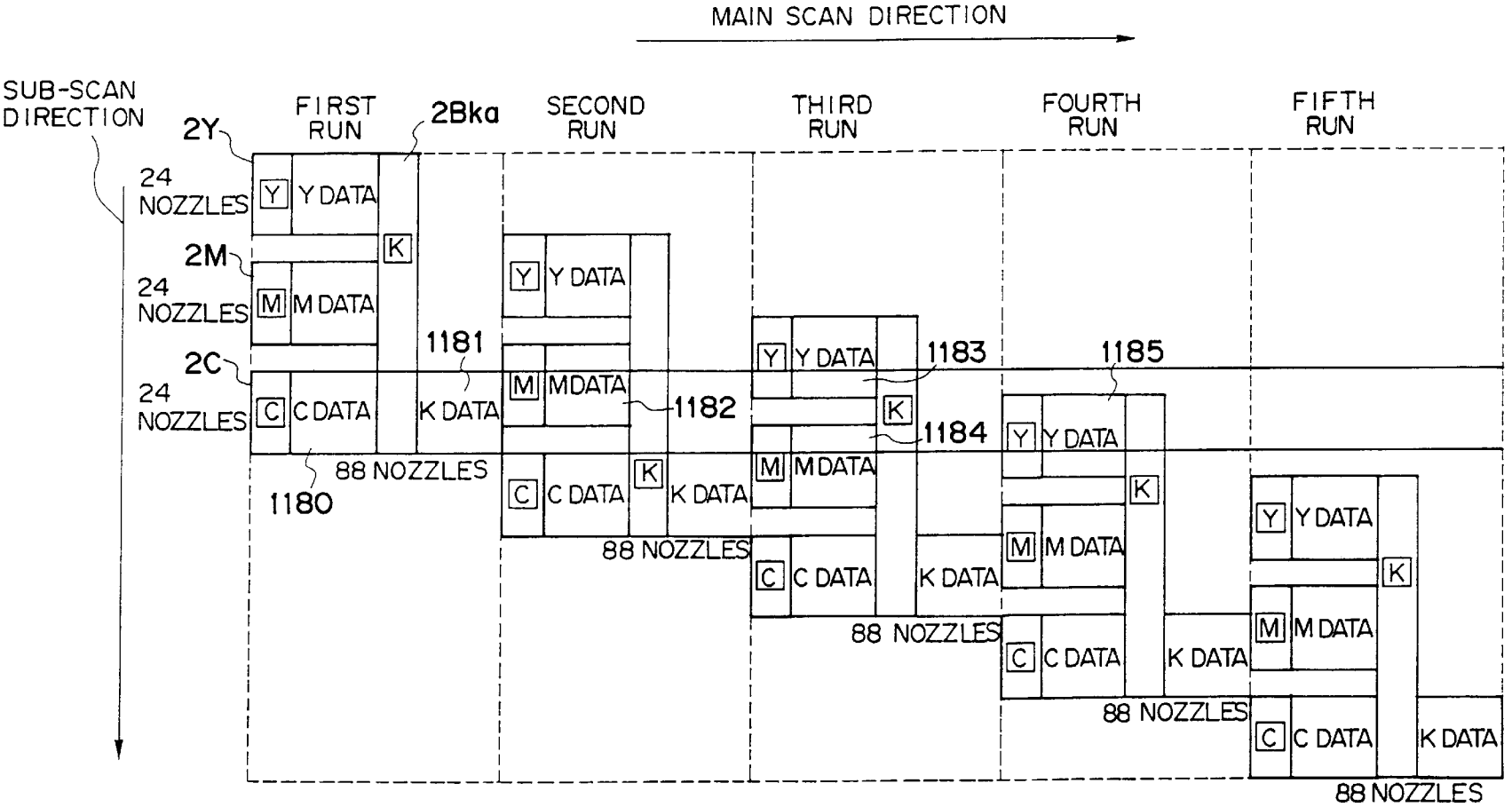
FIG. 59 is a typical view showing a recording process of using 24 nozzles of black head when recording color image in the embodiment.

FIG. 59 is a typical view showing an instance of recording the color image in units of twenty four nozzles, using predetermined nozzles (from the sixty fifth nozzle to the eighty eighth nozzle) of the black head 2Bk. In this case, as in the typical view as previously described, when the carriage 1 is moved in the main scan direction, the recording is performed using twenty four nozzles of each of the yellow, magenta, cyan and black heads, and the recording sheet is conveyed by the amount of twenty four nozzles in the sub-scan direction for each scan of the carriage 1.

First, at the first scan of the carriage 101, the black data is recorded using the sixty fifth to eightly eighth nozzles of the black head 33*a* (area 1181), while at the same time the cyan data is recorded using all the nozzles of the cyan head 2C (area 1180). Then, at the second scan of the carriage 101, the recording is performed using the ninth to twenty fourth nozzles of the magenta head 2M (area 182). Then, at the third scan of the carriage 101, the recording is performed using the seventeenth to twenty fourth nozzles of the yellow head 2Y (area 1183), while at the same time the recording is performed using the first to eighth nozzles of the magenta head 12M (area 1184). At the fourth scan of the carriage 101, the recording is performed using the first to sixteenth nozzles of the yellow head, in the reciprocatory movement of the carriage 101 in the main scan direction (area 1185).

In this manner, the color recording is performed by the amount of twenty four rasters on the recording sheet by reciprocating the carriage 101 in the main scan direction by four times.

Figure 60:
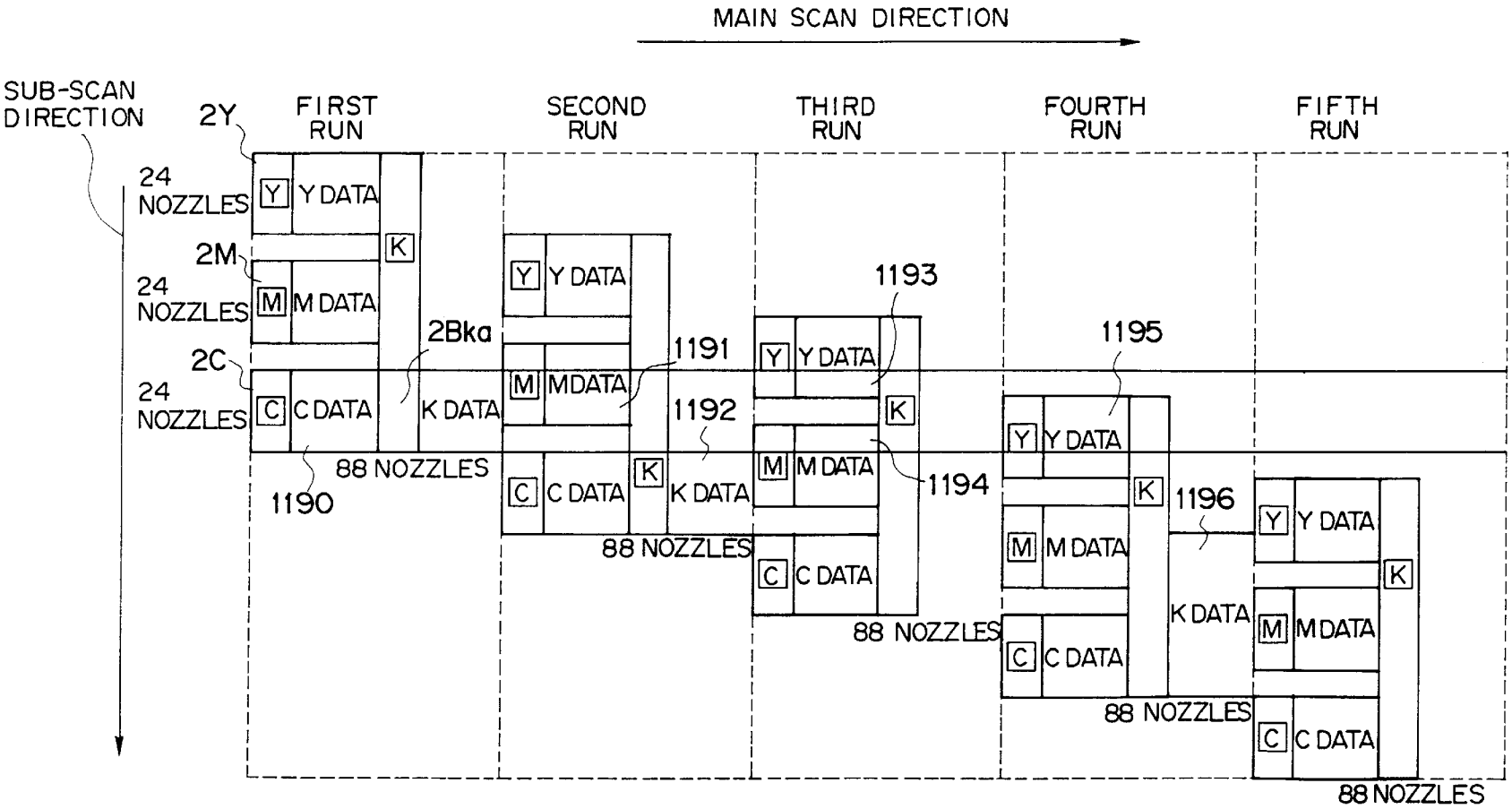
FIG. 60 is a typical view showing a basic operation of using 48 nozzles of black head when recording color image in the third embodiment.

FIG. 60 is a view showing the recording operation using forty eight nozzles of the black head 2Bk. Herein, when the carriage 101 is reciprocated in the main scan direction, the recording is performed using all the nozzles of each of the yellow, magenta and cyan heads, and using the fortieth to eighty eighth nozzles of the black head 2Bk. For each scan of the carriage 101, the recording sheet is moved by the amount of twenty four nozzles in the sub-scan direction.

At the first scan of the carriage 101, the recording is performed using all the nozzles of the cyan head 2C (area 1190). Then, at the second scan, the recording is performed in an area 1191 using the ninth to twenty fourth nozzles of the magenta head 2M, and simultaneously in an area 1192 using the forty first to eighty eighth nozzles of the black head 2Bk. Then at the third scan of the carriage 101, the recording is performed using the seventeenth to twenty fourth nozzles of the yellow head 2Y (area 1193), and simultaneously using the first to eighth nozzles of the magenta head 2M (area 1194). And at the fourth scan, the recording is performed in an area 1195 using the first to sixteenth nozzles of the yellow head 2Y, and simultaneously using the forty first to eighty eighth nozzles of the black head 2Bk (area 1196).

Note that in the above embodiment, the predischarge control is performed for the forty first to eighty eighth nozzles of the black head 2Bk at the first, third and fifth scans of the carriage 1 in the main scan direction. In this manner, the color image can be recorded by the amount of twenty four rasters on the recording sheet by reciprocating the carriage 1 in the main scan direction by four times.

As described, with the recording control of this embodiment, the recording can be made by changing the number of nozzles used by the black head 2Bk from twenty four to forty eight. On the other hand, in the recording of monochrome image, all the nozzles of the black head 2Bk are used.

By the way, in the ink jet printer of the sixteenth embodiment, like the fourteenth embodiment as previously described, the predischarge control is periodically performed to prevent the clogging of recording head or the fixing of the ink. This processing can be implemented by setting the predischarge data at step S34 in the flowchart of FIG. 49 to the twenty fifth to eighty eighth nozzles of the black head 33*a*, and the detailed explanation is omitted.

By making such predischarge control, the high quality image can be recorded without producing the recording unevenness.

In this manner, with the sixteenth embodiment, in either of the color recording and the monochrome recording, the use frequencies of nozzles for the black head 2Bk can be equalized, so that the image unevenness associated with the image recorded by nozzles not used before can be prevented.

Figure 61:
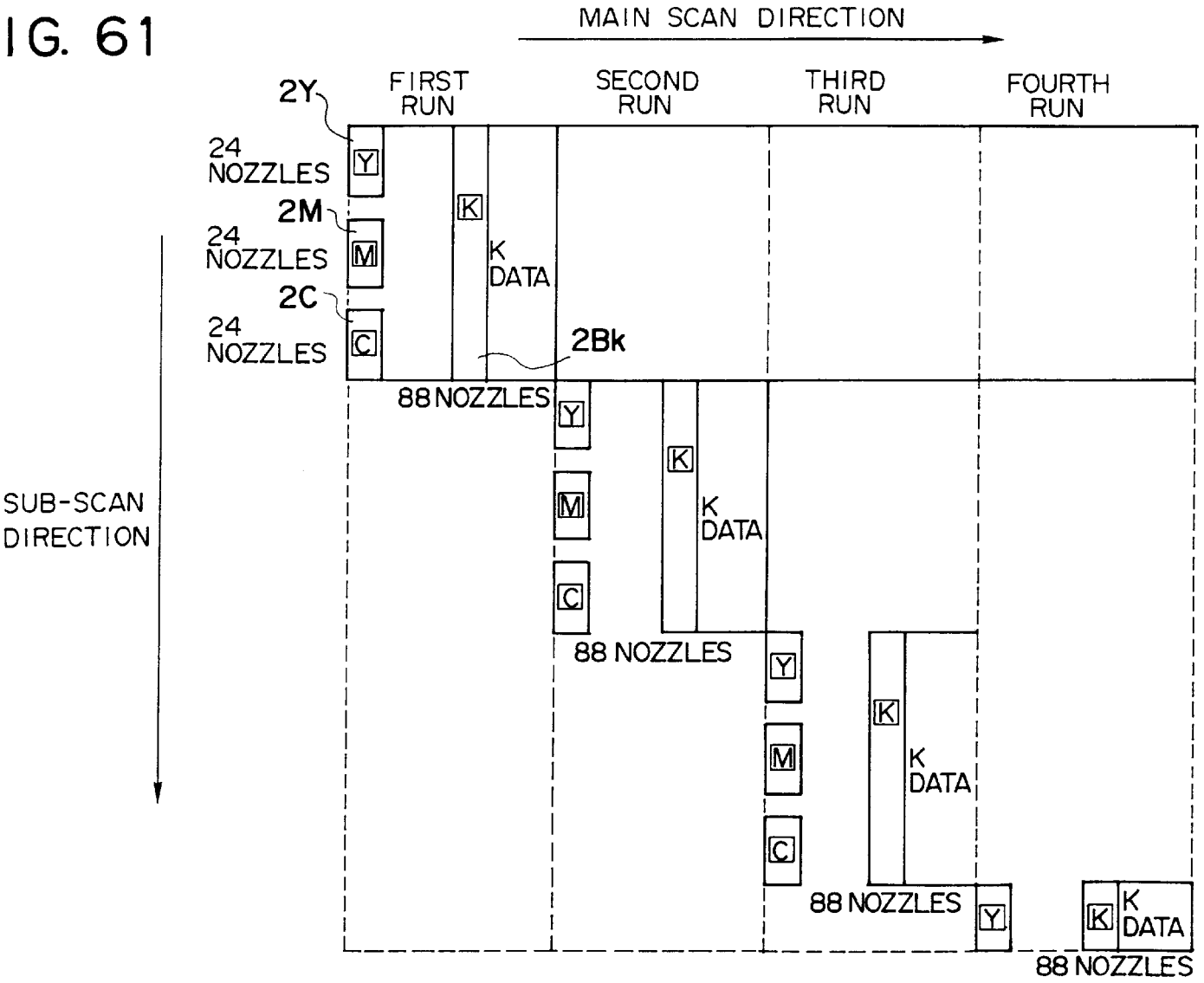
FIG. 61 is a typical view showing a process of recording monochrome image by the use of all the nozzles of black head with the recording head of the embodiment.

FIG. 61 is a typical view showing the operation of recording the black data in units of eighty eight rasters through eighty eight nozzles of the black head 2Bk, using the recording head 2*a* of the sixteenth embodiment. Herein, the recording is performed by conveying the recording sheet in the sub-scan direction by the amount of eighty eight nozzles for each scan of the carriage 1 in reciprocatory movement. Note that this processing can be implemented in a similar manner to that of the previous embodiments, and the detailed explanation is omitted.

Figure 62:
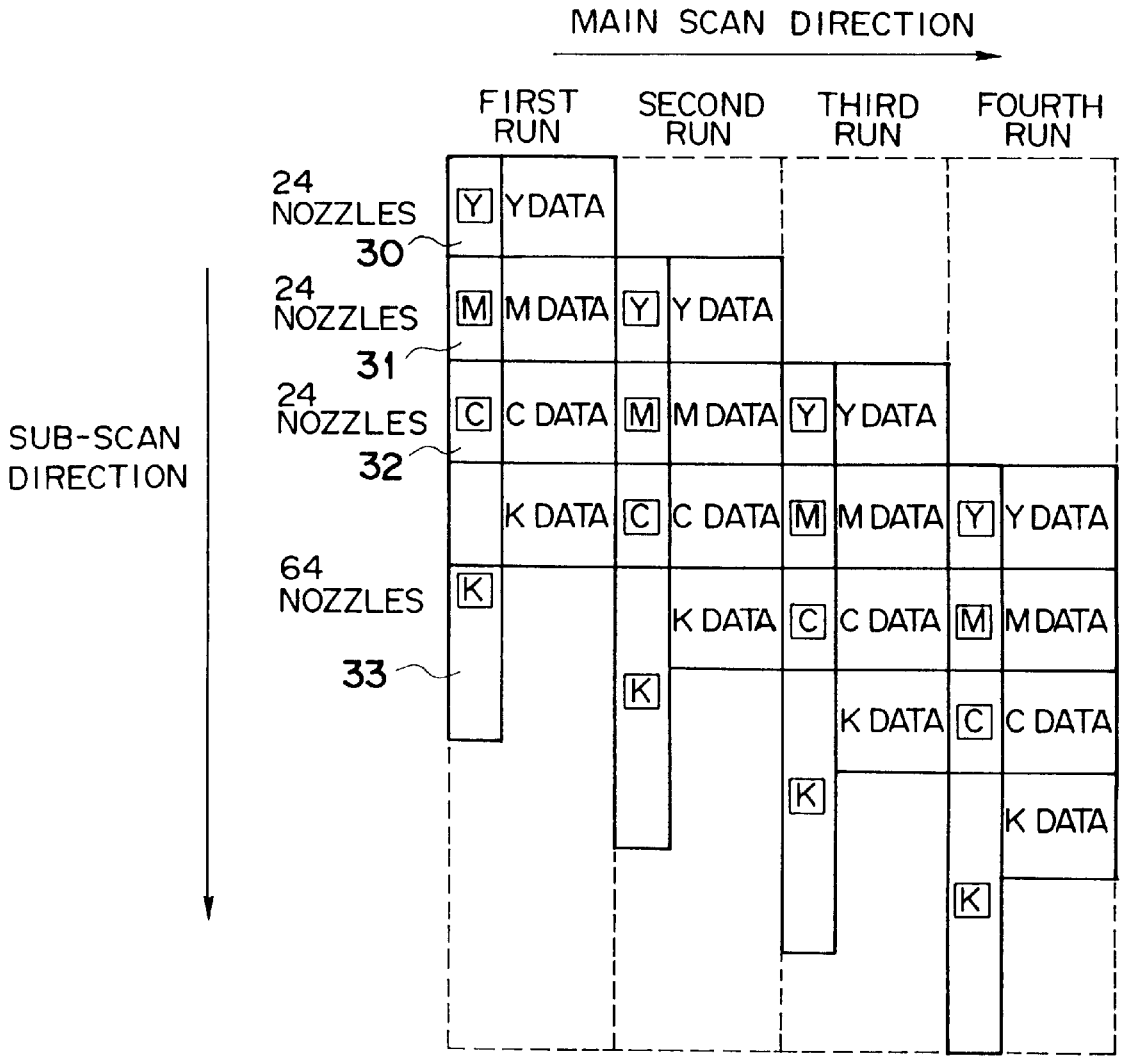
FIG. 62 is a typical view showing a recording process of color image by the use of 24 nozzles of black head, when there is no gap between heads, with the recording head of the embodiment.
Figure 63:
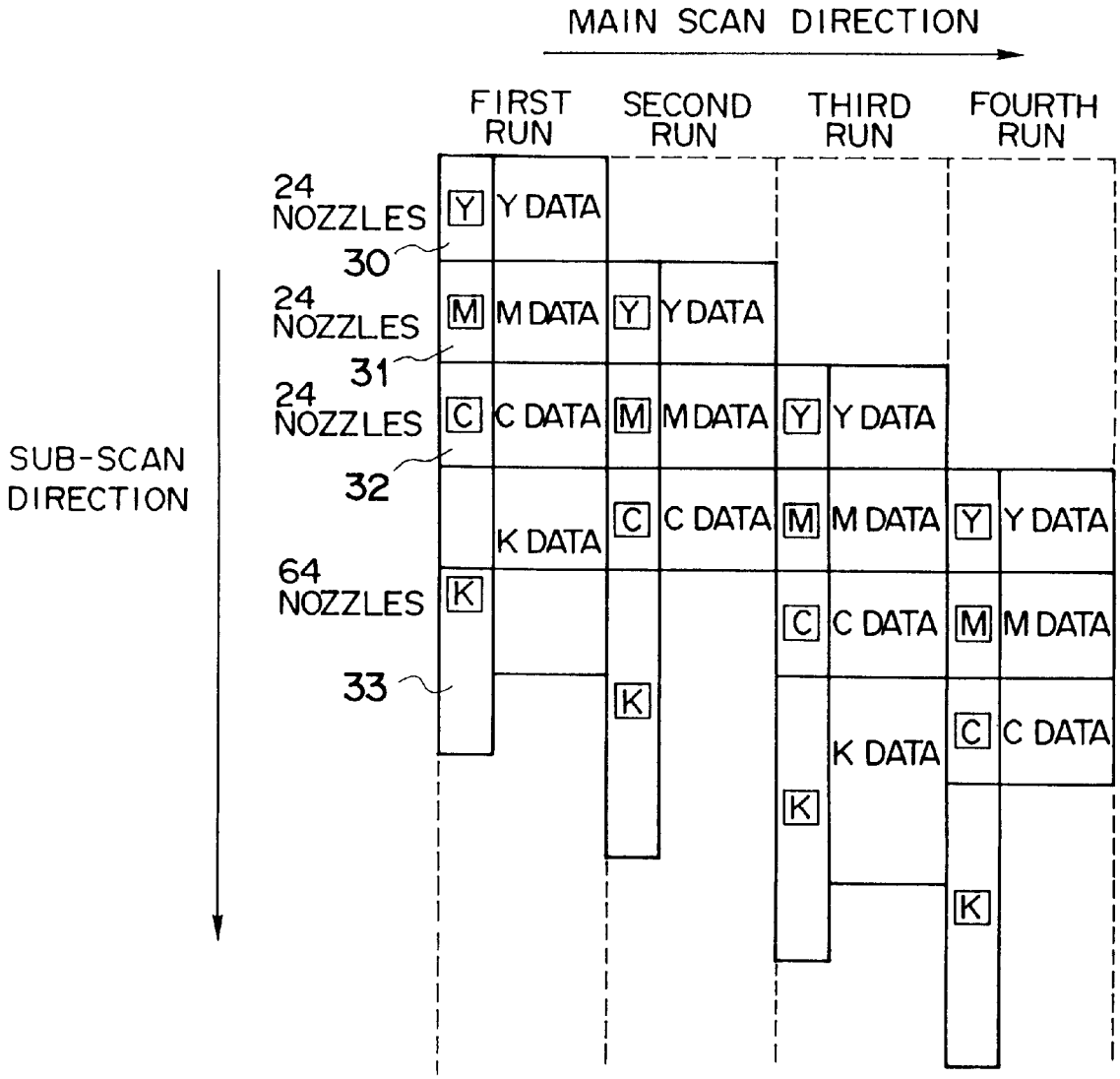
FIG. 63 is a typical view showing a recording process of color image by the use of 48 nozzles of black head, when there is no gap between heads, with the recording head of the embodiment.

FIGS. 62 and 63 are typical views showing the operation in the color recording mode and the monochrome recording mode, when the heads for yellow, magenta, cyan and black are arranged in a line, without space between adjacent heads, in which each of the heads used has the same number of nozzles as that of the ink jet printer of the fourteenth embodiment as previously described.

In FIG. 62, the recording is performed using the first to twenty fourth nozzles of the black head, at the first scan of the carriage 101, and using all the nozzles of the cyan head 2C at the second scan. Then, at the third scan of the carriage 101, the recording is performed using all the nozzles of the magenta head 2M, and at the fourth scan of the carriage, the recording is performed using all the nozzles of the yellow head 2Y.

In this manner, the color image can be recorded by the amount of twenty four rasters on the recording sheet by reciprocating the carriage 1 in the main scan direction by four times.

FIG. 63 is a typical view showing the operation of recording the image by the amount of forty eight rasters using the first to forty eight nozzles of the black head 2Bk, when recording the color image without space between adjacent heads as previously described.

With the first reciprocatory movement of the carriage 1 in the main scan direction, the black data is recorded by the amount of forty eight nozzles using the first to forty eighth nozzles of the black head 2Bk, and at the second scan of the carriage 1, the cyan data is recorded using all the nozzles of the cyan head 2C. Then at the third scan of the carriage, the magenta data is recorded using all the nozzles of the magenta head 2M, while at the same time the cyan data is recorded using all the nozzles of the cyan head 2C. At the fourth scan of the carriage, the yellow data is recorded using all the nozzles of the yellow head 2Y, while at the same time the magenta data is recorded using all the nozzles of the magenta head 2M. And at the fifth scan, the yellow data is recorded using all the nozzles of the yellow head 2Y.

In these first, third and fifth scans, the black data is recorded in units of forty eight rasters using the first to forty eight nozzles of the black head 2Bk. In this manner, the color image can be recorded by the amount of forty eight rasters on the recording sheet by reciprocating the carriage in the main scan direction by five times.

In this case, like the previous embodiments, the predischarge control for each print head is of course performed.

In this manner, the density unevenness of black ink on the recording sheet can be prevented by using the fixed nozzles of the black head 2Bk.

Figure 64:
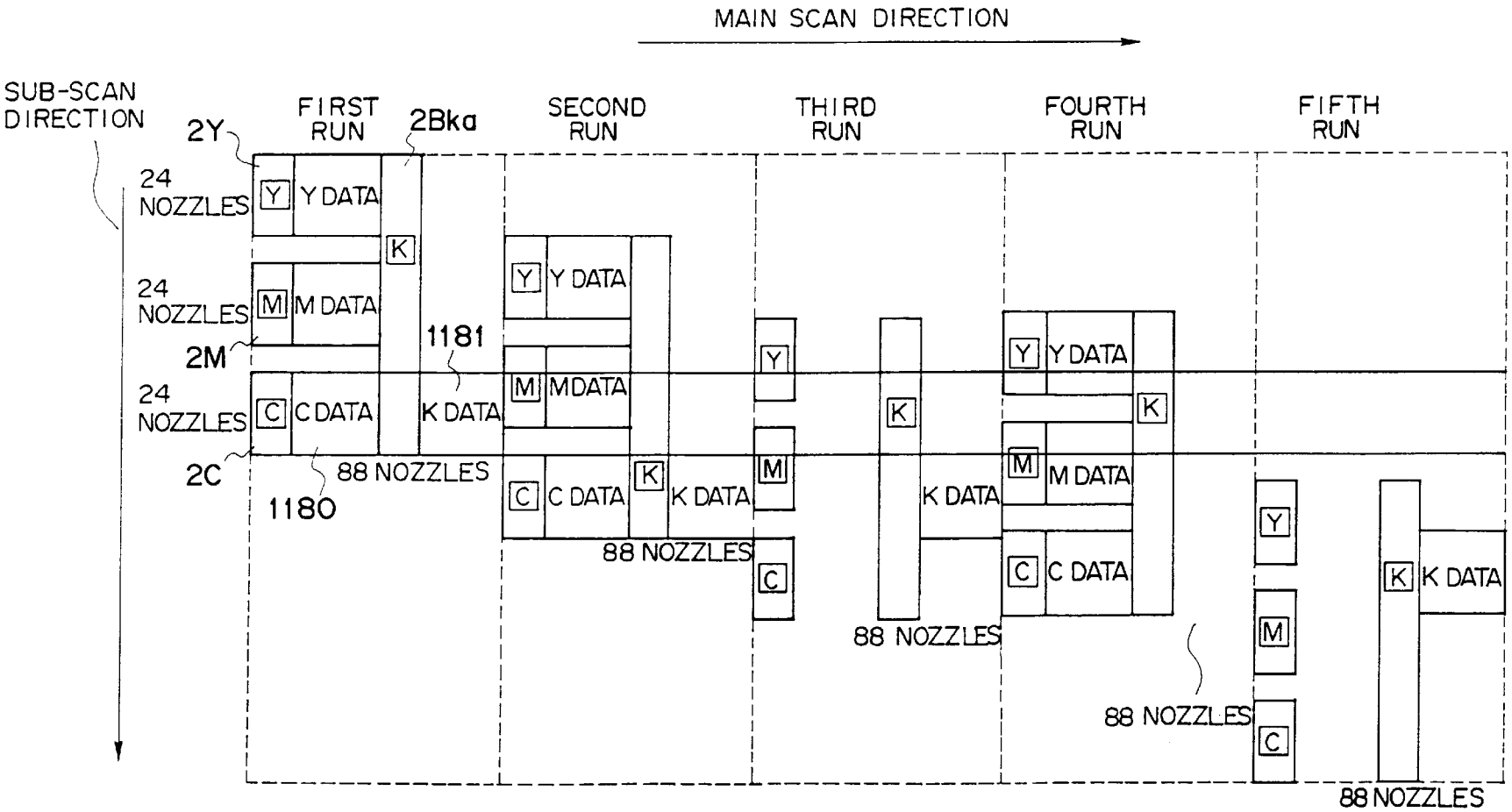
FIG. 64 is a typical view showing an operation of recording color image by changing the used nozzle position of black head in units of 24 nozzles, with the recording head in the embodiment.
Figure 65:
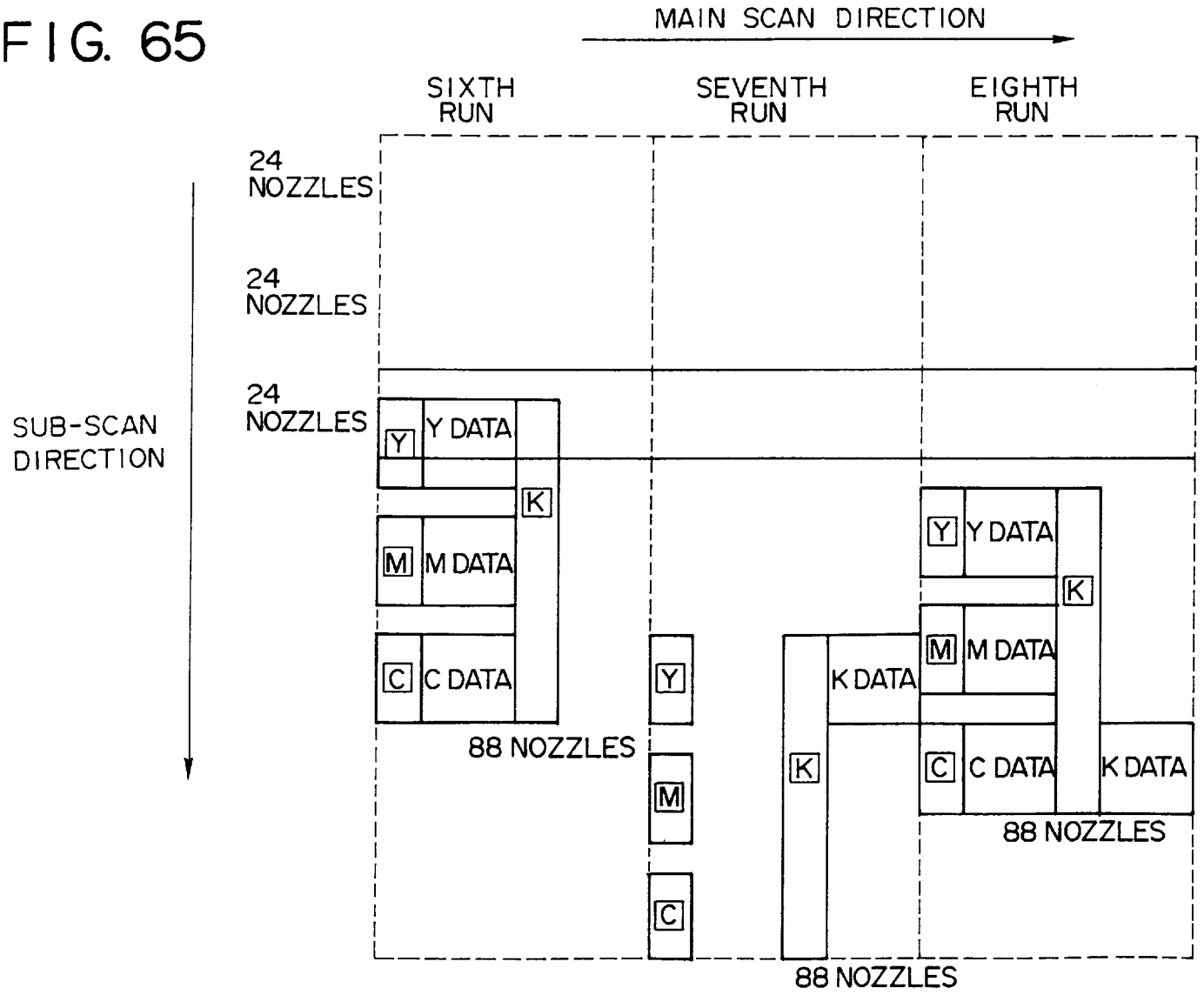
FIG. 65 is a typical view showing an operation of recording color image by changing the used nozzle position of black head in units of 24 nozzles, with the recording head in the embodiment.

FIGS. 64 and 65 are typical views showing the recording control of changing the use nozzles of the black head 2Bk at the color recording in the ink jet printer having the recording head 102 as previously described.

At the first scan of the carriage 101, the recording is performed using all the nozzles of the cyan head 2C, while at the same time the black data is recorded using the sixty fifth to eighty eighth nozzles of the black head 2Bk. Then, at the second scan of the carriage 101, the magenta data is recorded using the ninth to twenty fourth nozzles of the magenta head 2M. At the third reciprocatory movement of the carriage 101 in the main scan direction, the black data is recorded using the forty first to sixty fourth nozzles of the black head 2Bk. Then at the fourth scan of the carriage 101, the magenta data is recorded using the first to eighth nozzles of the magenta head 2M. Simultaneously, the yellow data is recorded using the seventeenth to twenty fourth nozzles of the yellow head 2Y.

Then, the recording sheet is conveyed by the amount of forty eight nozzles by driving the sheet feed motor 625. At the fifth scan of the carriage 101, the black data is recorded using the seventeenth to fortieth nozzles of the black head 2Bk. And at the sixth scan of the carriage 101, the recording sheet is moved back by rotating the sheet feed motor 625 in the reverse direction, and the yellow data is recorded using the first to sixteenth nozzles of the yellow head 2Y. And before the seventh scan, the recording sheet is conveyed by the amount of forty eight nozzles and the black data is recorded using the first to twenty fourth nozzles of the black head 2Bk.

In this manner, the color image can be recorded by the amount of N rasters on the recording sheet by reciprocating the carriage in the main scan direction by seven times, using all the nozzles of the black head.

As described, with the color recording of this embodiment, all the nozzles of the black head 2Bk can be used for the recording while the positions of twenty four nozzles used among all the nozzles of the black head 2Bk are varied. This makes it possible to prevent the density unevenness of black image arising from the difference between nozzles of high use frequency and nozzles of low use frequency.

Also, by performing the predischarge control as described in the previous embodiments, the use frequencies of all the nozzles of the black head 2Bk can be equalized.

Figure 66:
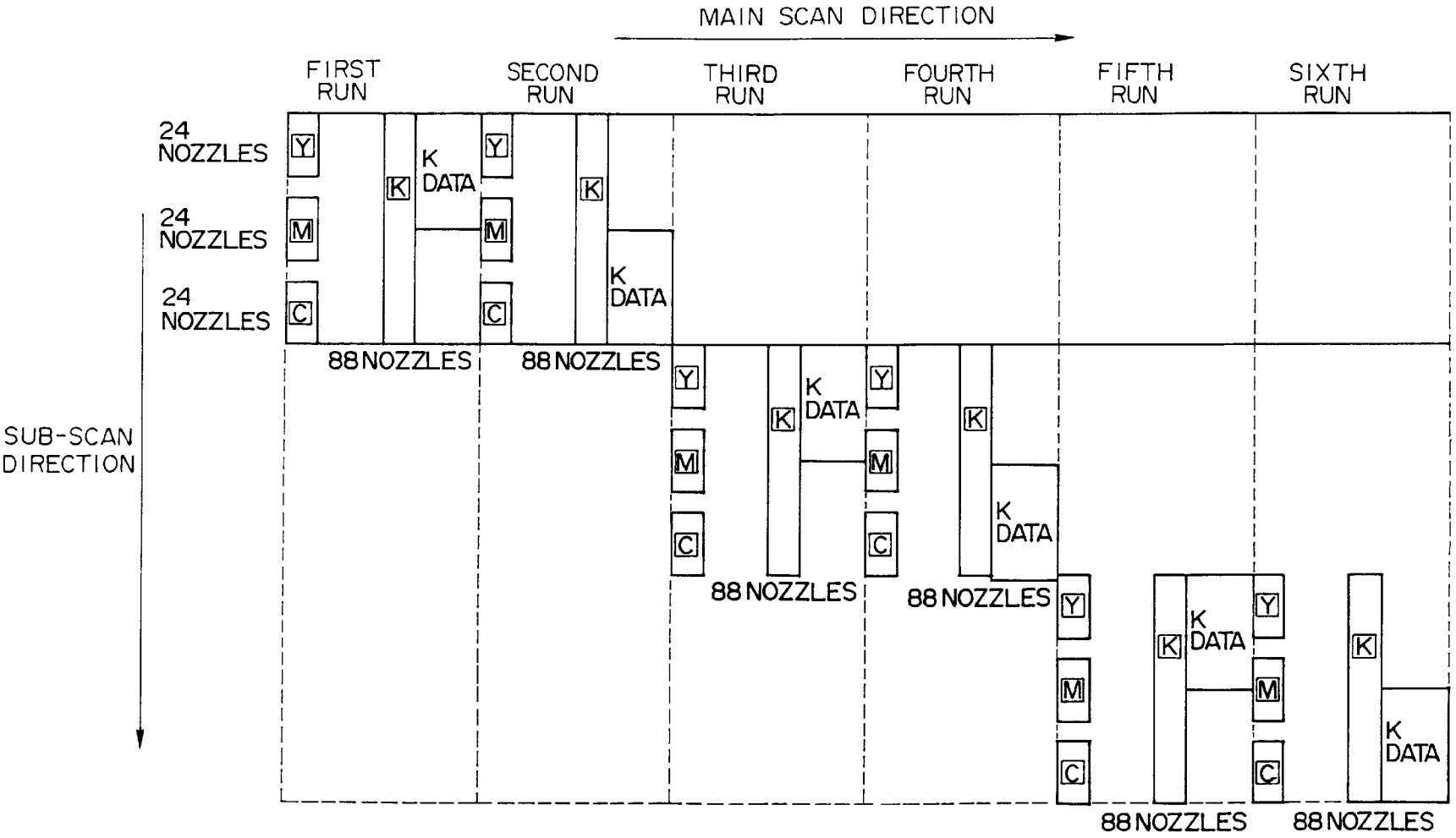
FIG. 66 is a typical view showing an operation of recording monochrome image by changing the used nozzle position of black head, with the recording head in the embodiment.

FIG. 66 is a typical view showing an instance of performing the recording by alternately using forty four nozzles among eighty eight nozzles of the black head 2Bk for each scan of the carriage 101 in recording the monochrome image. In this case, the recording sheet is conveyed by the amount of forty four nozzles for each scan of the carriage 101.

Figure 67:
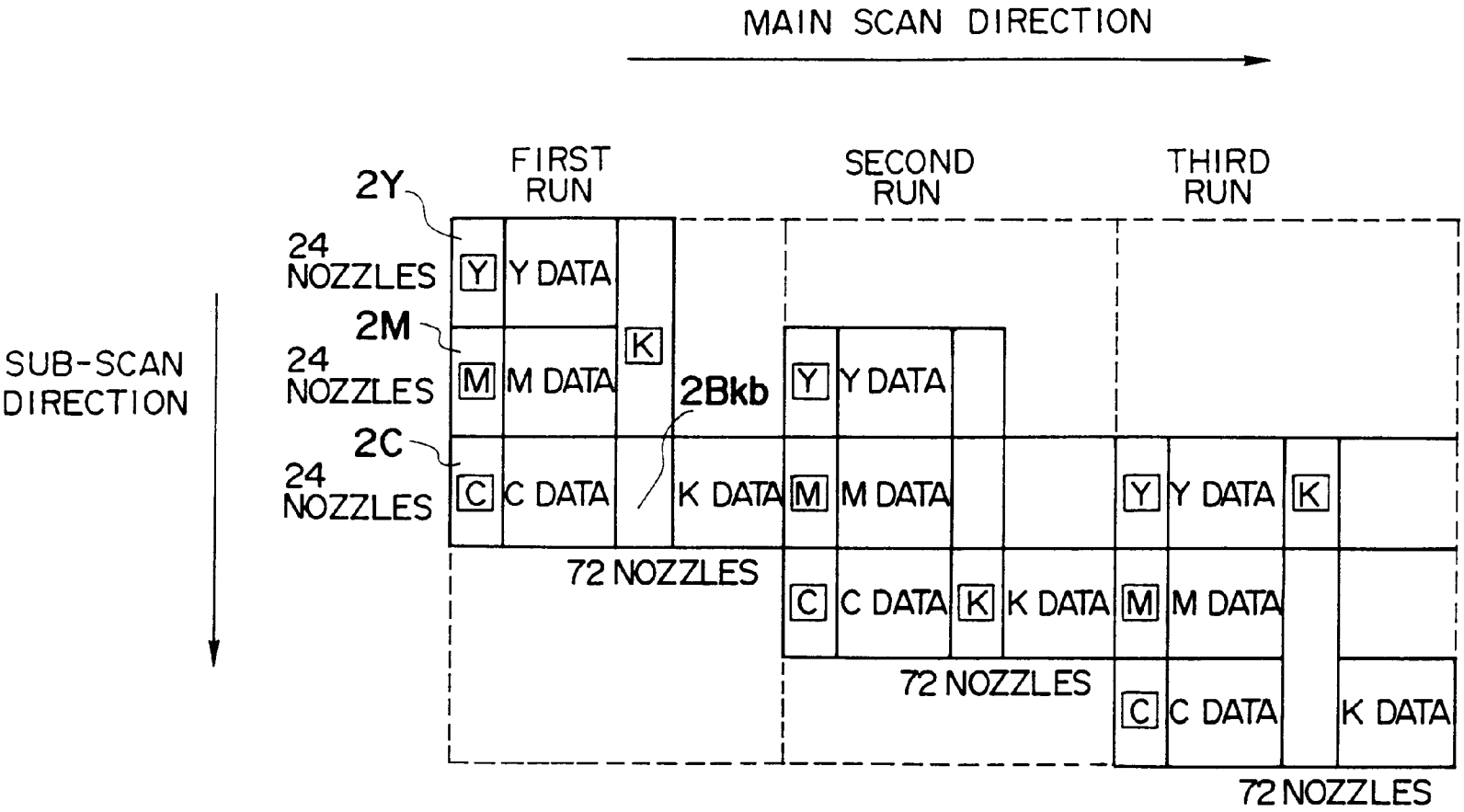
FIG. 67 is a typical view showing an operation of recording color image in units of 24 nozzles when there is no gap between recording heads for the color, with a variation of the recording head of the embodiment.

FIG. 67 is a typical view showing the recording operation of using the recording head without space between adjacent recording heads in the head array similar to that of the recording head 102 as previously described. Herein, the number of nozzles for the black head 2Bk is equal to 72.

In FIG. 67, at the recording of color image, the forty ninth to seventy second nozzles of the black head 2Bk are used.

In the first reciprocatory movement of the carriage 101 in the main scan direction, the recording is performed using all the nozzles of the cyan head 2C, and the forty ninth to seventy second nozzles of the black head 2Bk are used for the recording.

In the first reciprocatory movement of the carriage 101 in the main scan direction, the recording is performed using all the nozzles of the cyan head 2C and the forty ninth to seventy second nozzles of the black head 33*b*. Then, at the second scan of the carriage, the black data is recorded using the forty ninth to seventy second nozzles of the black head and the magenta data is recorded using all the nozzles of the magenta head 2M. And in the third reciprocatory movement of the carriage 101 in the main scan direction, the recording is performed using the forty ninth to seventy second nozzles of the black head 2Bk, and the yellow data is recorded using all the nozzles of the yellow head 2Y.

In this manner, the color image can be recorded by the amount of twenty four rasters on the recording sheet by reciprocating the carriage 101 having the recording head mounted in the main scan direction by three times.

Figure 68:
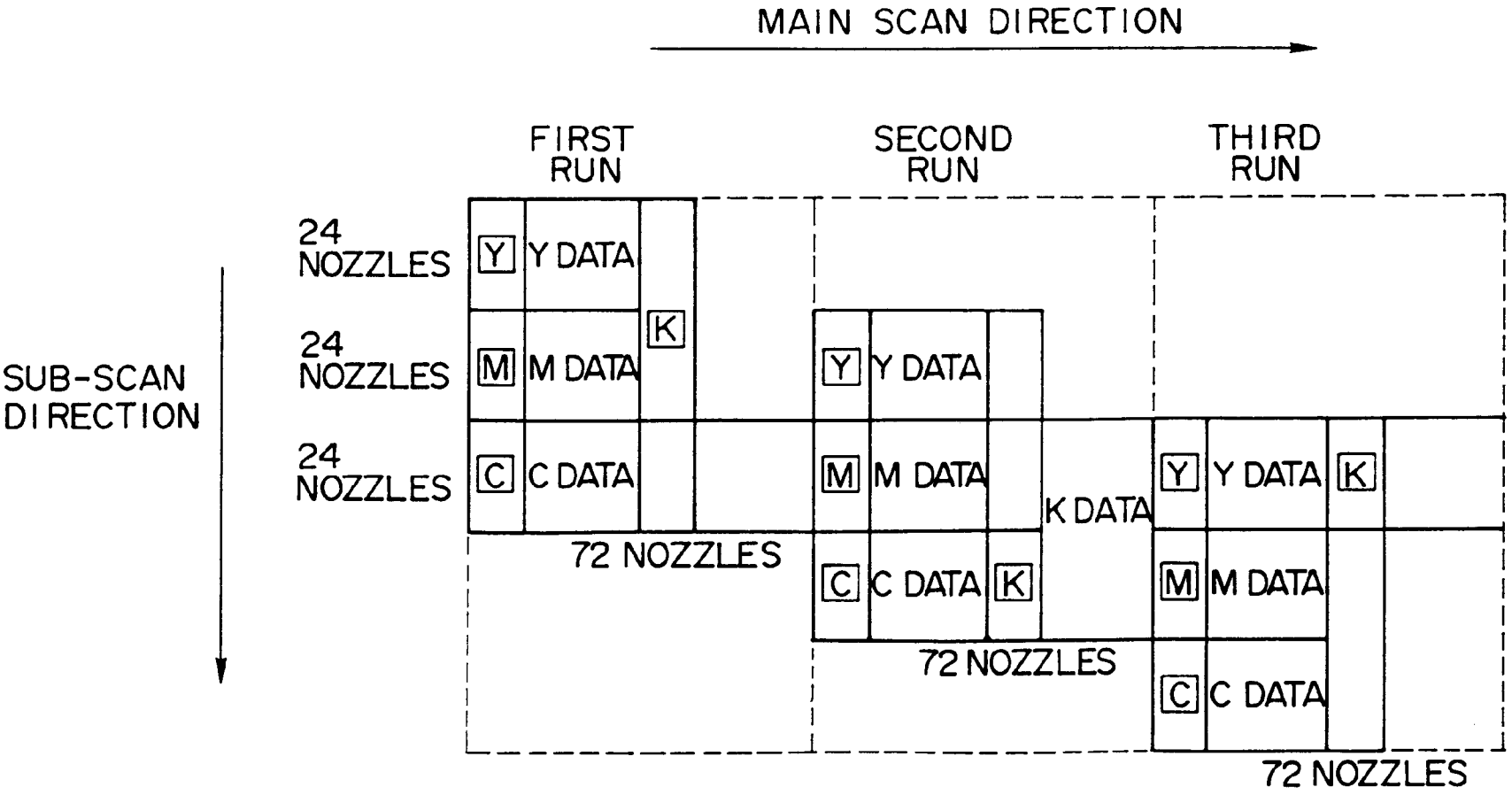
FIG. 68 is a typical view showing an operation of recording by changing the used nozzle position of black head when there is no gap between recording heads for the color, with a variation of the recording head of the second embodiment.

The recording operation of using forty eight nozzles of the black head 2Bk at the color recording, as shown in FIG. 68, will be described below. Herein, when the carriage 101 is moved in the main scan direction, the recording is performed using all the nozzles for each of the yellow, magenta and cyan heads and the twenty fifth to seventy second nozzles of the black head 2Bk. Also, the recording sheet is conveyed by the amount of twenty four nozzles in the sub-scan direction for each scan.

In the first reciprocatory movement of the carriage 101 in the main scan direction, the cyan data is recorded using all the nozzles of the cyan head, and at the second scan of the carriage 101, the recording is performed using all the nozzles of the magenta head 2M and the black data is recorded using the twenty fifth to seventy second nozzles of the black head 2Bk. And at the third reciprocatory movement of the carriage 101 in the main scan direction, the recording is performed using all the nozzles of the yellow head 2Y.

In this manner, in the color recording of this embodiment, the number of use nozzles for the black head 2Bk can be changed to twenty four or forty eight. On the other hand, when recording the monochrome image, the recording is performed using all the nozzles of the black head 2Bk. Therefore, there is great difference in the use frequency of nozzle between the color recording and the monochrome recording. For example, since the use frequency is different between the first to twenty fourth nozzles and the twenty fifth to seventy second nozzles of the black head 2Bk, the density unevenness may occur when the color image recording is switched to the monochrome image recording.

Therefore, the use frequencies of all the nozzles for the black head can be equalized by performing the predischarge control as described in the previous embodiments.

It should be noted that the present invention is applicable to a system comprised of a plurality of equipments or a single equipment. It should be also noted that the present invention is applicable where a system or equipment is supplied with a program for carrying out the present invention.

As described above, with this embodiment, when switching from the color image recording to the monochrome image recording, or conversely, the image can be recorded on the recording medium without producing density unevenness of the recording image.

Also, the recording quality can be enhanced with the minimum consumption of ink.

As described above, with the present invention, there is the effect that the high quality image can be recorded with least density unevenness of the recorded image.

Next, an ink jet recording method suitable for the present invention will be described below.

Figure 69:
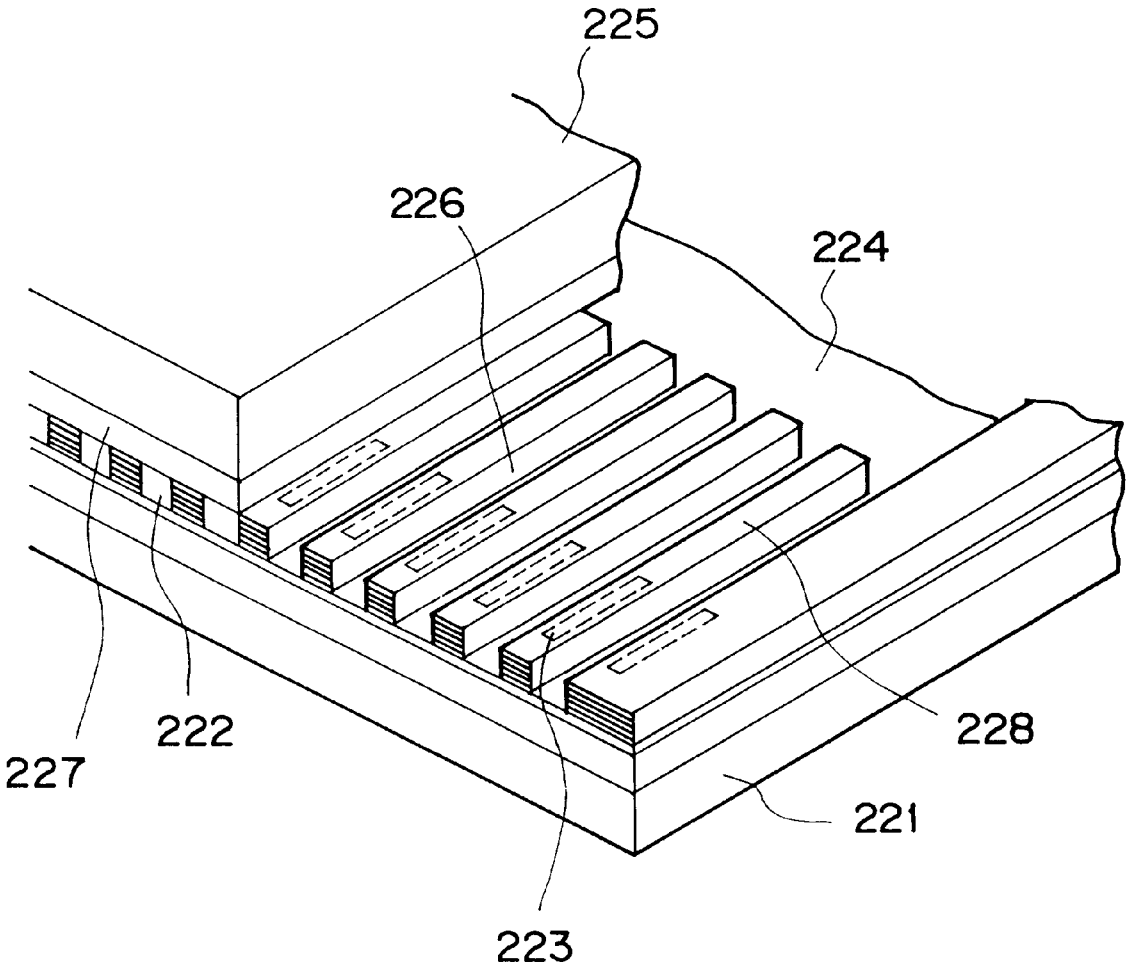
FIG. 69 is a detailed view showing the internal structure of an ink jet head which is mounted on the ink jet recording apparatus of the present invention.
Figure 70A:
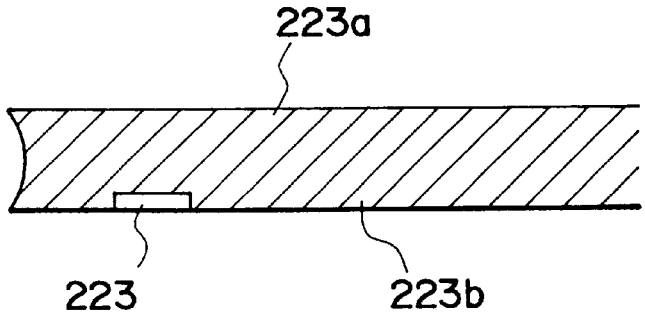
FIGS. 70A to 70E are views for explaining the discharge principle of an ink jet head.
Figure 70B:
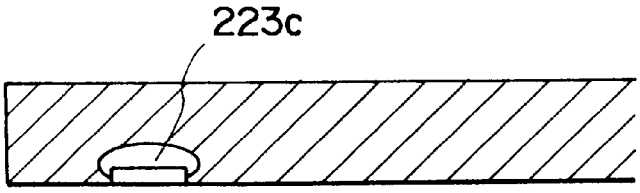
Figure 70C:
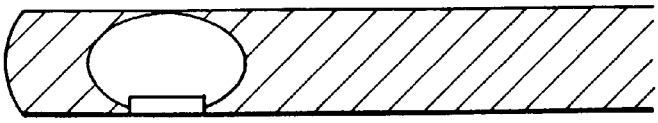
Figure 70D:
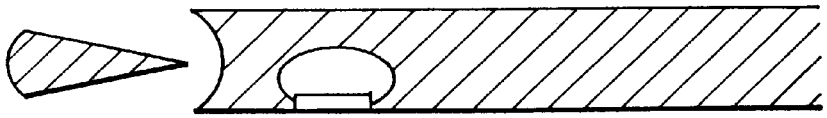
Figure 70E:
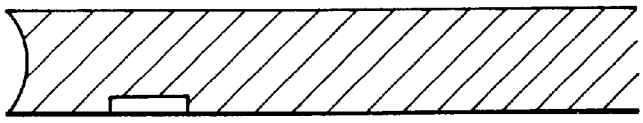

FIG. 69 shows the details of the inside of the nozzles 2Y, 2M, 2C and 2Bk. On a silicone substrate 221 are formed electricity-heat energy conversion elements (heaters) 223 and wirings at equal intervals through the same process as that for semiconductors, wherein a resin layer is laid between heaters 223 to form a partition wall 228, on to which a liquid channel forming member 227 is joined, and a ceiling plate 225 made of glass is joined thereon, whereby nozzles 222, liquid channels 226 and a common liquid chamber 224 are formed.

FIGS. 70A to 70E show the ink discharge principle through one nozzle of print head 102. FIGS. 70A to 70E show the discharge process.

(a) Discharge wait state. 223*a* is the ink and 223*b* is a liquid channel.

(b) State where a bubble 223*c* grows when an electric signal is applied to an ink discharging heater 223.

(c) State where the bubble is growing when the electric signal is continuously applied to the heater 223.

(d) State where a liquid droplet of the ink 223*a* is discharged.

(e) State where the heater 223 is electrically disconnected, and the ink 223*a* is refilled to a discharge orifice of nozzle.

In the above process, it is desired that the temperature elevation of the heater 223 is rapidly made and followed by the temperature elevation of the ink near the heater 223 to exhibit its function excellently, but it is necessarily difficult to realize the ideal discharge state only by applying a single phase electric pulse due to the outside air temperature and the ink characteristic. Therefore, a measure can be taken in which before heating by the heater, the temperature of the surroundings of nozzles 223*b* is retained, or a preheat pulse is applied immediately before an electric pulse for the generation of bubbles.

The present invention brings about excellent effects particularly in a recording apparatus using a recording head of the ink jet recording system of forming fine liquid droplets by the use of heat energy for the recording among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention. In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure waves of heat energy correspondent to the discharging portion. That is, the present invention makes it possible to realize the secure and efficient recording in whatever form the recording head may be configured.

In addition, among the serial-type recording heads as above described, the present invention is effective for a recording head fixed to the main device, a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and predischarging means for performing discharging separate from recording.

In addition, though the ink is considered as the liquid in the embodiments as above described, another ink may be also usable which is solid below room temperature and will soften or liquefy at or above room temperature, or liquefy when a recording signal is issued as it is common with the ink jet device to control the viscosity of ink to be maintained within a certain range of the stable discharge by adjusting the temperature of ink in a range from 30 to 70° C. In addition, in order to avoid the temperature elevation due to heat energy by positively utilizing the heat energy as the energy for the change of state from solid to liquid, or to prevent the evaporation of ink, the use of the ink which will solidify in the shelf state and liquefy by heating is also possible. In any event, the ink that will liquefy only with the application of heat energy, such as liquefying with the application of heat energy in accordance with a recording signal so that liquid ink is discharged, or may be already solidifying prior to reaching the recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on the film boiling.

Further, an ink jet recording apparatus according to the present invention may be used as an image output terminal for the information processing equipment such as a computer, a copying machine in combination with a reader, or a facsimile terminal equipment having the transmission and reception feature.

What is claimed is:

1. An ink jet recording method for obtaining a multi-color image comprising the steps of:

providing an ink jet recording apparatus in which a recording head is scanned in a main scan direction relative to a recording medium to record an image and the recording medium is scanned relatively in a sub-scan direction perpendicular to the main scan direction, the recording head having a group of m black discharge elements for discharging black ink and a plurality of groups of n color discharge elements ($m \geqq 2n$) for discharging color inks and the groups of the discharge elements corresponding to the black ink and the color irk being arranged in an arranging direction and being not overlapped with each other in the main scan direction;

recording by selecting at least one predetermined discharge element among the group of m black discharge elements in a case of forming an image in which an image formed by black ink is adjacent to an image formed by color ink, the selected at least one predetermined black discharge element being separated from the color discharge elements by a plurality of non-selected black discharge elements and being spaced apart from each other by a distance of at least n discharge elements at least in the arranging direction of the discharge elements; and conveying the recording medium by a distance corresponding to the n discharge elements.

2. An ink jet recording method according to claim 1, wherein said color inks comprise yellow, magenta, and cyan inks.

3. An ink jet recording method according to claim 1, wherein said group of black discharge elements for discharging the black ink is disposed at an end portion of said recording head.

4. An ink jet recording method according to claim 1, wherein a space is provided between said groups of discharge elements for each color.

5. An ink jet recording method according to claim 1, wherein the at least one predetermined black discharge element includes a number l of said black discharge elements for discharging the black ink, and an inequality $l \leqq n$ is satisfied.

6. An ink jet recording method according to claim 5, wherein a feed pitch of the recording medium where the black image and the color image are adjacent corresponds to the number l of discharge elements.

7. An ink jet recording method according to claim 1, wherein the inks are discharged by heat energy.

8. An ink jet recording apparatus comprising:

main scan means for scanning a recording head in a main scan direction relative to a recording medium;

sub-scan means for scanning the recording medium relatively in a sub-scan direction perpendicular to the main scan direction;

image forming control means for forming an image by driving said recording head during scanning said recording head by said main scan means in the main scan direction, said recording head having a group of m black discharge elements for discharging black ink and a plurality of groups of n color discharge elements ($m \geqq 2n$) for discharging color inks corresponding to a plurality of colors and the groups of the discharge elements corresponding to the black ink and color inks being arranged in an arranging direction and being not overlapped with each other in the sub-scan direction; and selecting means for selecting a predetermined portion of the black discharge elements including at least one discharge element among said group of m black discharge elements for discharging the black ink in recording during the scanning by said main scan means, said at least one black discharge element and the color discharge elements being spaced apart from each other by a distance of n discharge elements at least in the arranging direction of the discharge elements, wherein said selecting means selects said predetermined portion for discharging the black ink in order to record an area where a black image to be recorded with the black ink and a color image to be recorded with the color ink are contiguous, a main scan for forming the black image with said predetermined portion of black discharge elements for discharging the black ink and a main scan for forming the color image with said groups of color discharge elements for discharging the color inks are not contiguous.

9. An ink jet recording apparatus according to claim 8, wherein said color inks comprise yellow, magenta, and cyan ink.

10. An ink jet recording apparatus according to claim 8, wherein said group of discharge elements for discharging the black ink is arranged on the end portion of said recording head in a direction orthogonal to the direction of main scan by said relative main scan means.

11. An ink jet recording apparatus according to claim 8, wherein a space is provided between said group of discharge elements for discharging the black ink and each of said groups of discharge elements for discharging the color inks.

12. An ink jet recording apparatus according to claim 1, wherein the predetermined portion of black discharge elements includes a number l of black discharge elements selected by said selecting means, and an inequality $l \leqq n$ is satisfied.

13. An ink jet recording apparatus according to claim 12, wherein a relative scanning amount by said sub-scan means corresponds to a length encompassed by l discharge elements.

14. An ink jet recording apparatus according to claim 1, wherein said discharge elements comprise heat energy generating means for applying heat energy to the ink to cause a state change in the ink due to the heat, and causing the ink to be discharged through discharge portions due to the state change, so as to form fine ink droplets.

15. An ink jet recording method for obtaining a multicolor image, said method comprising the steps of:

providing an ink jet recording apparatus in which a recording head is scanned in a main scan direction relative to a recording medium to record an image and the recording medium is scanned relatively in a sub-scan direction perpendicular to the main scan direction, said recording head having an array of nozzles corresponding to at least one specific color and an array of nozzles corresponding to a plurality of colors other than the specific color, wherein the number of the nozzles forming the nozzle array for discharging ink of the specific color is N times more than the number of the nozzles forming the nozzle array for discharging ink of the other colors; and recording an image formed by the specific color and the plurality of other colors, wherein recording the image by applying ink of the specific color to a predetermined area is performed in a plurality of the main scans by said main scan means and performed M times more than a number of the main scans in recording the image by applying ink of the other colors to the predetermined recording area, and M and N are integers greater than two and $N \geqq M$, and wherein recording of the image by the specific color is intermittently performed in each scan of the plurality of main scans and the recording is performed such that the frequency of use of the nozzles for one recording operation is lowered.

16. An ink jet recording method according to claim 15, where an ink discharge amount for the specific color per dot is greater when recording code information including a character or a symbol than when recording bit map data including an image.

17. An ink jet recording method according to claim 15, wherein the at least one specific color comprises at least one of black and yellow.

18. An ink jet recording method according to claim 15, wherein the recording head comprises heat energy generating means to cause a state change in ink due to heat, and causes the ink to be discharged through nozzles based on the state change, so as to form fine ink droplets.

19. An ink jet recording method comprising the steps of:

providing an ink jet recording head having two or more color inks and two or more nozzle groups, each of which discharges the ink corresponding to one color, a number of nozzles in each nozzle group corresponding to at least one color being different from a number of nozzles for other colors, among nozzle groups corresponding to the colors; and effecting recording for a certain area, wherein among nozzle groups corresponding to the colors, a recording pixel charging frequency per nozzle among nozzles actuated in said recording effecting step for at least one nozzle group having a greatest number of nozzles at the certain area is smaller than a recording pixel charging frequency for the nozzle groups of other colors at the certain area, and recording of the certain area by the nozzle group having the largest number of nozzles is performed intermittently by complementary patterns in a plurality of scans.

20. An ink jet recording method according to claim 19, wherein the color of the ink corresponding to the at least one nozzle group having the greatest number of nozzles among the nozzle groups corresponding to the colors is black.

21. An ink jet recording method according to claim 19, wherein the color of the ink corresponding to the at least one nozzle group having the greatest number of nozzles among the nozzle groups corresponding to the colors is yellow.

22. An ink jet recording method according to claim 19, wherein a color of the ink corresponding to the at least one nozzle group having the greatest number of nozzles among the nozzle groups corresponding to the colors is one of black and yellow.

23. An ink jet recording method according to claim 19, wherein, among said nozzle groups, the number of nozzles for a nozzle group A of a color having the greatest number of nozzles is NA and the number of nozzles for a nozzle group B having the smallest number of nozzles is NB, $$NA \geqq 2 \cdot NB$$

holds.

24. An ink jet recording method according to claim 19, wherein the inks comprise four colors including black, cyan, magenta and yellow.

25. An ink jet recording method according to claim 14, wherein the number of nozzles for a nozzle group of black ink is Nk, the number of nozzles for a nozzle group of cyan ink is Nc, the number of nozzles for a nozzle group of magenta ink is Nm, and the number of nozzles for a nozzle group of yellow ink is Ny, $$Nk \geqq 2 \cdot Nc = 2 \cdot Nm = 2 \cdot Ny$$

holds.

26. An ink jet recording method according to claim 19, wherein among said nozzle groups, the number of nozzles for a nozzle group A of a color having the greatest number of nozzles is NA, and the number of nozzles for a nozzle group B having the smallest number of nozzles is NB, the recording pixel charging frequency PA for the nozzle group A and the recording pixel charging frequency PB for the nozzle group B has a relation $$PB \cdot NB/NA \leqq PA < PB.$$

27. An ink jet recording method according to claim 19, wherein among said nozzle groups, the number of nozzles for a nozzle group A having the greatest number of nozzles is NA, and the number of nozzles for a nozzle group B having the smallest number of nozzles is NB, a scan of said ink jet recording head relative to the recording medium in recording of a specific area is effected so that a number of scans for recording by the nozzle group A is greater than that for recording by the nozzle group B.

28. An ink jet recording method according to claim 27, wherein in recording the specific area, the scan of the recording head relative to the recording medium is effected so that for a substantial average scan number SA for the nozzle group A and a substantial average scan number SB for the nozzle group B, $$SB < SA \leqq SB \cdot NA/NB.$$

29. An ink jet recording method according to claim 19, wherein among the nozzle groups corresponding to said colors, the recording of a specific area by the nozzle group having the greatest number of nozzles is performed in complementary patterns in at least two scans.

30. An ink jet recording method according to claim 19, wherein among the nozzle groups corresponding to said colors, the number of nozzles for the nozzle group having the greatest number of nozzles is twice that of other nozzle groups, and recording of a specific area by said nozzle group having the greatest number of nozzles is performed in complementary patterns in two scans.

31. An ink jet recording method according to claim 30, wherein said specific area is a recording area corresponding to nozzles of nozzle groups for the other colors.

32. An ink jet recording method according to claim 30, wherein said complementary patterns are a cross pattern and a counter-cross pattern.

33. An ink jet recording method according to claim 19, wherein said ink jet recording head causes a state change in the ink due to heat and discharges the ink based on the state change to form fine liquid droplets.

34. An ink jet recording apparatus comprising a plurality of recording heads each having a different number of nozzles, said recording heads performing the recording on a recording medium by discharging the ink through said nozzles, said apparatus comprising:

means for creating image data corresponding to each of said plurality of recording heads;

means for storing said image data;

means for detecting a number of ejections from the nozzles for all the nozzles of said plurality of recording heads;

means for producing a discharge pattern to equalize use frequencies for all the nozzles of a recording head having more nozzles than other recording heads among said plurality of recording heads in accordance with the number of ejections detected by said means for detecting; and means for masking the image data of said storage means with the discharge pattern, wherein each ink jet recording head has two or more color inks and two or more nozzle groups, each of which discharges the ink corresponding to one color, a number of nozzles in each nozzle group corresponding to at least one color being different from a number of nozzles for other colors, among nozzle groups corresponding to the colors; and wherein in effecting recording for a certain area, among nozzle groups corresponding to the colors, a recording pixel charging frequency per nozzle among nozzles discharging ink to effect recording for at least one nozzle group having a greatest number of nozzles at the certain area is smaller than a recording pixel charging frequency for the nozzle groups of other colors at the certain area, and recording of the certain area by the nozzle group having the largest number of nozzles is performed intermittently by complementary patterns in a plurality of scans.

35. An ink jet recording apparatus according to claim 34, wherein said plurality of recording heads produce bubbles in the ink by the use of heat energy and discharge the ink based on the production of the bubbles.

36. An ink jet recording method of performing recording by scanning at least one recording head relative to a recording medium, the at least one recording head having a nozzle group of m nozzles for discharging black ink and a plurality of nozzle groups of n (n<m) nozzles for discharging color inks, corresponding to a plurality of colors, said method comprising the steps of:

storing image data for an image to be recorded;

producing a discharge pattern to equalize use frequencies of nozzles for said nozzle group for discharging the black ink;

masking said image data with said discharge pattern; and performing recording in accordance with said image data masked in said masking step, wherein during said performing recording step the at least one recording head is scanned in a main scan direction relative to a recording medium to record an image and the recording medium is scanned relatively in a sub-scan direction perpendicular to the main scan direction, said recording head having an array of nozzles corresponding to a black color and an array of nozzles corresponding to a plurality of colors other than the black color, wherein the number of the nozzles forming the nozzle array for discharging ink of the black color is N times more than the number of the nozzles forming the nozzle array for discharging ink of the other colors; and wherein in recording an image formed by the black color and the plurality of other colors during said performing recording step, recording the image by applying ink of the black color to a predetermined area is performed in a plurality of the main scans by said main scan means and performed M times more than a number of the main scans in recording the image by applying ink of the other colors to the predetermined recording area, and M and N are integers greater than two and $N \geqq M$, and wherein recording of the image by the black color is intermittently performed in each scan of the plurality of main scans during said performing recording step and the recording is performed such that the frequency of use of the nozzles for one recording operation is lowered.

37. An ink jet recording method according to claim 36, wherein said color inks comprise yellow, magenta and cyan inks.

38. An ink jet recording method according to claim 36, wherein said nozzle group for discharging the black ink and said nozzle groups for discharging the color inks are provided in one recording head.

39. An ink jet recording method according to claim 36, wherein said nozzle group for discharging the black ink and said nozzle groups for discharging the color inks are provided in separate recording heads.

40. An ink jet recording apparatus comprising a plurality of recording heads each having a different number of nozzles, said recording heads performing the recording on a recording medium by discharging the ink through said nozzles, said apparatus comprising:

means for creating image data corresponding to each of said plurality of recording heads;

means for storing said image data;

means for detecting a number of ejections from the nozzles for all the nozzles of said plurality of recording heads;

means for producing a discharge pattern to equalize use frequencies for all the nozzles of a recording head having more nozzles than other recording heads among said plurality of recording heads in accordance with the number of ejections detected by said means for detecting;

means for masking the image data of said storage means with the discharge pattern; and means for altering the discharge pattern for every predetermined number of pages of the recording medium, wherein each ink jet recording head has two or more color inks and two or more nozzle groups, each of which discharges the ink corresponding to one color, a number of nozzles in each nozzle group corresponding to at least one color being different from a number of nozzles for other colors, among nozzle groups corresponding to the colors; and wherein in effecting recording for a certain area, among nozzle groups corresponding to the colors, a recording pixel charging frequency per nozzle among nozzles discharging ink to effect recording for at least one nozzle group having a greatest number of nozzles at the certain area is smaller than a recording pixel charging frequency for the nozzle groups of other colors at the certain area, and recording of the certain area by the nozzle group having the largest number of nozzles is performed intermittently by complementary patterns in a plurality of scans.

* * * * *

UNITED STATES PATENT AND TRADEMARK OFFICE

CERTIFICATE OF CORRECTION

PATENT NO. : 6,086,185
DATED : July 11, 2000
INVENTOR(S) : Inui, Toshiharu et al.

It is certified that error appears in the above-identified patent and that said Letters Patent is hereby corrected as shown below:

Title page,
Item [75], Inventors, "Yasuhiro Numata, Kawasaki; Takayoshi Ishino;" should be deleted; also "both of" should be deleted.

Column 1,
Line 58, "the" should be deleted.

Column 5,
Line 5, "provide" should read -- provides --; and
Line 38, "us ed" should read -- used --.

Column 6,
Line 25, "can" should read -- scan --.

Column 8,
Lines 24-25, "adjacent in" should read -- adjacent another in --.

Column 10,
Lines 13 and 23, "10d," should read -- 10d', --;
Line 49, "twenty fifth" should read -- twenty-fifth --.

Column 12,
Lines 22 and 29, "or" should read -- for --.

Column 15,
Line 56, "PB‰ 6/12=PA" should read -- PB•6/12=PA --.

Column 16,
Line 11, "121" should read -- 121' --; and
Line 42, "121-" should read -- 121" --.

Column 17,
Line 5, "121" should read -- 121''' --; and
Line 54, "a rerecorded" shoud read -- are recorded --.

Column 18,
Line 64, "with-other" should read -- with other --.

UNITED STATES PATENT AND TRADEMARK OFFICE

CERTIFICATE OF CORRECTION

PATENT NO. : 6,086,185
DATED : July 11, 2000
INVENTOR(S) : Inui, Toshiharu et al.

It is certified that error appears in the above-identified patent and that said Letters Patent is hereby corrected as shown below:

Column 21,
Line 18, "more that" should read -- more than that --.

Column 26,
Line 6, "fifty sixty" should read -- fifty sixth --.

Column 37,
Line 56, "data the" should read -- data is then --.

Column 44,
Line 41, "eightly eighth" should read -- eighty eighth --.

Column 50,
Line 42, "irk" should read -- ink --.

Signed and Sealed this

Twenty Seventh Day of November, 2001

*Attest:*

Nicholas P. Godici

NICHOLAS P. GODICI
*Acting Director of the United States Patent and Trademark Office*

*Attesting Officer*